US012638195B2

(12) United States Patent
Liu et al.

(10) Patent No.: US 12,638,195 B2
(45) Date of Patent: May 26, 2026

(54) WEARABLE AIR CONDITIONER

(71) Applicant: Shenzhen Lanhe Technologies Co., Ltd., Shenzhen (CN)

(72) Inventors: Kai Liu, Shenzhen (CN); You Lai, Shenzhen (CN); Guang Yang, Shenzhen (CN); Weiping Li, Shenzhen (CN); Guowei Song, Shenzhen (CN); Xunhuan Wu, Shenzhen (CN); Xiaofeng Yue, Shenzhen (CN); Xiankun Fang, Shenzhen (CN); Yongsheng Yang, Shenzhen (CN); Tong Li, Shenzhen (CN)

(73) Assignee: SHENZHEN LANHE TECHNOLOGIES CO., LTD., Shenzhen (CN)

( * ) Notice: Subject to any disclaimer, the term of this patent is extended or adjusted under 35 U.S.C. 154(b) by 463 days.

(21) Appl. No.: 18/315,461

(22) Filed: May 10, 2023

(65) Prior Publication Data

US 2023/0280050 A1 Sep. 7, 2023

Related U.S. Application Data

(63) Continuation-in-part of application No. PCT/CN2022/131161, filed on Nov. 10, 2022, and a (Continued)

(30) Foreign Application Priority Data

Nov. 12, 2020 (CN) ..... 202022621762.7
Dec. 31, 2020 (CN) ..... 202023347595.8

(Continued)

(51) Int. Cl.
*F24F 5/00* (2006.01)
*F24F 11/52* (2018.01)

(Continued)

(52) U.S. Cl.
CPC ..... *F24F 5/00* (2013.01); *F24F 11/52* (2018.01); *F24F 13/32* (2013.01); *F24F 2120/00* (2018.01)

(58) Field of Classification Search
CPC .... F24F 5/00; F24F 11/52; F24F 13/32; F24F 2120/00

(Continued)

(56) References Cited

U.S. PATENT DOCUMENTS 5,802,865 A * 9/1998 Strauss ..... A61F 7/10 62/259.3
6,125,636 A * 10/2000 Taylor ..... H10N 10/00 62/3.5

(Continued)

FOREIGN PATENT DOCUMENTS

CN 205787943 U 12/2016
CN 206837012 U 1/2018

(Continued)

*Primary Examiner* — Steven B McAllister
*Assistant Examiner* — Dana K Tighe
(74) *Attorney, Agent, or Firm* — Andrew C. Cheng

(57) ABSTRACT

A wearable air conditioner includes a shell for being worn around a wearing portion of a user, a fan and a temperature regulating member disposed in the shell. The shell includes a first air passage, a first accommodating chamber, at least one air outlet in communication with the first air passage, and vent holes in communication with the first accommodating chamber. The temperature regulating member is configured for generating heat energy or cold energy. The temperature regulating member is in thermal connection with a sidewall of the first accommodating chamber. An airflow generated by the fan is capable of entering the first air passage and then exiting the shell via the at least air outlet.

16 Claims, 39 Drawing Sheets

Related U.S. Application Data continuation-in-part of application No. PCT/CN2021/142258, filed on Dec. 29, 2021, and a continuation-in-part of application No. PCT/CN2021/130428, filed on Nov. 12, 2021.

(30) Foreign Application Priority Data

| | | |
|---|---|---|
| Jan. 19, 2021 | (CN) | 202120144247.6 |
| Jan. 22, 2021 | (CN) | 202120186085.2 |
| Nov. 11, 2021 | (CN) | 202111335013.0 |
| Nov. 15, 2021 | (CN) | 202122791059.5 |
| Dec. 20, 2021 | (CN) | 202123206726.5 |
| Mar. 10, 2022 | (CN) | 202220549967.5 |
| Apr. 23, 2022 | (CN) | 202220957359.8 |

(51) Int. Cl.
*F24F 13/32* (2006.01)
*F24F 120/00* (2018.01)

(58) Field of Classification Search
USPC ..... 454/239
See application file for complete search history.

(56) References Cited

U.S. PATENT DOCUMENTS

| | | | | |
|---|---|---|---|---|
| 10,709,601 | B2 * | 7/2020 | Adair | A61F 7/02 |
| 2017/0266038 | A1 * | 9/2017 | Peavy | A41D 13/0053 |
| 2017/0370596 | A1 * | 12/2017 | Lee | A42B 3/286 |
| 2020/0187574 | A1 * | 6/2020 | Te Hsiang | A41D 13/0053 |

FOREIGN PATENT DOCUMENTS

| | | | |
|---|---|---|---|
| CN | 208339656 | U | 1/2019 |
| CN | 209354401 | U | 9/2019 |
| CN | 209689110 | U | 11/2019 |
| CN | 111120369 | A | 5/2020 |
| CN | 211039122 | U | 7/2020 |
| CN | 211049811 | U | 7/2020 |
| CN | 211116731 | U | 7/2020 |
| CN | 211525144 | U | 9/2020 |
| CN | 111765125 | A | 10/2020 |
| CN | 211633838 | U | 10/2020 |
| CN | 211692897 | U | 10/2020 |
| CN | 211692914 | U | 10/2020 |
| CN | 211778092 | U | 10/2020 |
| CN | 211781697 | U | 10/2020 |
| CN | 211874774 | U | 11/2020 |
| CN | 211874797 | U | 11/2020 |
| CN | 212536127 | U | 2/2021 |
| CN | 212690401 | U | 3/2021 |
| CN | 213392789 | U | 6/2021 |
| CN | 213450914 | U | 6/2021 |
| CN | 213747118 | U | 7/2021 |
| CN | 213931250 | U | 8/2021 |
| CN | 214198974 | U | 9/2021 |
| CN | 214404034 | U | 10/2021 |
| CN | 214404053 | U | 10/2021 |
| CN | 215570928 | U | 1/2022 |
| JP | 2006086980 | A | 3/2006 |
| JP | 2009009961 | A | 1/2009 |
| JP | 2019105266 | A | 6/2019 |
| JP | 3230942 | U | 3/2021 |
| JP | 2021188535 | A | 12/2021 |
| KR | 102089967 | B | 3/2020 |
| KR | 20210000100 | U | 1/2021 |

* cited by examiner

WEARABLE AIR CONDITIONER

CROSS REFERENCE TO RELATED APPLICATIONS

This application is a continuation-in-part of International Patent Applications: 1) PCT/CN2021/130428 filed on Nov. 12, 2021, which claims priority of China Patent Application No. 202022621762.7, filed on Nov. 12, 2020; 2) No. PCT/CN2022/131161, filed on Nov. 10, 2022, which claims priority of China Patent Application No. 202123206726.5, filed on Dec. 20, 2021, China Patent Application No. 202220549967.5, filed on Mar. 10, 2022, China Patent Application No. 202122791059.5, filed on Nov. 15, 2021, China Patent Application No. 202220957359.8, filed on Apr. 23, 2022, and China Patent Application No. 202111335013.0 filed on Nov. 11, 2021; and 3) No. PCT/CN2021/142258, filed on Dec. 29, 2021, which claims priority of China Patent Application No. 202023347595.8, filed on Dec. 31, 2020, China Patent Application No. 202120144247.6, filed on Jan. 19, 2021, and China Patent Application No. 202120186085.2, filed on Jan. 22, 2021. The contents of the above-identified applications are incorporated herein by reference.

TECHNICAL FIELD

The present disclosure relates to the technical field of household electrical appliances, in particular to a wearable air conditioner.

BACKGROUND

With people's growing request for a more convenient life in recent years, various portable fans such as neck fans have appeared in the market to meet the needs in outdoor activities or other life scenes.

Neck fans overcome the limitation of hand-held fans. Whether it is during exercise and outdoor activities or in the office, neck fans can achieve the effect of blowing air anytime and anywhere while freeing users' hands. However, traditional neck fans have only one single cooling mode, that is, blowing air for cooling. The cooling efficiency cannot meet requirements of some users.

BRIEF SUMMARY OF THE INVENTION

The purpose of this present application is to provide an improved wearable air conditioner with an improved temperature adjusting effect and wide application scenarios.

In one aspect, the present disclosure provides a wearable air conditioner which comprises a body for being worn around a wearing portion of a user, a fan and a temperature regulating member disposed in the body. The body comprises a first air passage, a first accommodating chamber, at least one air outlet in communication with the first air passage, and vent holes in communication with the first accommodating chamber. The temperature regulating member is disposed in the first accommodating chamber of the body and configured to generate heat energy or cold energy, the temperature regulating member being in thermal connection with a sidewall of the body. An airflow generated by the fan is capable of entering the first air passage and the first accommodating chamber and then exiting the body via the at least air outlet and the vent holes.

In another aspect, the present disclosure further provides a wearable air conditioner which comprises a body for being hung around a wearing portion of a user; and a temperature regulating member disposed in the body and configured for generating heat energy or cold energy. The body comprises two shells and an elastic restore member connected between the two shells to cooperatively form a wearing space corresponding to the wearing portion. Each shell comprises an inner sidewall facing the wearing space and the temperature regulating member is in thermal connection with inner sidewall.

In yet another one aspect, the present disclosure further provides a portable air conditioner comprising a shell, a temperature regulating member disposed in the shell and configured for generating heat energy or cold energy, and a temperature conducting portion disposed on an outer surface of the shell. The temperature conducting portion is in thermal contact with the temperature regulating member. A temperature sensing layer is provided on a surface of the temperature conducting portion and configured for indicating temperature information of the temperature conducting portion.

In further another aspect, the present disclosure further provides a wearable air conditioner, comprising a shell for being worn around a wearing portion of a user, the shell comprising a first air passage, a first accommodating chamber, at least one air outlet in communication with the first air passage, and vent holes in communication with the first accommodating chamber; a fan disposed in the shell. An airflow generated by the fan is capable of entering the first air passage and then exiting the shell via the at least air outlet. A temperature regulating member is disposed in the first accommodating chamber of the shell and configured to generate heat energy or cold energy, the temperature regulating member being in thermal connection with a sidewall of the shell. A heat dissipation member is attached to the temperature regulating member and faces the vent holes.

DETAILED DESCRIPTION OF THE INVENTION

Figure 1:
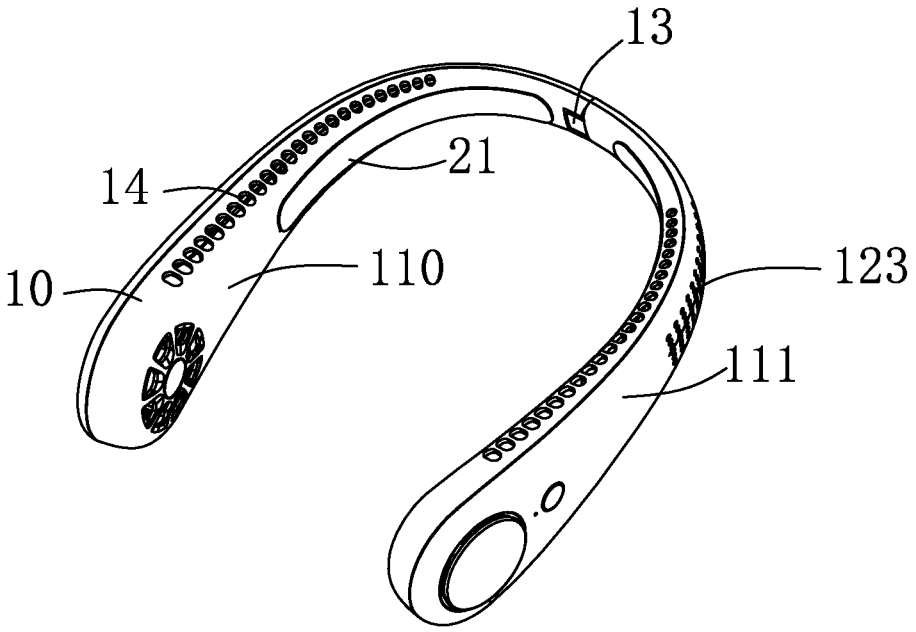
FIG. 1 is a perspective assembled view of a wearable air conditioner according to a first embodiment of the present invention.
Figure 2:
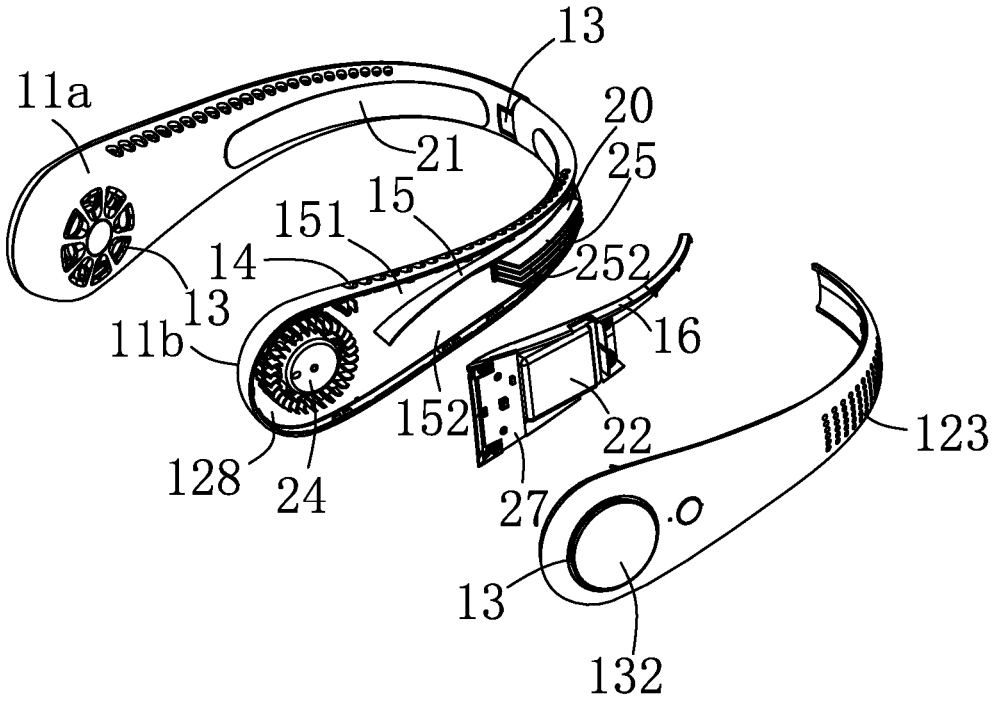
FIG. 2 is a partially exploded view of FIG. 1.
Figure 3:
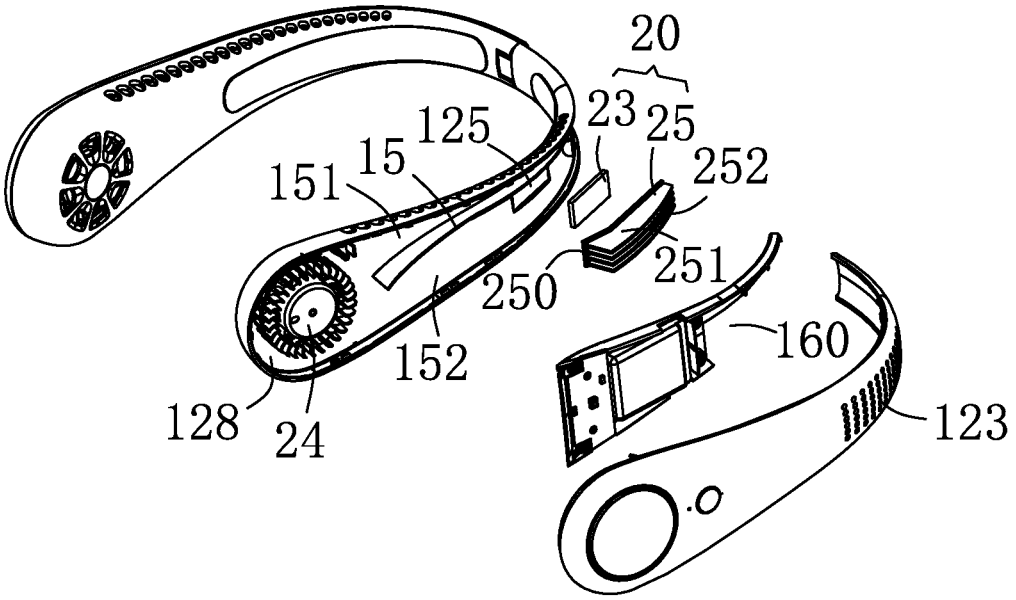
FIG. 3 is a further exploded view of FIG. 2.
Figure 4:
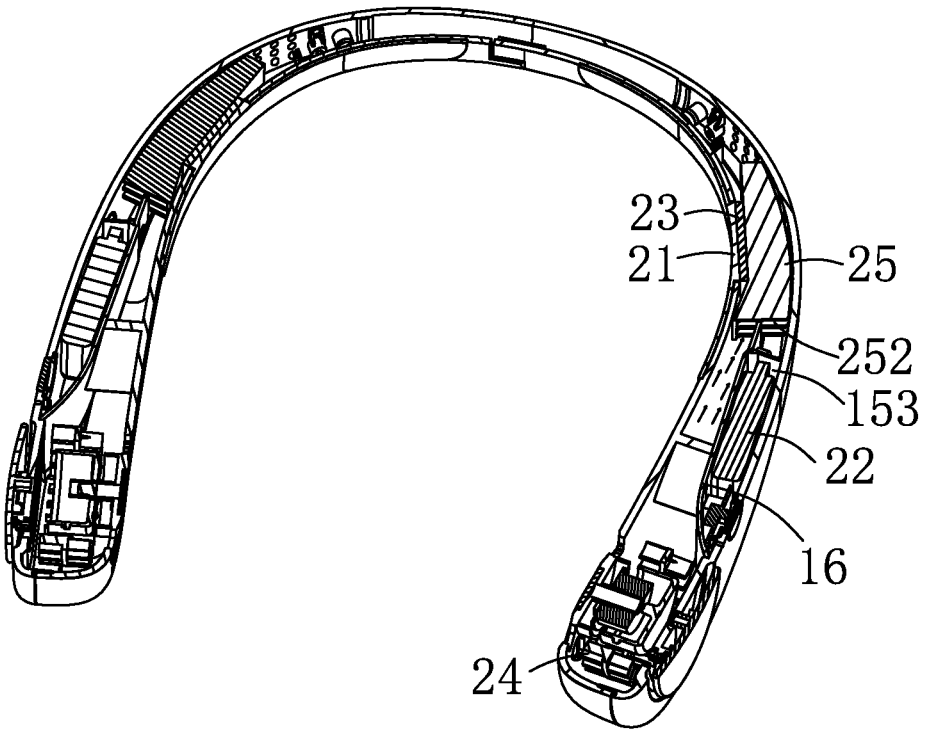
FIG. 4 is a sectional view of the wearable air conditioner of FIG. 1.

In order to have a clearer understanding of the technical features, objects and effects of the present invention, the specific embodiments of the present invention will now be described in detail with reference to the accompanying drawings. Unless otherwise specified, all the technical and scientific terms adopted in the disclosure are literally consistent with what understood by the artisans of the technical field of the present invention. The terminology applied in the specification of the present invention is adopted for the purposes of describing specific embodiments and are not intended to constrain the present invention. In the following description, the expression "some embodiments" refers to a subset of all possible embodiments, but it should be understood that "some embodiments" may be the same or different subsets of all possible embodiments and may be combined with each other without conflicting.

It is noted that the terms used herein, such as "front", "rear", "left", "right", "up", "down", "first", and "second", are applied for easy illustration of the technical solution of the present invention and are not for indicating that a designated device or component has to demonstrate a specific difference, and thus, should not be construed as constraints to the present invention. It is noted that when an object is identified as being "fixed to" another object, it can be directly fixed to said another object, or there may simultaneously exist an intermediate object. When a component is identified as being "connected to" another component, it can be directly connected to said another component or there may simultaneously exist on an intermediate component. The terms "vertical", "horizontal", "inner", "outer", "left", "right", and similar expressions used in this application are only for illustrative purposes and do not represent the only implementation methods.

As shown in FIG. 1 to FIG. 4, a wearable air conditioner according to a first embodiment of the present application comprises a body 10, and at least one fan 24 and at least one temperature adjusting unit 20 disposed in the body 10. The body 10 can be a neck-hung frame configured to be worn around a user's neck. A partition 15 is provided inside the body 10 to divide an internal space of the body 10 into a first air passage 151 and a first accommodating chamber 152. The part of the body 10 corresponding to the first air passage 151 is provided with an air outlet 14 which is fluidly communicated with the first air passage 151. The temperature adjusting unit 20 is located in the first accommodating chamber 152, and includes a temperature regulating member 23, which may be a semiconductor refrigeration chip. The cold end of the temperature regulating member 23 is in contact with the sidewall of the first accommodating chamber 152 to form a thermal connection. The part of the body 10 corresponding to the first accommodating chamber 152 is provided with vent holes 123. A part of the airflow generated by the fan 24 flows into the first air passage 151 and is blown out of the body 10 via the air outlet 14, while another portion flows into the first accommodating chamber 152 and is blown out of the body 10 via the vent holes 123.

In this application, "thermal connection" refers to the transfer of heat energy or cold energy between two objects that can be in direct contact, or in indirect contact through an intermediate thermal conductor such as thermal grease/silicone gel, graphite, etc. to form the transfer of heat energy or cold energy.

In the above embodiment, the internal space of the body 10 is divided into the first air passage 151 and the first accommodating chamber 152 through the partition 15. The sidewall of the first air passage 151 is provided with the air outlet 14. The temperature adjusting unit 20 located in the first accommodating chamber 152 includes a temperature regulating member 23. The cold end of the temperature regulating member 23 is in contact with the sidewall of the first accommodating chamber 152 to form a thermal connection. The part of the body 10 corresponding to the first accommodating chamber 152 is provided with vent holes 123. A part of the airflow generated by the fan 24 flows into the first air passage 151 and exits the body 10 via the air outlet 14, while another part flows into the first accommodating chamber 152 and takes away the heat generated by the temperature adjusting unit 20, and exits the body 10 via the vent holes 123. In this way, the wearable air conditioner of this embodiment can achieve higher cooling efficiency by both blowing cool air with the fan 24 and refrigerating with the temperature adjusting unit 20. Furthermore, a part of the airflow produced by the fan 24 can be used for heat dissipation of the temperature adjusting unit 20. Thus, a separate cooling fan for the temperature adjusting unit 20 is omitted, which simplifies the structure and reduces the cost.

The body 10 includes an inner sidewall 110 for contacting with a wearing portion of the user such as a human neck and an outer sidewall 111 away from the human neck. The outer sidewall 111 is opposite to the inner sidewall 110 with the internal space formed therebetween. The cold end of the temperature regulating member 23 is preferably attached to the inner sidewall 110 or the partition 15. The vent holes 123 are defined in the outer sidewall 111 at a position corresponding to the first accommodating chamber 152. The cold end of the temperature regulating member 23 is attached to the inner sidewall 110, which facilitates to quickly conduct the cold energy produced by the temperature regulating member 23 directly to the human neck, thereby accelerating the cooling and heat dissipation efficiency. In other embodiments, the cold end of the temperature regulating member 23 can also be attached to the outer sidewall 111. The cold energy produced by the temperature regulating member 23 is transmitted through the outer sidewall 111 to the inner sidewall 110 and then to the human neck for cooling. Alternatively, the cold end of the temperature regulating member 23 can be attached to the partition 15, which is conducive to quickly conducting the cold energy produced by the temperature regulating member 23 to the airflow in the first air passage 151 through the partition 15, reducing the temperature of the airflow blown out from the first air passage 151 via the air outlet 14, and achieving better cooling effects. Optionally, the fans 24 are respectively accommodated in receiving cavities 128 at opposite ends of the body 10. The fan 24 can be for example a centrifugal fan which includes a hub in the center and blades spokewise around the outer side of the hub. The portion of the shell 11 surrounding the fan 24 acts as a volute of the centrifugal fan. Optionally, the inner sidewall 110 and the outer sidewall 111 of the shell 11 correspondingly form air inlets 13 at positions corresponding to opposite axial ends of the fan 24. The air inlet 13 includes multiple air inlet holes facing the fan 24. The first air passage 151 and the first accommodating chamber 152 are respectively in fluid communication with the receiving cavity 128. The partition 15 extends along a length direction of the body 10 (i.e., the circumferential direction of the human neck), with one end of the partition 15 close to the airflow outlet of the fan 24 and the other end orientated towards the middle of the body 10. The first air passage 151 and the first accommodating chamber 152 are arranged side by side along the height direction of the body 10. The first air passage 151 and the first accommodating chamber 152 each extends along the length direction of the body 10. Optionally, the air outlet 14 is arranged on the top sidewall of the body 10 which faces the head of the user when the body is worn on the neck of the user. The first air passage 151 is near the top sidewall of the body 10. The air outlet 14 includes multiple air outlet holes arranged on the top sidewall of the body 10 along the extension direction of the first air passage 151.

In other embodiments, the partition 15 may be removed from the body 10. The first air passage 151 is arranged between and in communication with the receiving cavity 128 and the first accommodating chamber 152 such that the airflow generated by the fan 24 may flow into the first air passage 151 and the first accommodating chamber 152 and exits the body 10 through the air outlet 14 and the vent holes 123.

Optionally, the temperature adjusting unit 20 further includes a heat dissipation member 25 which is in thermal contact with the hot end of the temperature regulating member 23 for absorbing heat therefrom. The heat dissipation member 25 includes a base plate 250 in thermal contact with the hot end of the temperature regulating member 23 and heat dissipation fins 251 extending from the base plate 250 in a direction away from the temperature regulating member 23. Heat dissipation channels 252 are formed between adjacent heat dissipation fins 251, and the vent holes 123 correspond to the heat dissipation channels 252 which are in communication with the corresponding vent holes 123. The shape and size of the base plate 250 can match or correspond to the shape and size of the hot end of the temperature regulating member 23. The base plate 250 covers the hot end of the temperature regulating member 23 so that the heat generated by the hot end of the temperature regulating member 23 can be quickly conducted to the base plate 250 and then to the heat dissipation fins 251. Preferably, a thermally conductive adhesive layer is attached between the base plate 250 and the hot end of the temperature regulating member 23 to speed up the thermal conduction therebetween. The heat dissipation fins 251 extend from the base plate 250 toward the outer sidewall 111 of the body 10, and the extension direction of the heat dissipation channels 252 between adjacent heat dissipation fins 251 is consistent with that of the first accommodating chamber 152. Optionally, the channels 252 extend along the length direction of the shell 11. The part of the airflow entering the first accommodating chamber 152 flows through the heat dissipation channels 252, taking away the heat on the heat dissipation fins 251 and exits the shell via the corresponding vent holes 123, thus effectively dissipating the heat generated by the heat dissipation member 25 and avoiding the accumulation of heat within the first accommodating chamber 152.

Optionally, the inner sidewall 110 is made of a thermal conductive material. Alternatively, a temperature conducting portion 21 is attached to a part of the inner sidewall 110 corresponding to the temperature regulating member 23 such that the temperature conducting portion 21 forms a part of the inner sidewall 110 and the sidewall of the first accommodating chamber 152. The cold end of the temperature regulating member 23 is attached to the temperature conducting portion 21 on the inner sidewall 110. The inner sidewall 110 is made of a thermal conductive material, such as metal aluminum material. In some embodiments, the inner sidewall 110 is made of aluminum material such that the inner sidewall 10 is capable of rapidly transmitting the cold energy generated by the cold end of the temperature regulating member 23 to the human neck to thereby improve cooling efficiency. In this embodiment, a temperature conducting portion 21 is attached to a position of the inner sidewall 110 corresponding to the temperature regulating member 23. The temperature conducting portion 21 is made of a thermal conductive material with good thermal conductivity, such as aluminum alloy material or thermal conductive silicone material. In the case where the inner sidewall 110 is not entirely made of thermal conductive material, the temperature conducting portion 21 is used, which can also ensure that the cold energy generated by the cold end of the temperature regulating element 23 is promptly transmitted to the human neck for cooling and heat dissipation. Optionally, a notch 125 can be provided on the inner sidewall 110 corresponding to the temperature regulating element 23, and the cold end of the temperature regulating element 23 is located within the notch 125 and in contact with the temperature conducting portion 21. By setting the notch 125, the cold end of the temperature regulating element 23 can directly contact with the temperature conducting portion 21, thereby improving the efficiency of transmitting the cold energy generated by the cold end to the temperature conducting portion 21 and improving the cooling and heat dissipation effect on the human neck. In other embodiments, the temperature conducting portion 21 is provided with a convex part located in the notch 125, and the cold end of the temperature regulating member 23 is in contact with the convex part, thereby transmitting the cold energy to the temperature conducting portion 21 rapidly.

In the present embodiment, the body 10 has a curved shape adapted to the radian of the neck of the human body. The body 10 may be an integral structure or is consisted of multiple sections. In some embodiments, the body 10 comprises a first shell 11*a* and a second shell 11*b* symmetric to each other. The first shell 11*a* and the second shell 11*b* are connected together via an elastic restore member 12. The elastic restore member is configured to provide a mutual close force to the first shell 11*a* and the second shell 11*b*, so that when the wearable air conditioner is worn on the human neck, the inner sidewall 110 stays in contact with the human neck. The elastic restore member connects the first shell 11*a* and the second shell 11*b*, making them close to each other. At this time, the width of the opening between free ends of the first shell 11*a* and the second shell 11*b* can be slightly smaller than the diameter of the human neck. When the body 10 is to be worn on the human neck, the first shell 11*a* and the second shell 11*b* are bent outwardly in opposite directions, the elastic restore member is elastically deformed to expand the opening between the free ends of the first shell 11*a* and the second shell 11*b*, allowing the human neck to pass through the opening such that the body 10 is worn on the human neck. After the body 10 is worn on the human neck, the external force applied to the first shell 11*a* and the second shell 11*b* is withdrawn. At this time, the elastic restore member tries to recover its deformation to urge the first shell 11*a* and the second shell 11*b* relatively close to each other, such that the inner sidewall 110 of the body 10 tightly fits against the human neck.

In some embodiments, the body 10 comprises a first shell 11*a* and a second shell 11*b* symmetric to each other. The first shell 11*a* and the second shell 11*b* are connected together via a rotatable member 13. The rotatable member 13 is configured to adjust the distance between the first shell 11*a* and the second shell 11*b* such that the body 10 is suitable to different users. By setting the rotatable member 13, the distance between the first shell 11*a* and the second shell 11*b* can be adjusted to adapt to different user needs for different tightness when wearing the main body 10 on the human neck, thereby maintaining the inner sidewall 110 of the main body 10 in close contact with the human neck. This can improve the cooling and heat dissipation efficiency when the cold generated by the temperature adjusting member 23 is conducted through the inner sidewall 110 to the human neck. In other embodiments, the first shell 11*a* and the second shell 11*b* are connected by a bendable member, allowing users to adjust the distance between the first shell 11*a* and the second shell 11*b*.

Optionally, the internal space of the body 10 is provided with a separating member 16 which is located between the partition 15 and the outer sidewall 111. A second accommodating chamber 153 separated from the first air passage 151 and the first accommodating chamber 152 is formed between the separating member 16 and the outer sidewall 111. The second accommodating chamber 153 can be used for accommodating a battery 22 and/or a circuit board 27 therein. The separating member 16 can be located on a side of the partition 15 away from the inner sidewall 110, and its shape and size can be conformed to the shape and size of the cross section of the internal space of the body 10, so as to form the second accommodating chamber 153 separated from the first air passage 151 and the first accommodating chamber 152. Thus, two air passages formed by the first air passage 151 and first accommodating chamber 152 are located on one side of the body 10 near the inner sidewall 110, and the second accommodating chamber 153 is located on the other side of the body near the outer wall side 111. In the internal space of the body 10, the arrangement direction of the air passages and the second accommodating chamber 153 is perpendicular to that of the first air passage 151 and the first accommodating chamber 152. For example, the first air passage 151 and the first accommodating chamber 152 are distributed along the height direction of the body 10 while the air passages and the second accommodating chamber 153 are distributed along the width direction of the body 10. The separating member 16 is provided with an avoidance opening 160 at a position corresponding to the temperature regulating unit 200, and the heat dissipation fins 251 of the heat dissipation member 25 can be located in the avoidance opening 160 so that the heat dissipation channels 252 are directly connected to the vent holes 123 defined in the outer sidewall 111, allowing the airflow carrying the heat generated by the temperature regulating member 23 during operation to smoothly flow out of the heat dissipation channels 252 via the vent holes 123 defined in the outer sidewall 111. Of course, in other embodiments, the separating member 16 can also be set at other positions of the internal space of the body 10, and the specific position of the separating member 16 is not limited in this application, as long as it can separate the second accommodating chamber 153 from the first air passage 151 and the first accommodating chamber 152.

Optionally, the inner sidewall 110 and the outer sidewall 111 are respectively provided with air inlets 13 at positions corresponding to the fan 24. A wind-blocking portion can be provided inside the air inlet 13 on the inner sidewall 110 to partially shield the air inlet 13, thereby avoiding hair from getting caught when the body 10 is worn around the neck. A protective cover 132 can be arranged at the air inlet 13 on the outer sidewall 111. The protective cover 132 protrudes outwardly and beyond the outer surface of the outer sidewall 111 with the air inlet 13 being formed between the protective cover 132 and the outer surface of the outer sidewall 111. Specifically, the air inlet 13 is formed between the periphery of the protective cover 132 and the outer sidewall 111. The protective cover 132 can prevent foreign debris from entering the body 10 and also prevent the hair of the user from getting caught.

Figure 5:
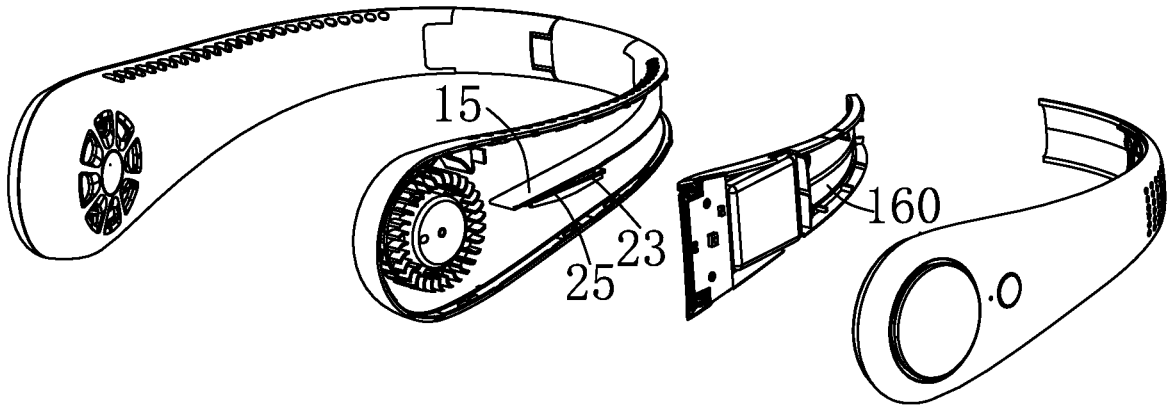
FIG. 5 is a perspective partially exploded view of a wearable air conditioner according to a second embodiment of the present invention.

FIG. 5 illustrates a neck-hung type wearable air conditioner according to a second embodiment of the present invention. The neck-hung wearable air conditioner of the second embodiment differs from the neck-hang wearable air conditioner of the first embodiment mainly in: the cold end of the temperature regulating member 23 being attached to the partition 15. Specifically, the partition 15 has a board shape with a pair of opposite major surfaces. The cold end of the temperature regulating member 23 is attached to one of the major surfaces of the partition 15 facing the first accommodating chamber 152. Thus, the partition 15 is capable of absorbing the cold energy generated by the temperature regulating member 23 and transferring it to the first air passage 151 to cool the airflow in the first air passage 151 such that the air flowing out from the first air outlet 14 after passing through the first air passage 151 is further cooled down and the user experience is further improved.

Figure 6:
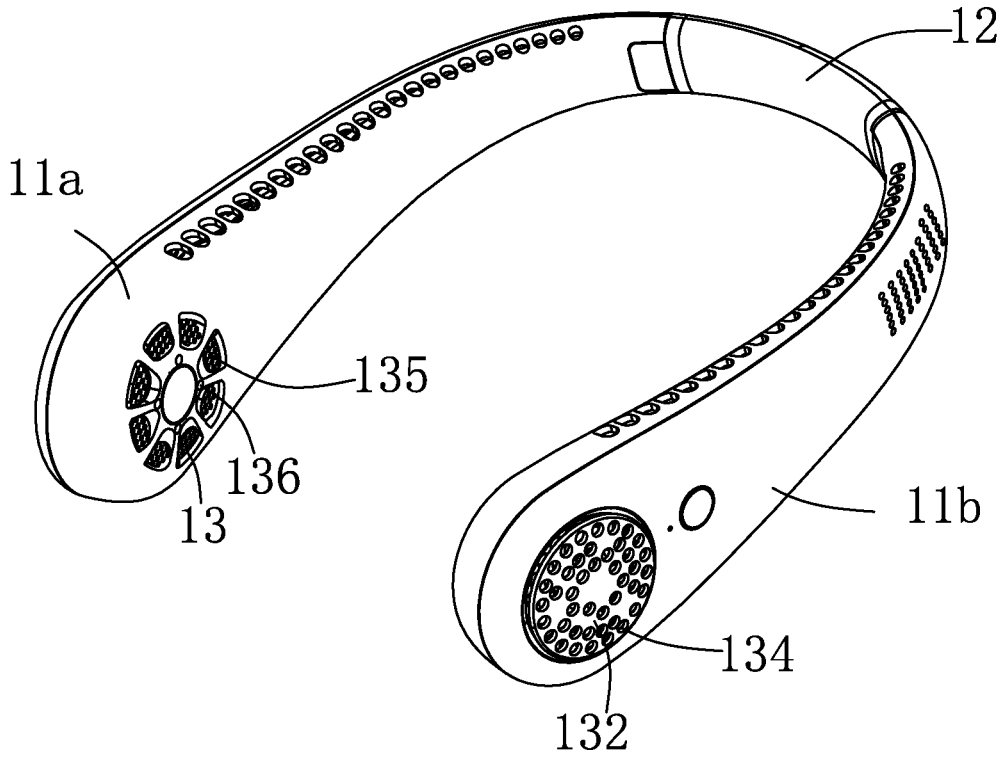
FIG. 6 is a perspective view of a wearable air conditioner according to a third embodiment of the present invention.
Figure 7:
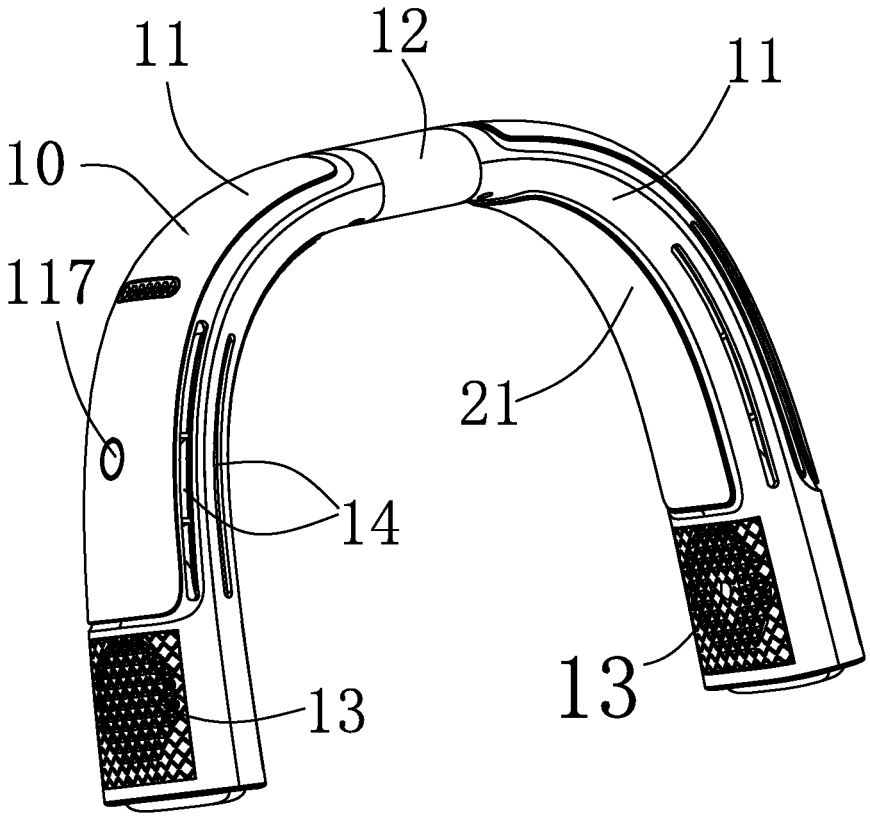
FIG. 7 is a perspective partially exploded view of a wearable air conditioner according to a fourth embodiment of the present invention.
Figure 8:
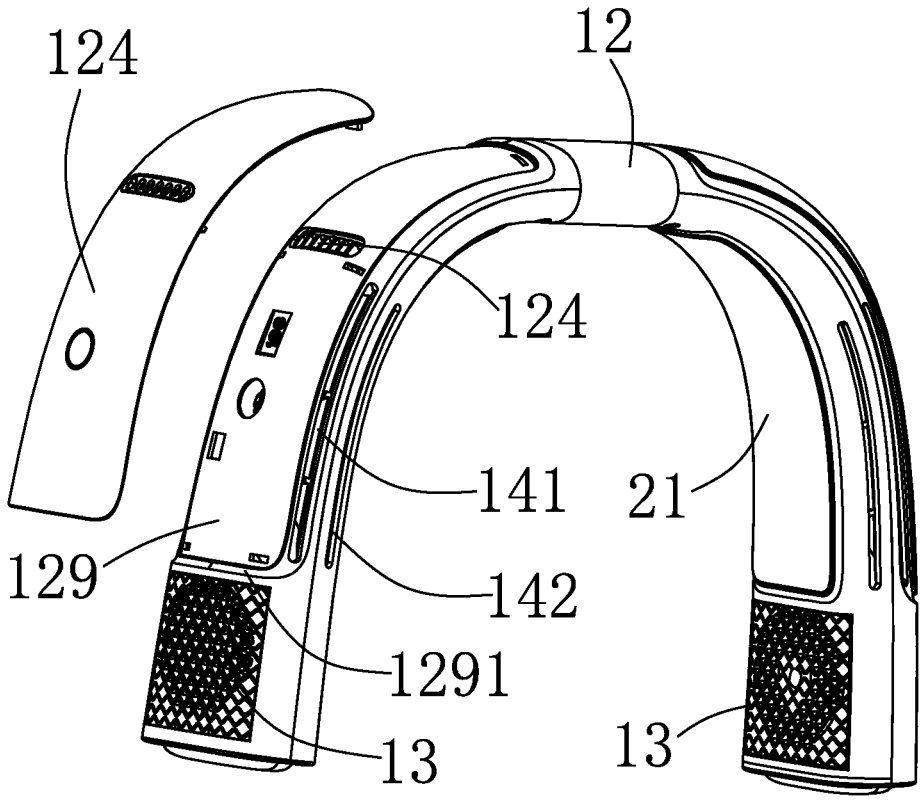
FIG. 8 is an exploded view of FIG. 7.
Figure 9:
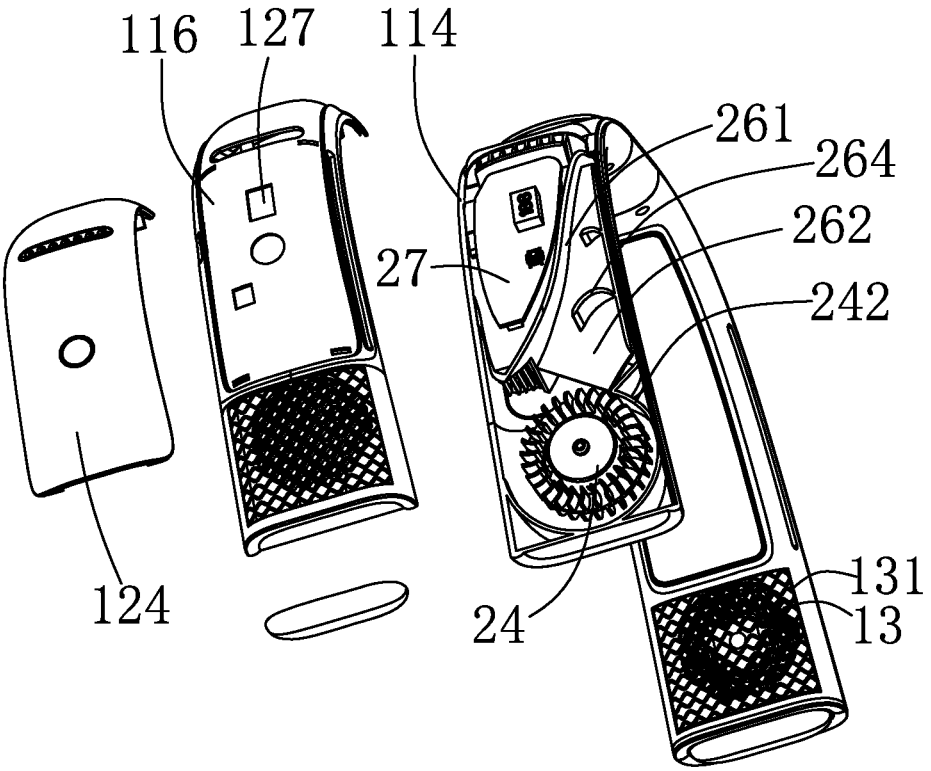
FIG. 9 is a further exploded view of FIG. 8.

FIG. 6 illustrates a neck-hung type wearable air conditioner according to a third embodiment of the present invention. The neck-hang air conditioner of the third embodiment differs from the neck-hang air conditioner of the first embodiment mainly in: a filter 135 being embedded in the inner sidewall 110 at a position corresponding to the air inlet 13. Multiple fixing holes 136 are formed in the inner sidewall 110 for positioning the filter 135 during manufacturing. The air inlet 13 can be circular. A filter 135 can be embedded in the inner sidewall 110 at a position corresponding to the air inlet 13 to prevent hair of the user from getting caught during use of the neck-hanging air conditioner. Multiple fixing holes 136 are defined in the inner sidewall 110 at the positions corresponding to the filter 135, such that during the process of the filter 135 being embedded in the body 10 by injection molding, the filter 135 can be positioned by pins of a mold where the body 10 is formed, being inserted into the fixing holes 136 to prevent the filter 135 from deviating during the process of the injection molding. In addition, the protective cover 132 can have multiple mesh holes 134 distributed therein. The mesh holes 134 are in communication with the air inlet 13 defined in the outer sidewall 111. The mesh holes 134 defined in the protective cover 132 can further increase the air volume entering into the air inlet 13.

FIGS. 7-11 illustrate a portable wearable air conditioner according to a fourth embodiment of the present invention. The neck-hang air conditioner comprises a body 10, two temperature adjusting units 20 disposed in the body 10 and the temperature conducting portions 21 disposed in the inner sidewall of the body 10. The body 10 comprises two shells 11 and an elastic restore member 12 connected between the two shells 11. Each temperature adjusting unit 20 is disposed in one corresponding shell 11. Each temperature adjusting unit 20 comprises a temperature regulating member 23 for example a semiconductor refrigeration chip. The temperature conducting portions 21 is disposed at the inner sidewall of the shell 11 and in thermal connection with the temperature regulating member 23.

Figure 36:
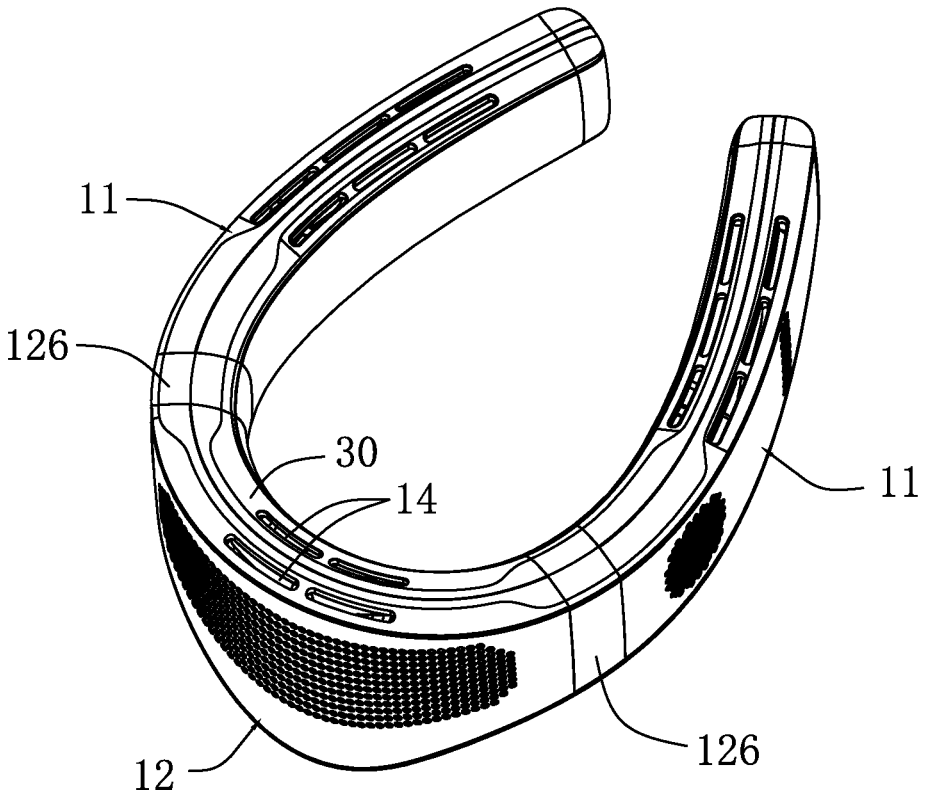
FIG. 36 is a perspective view of a wearable air conditioner according to an eleventh embodiment of the present invention.
Figure 37:
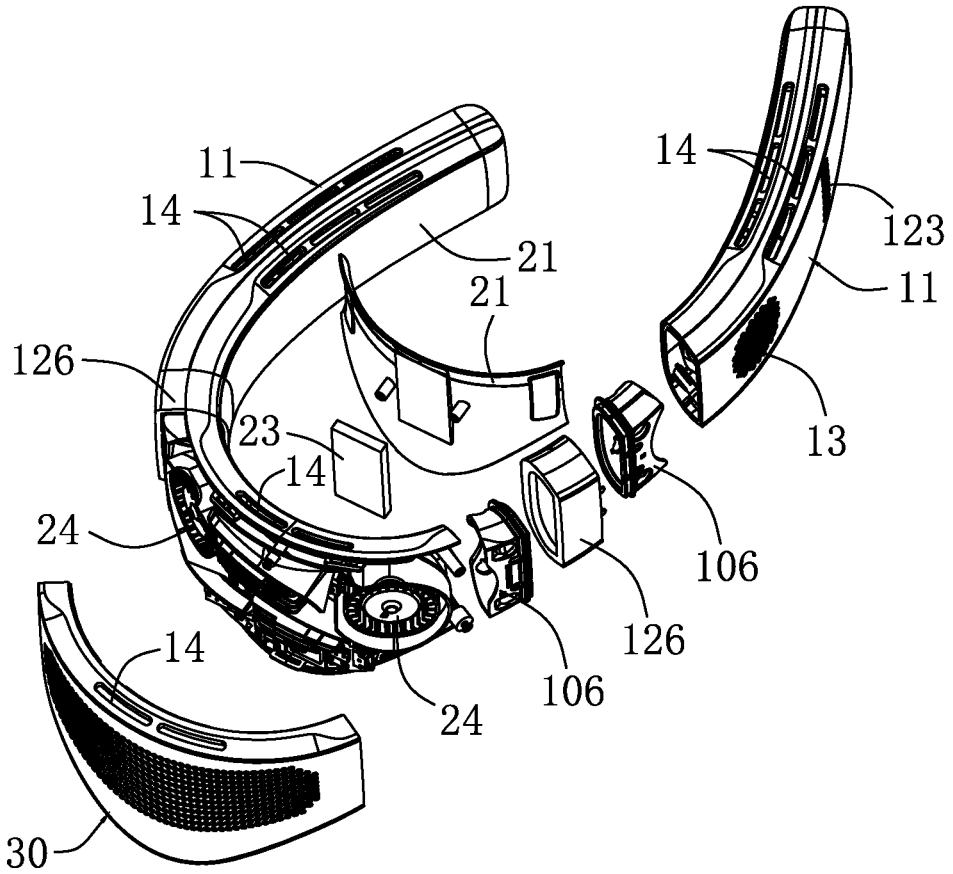
FIG. 37 is an exploded view of FIG. 36.
Figure 38:
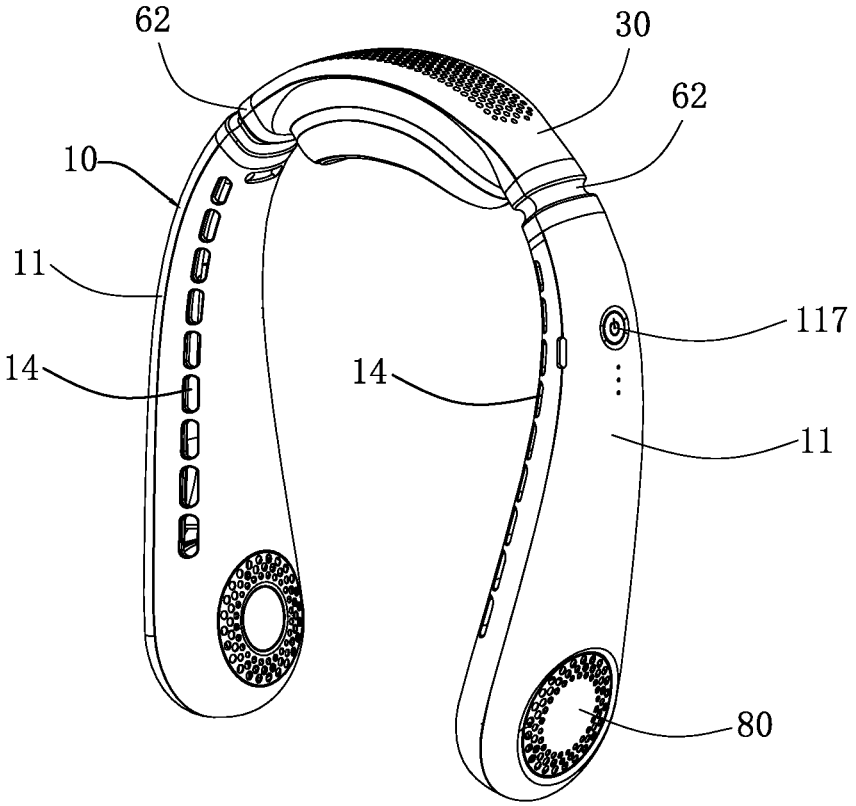
FIG. 38 is a perspective view of a wearable air conditioner according to a twelfth embodiment of the present invention.
Figure 39:
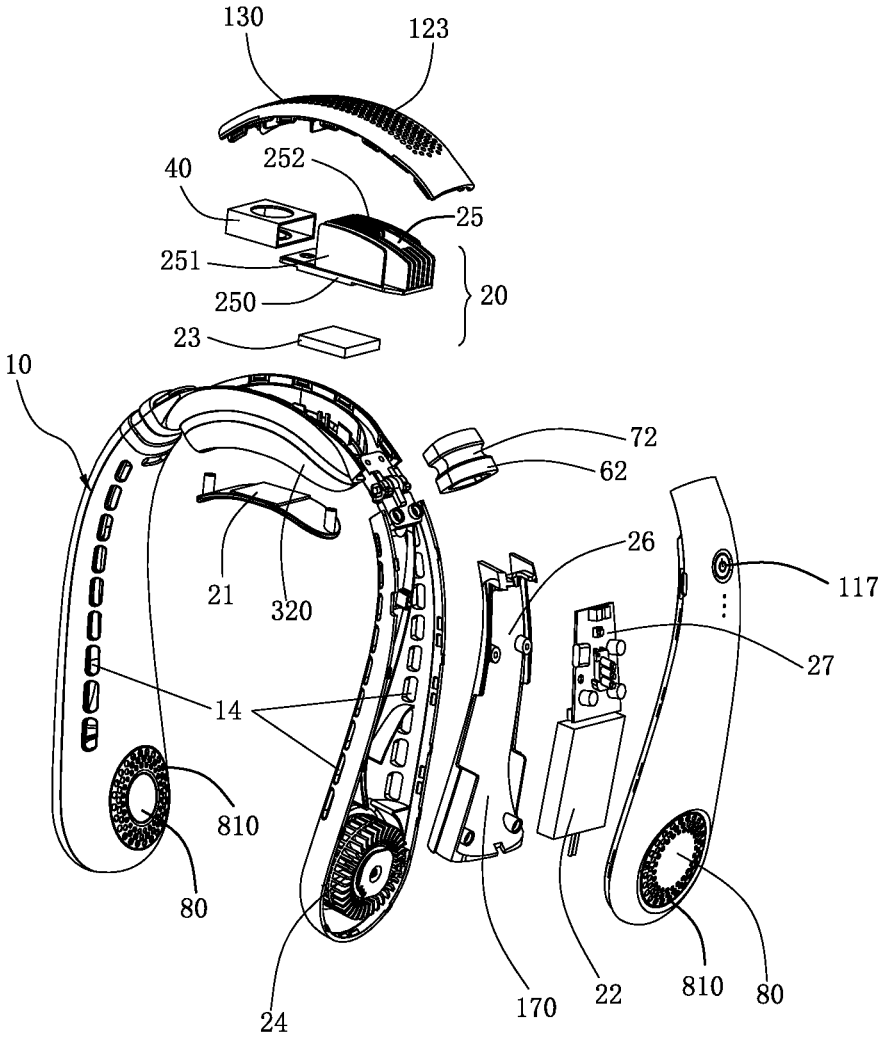
FIG. 39 is a first exploded view of FIG. 38.
Figure 40:
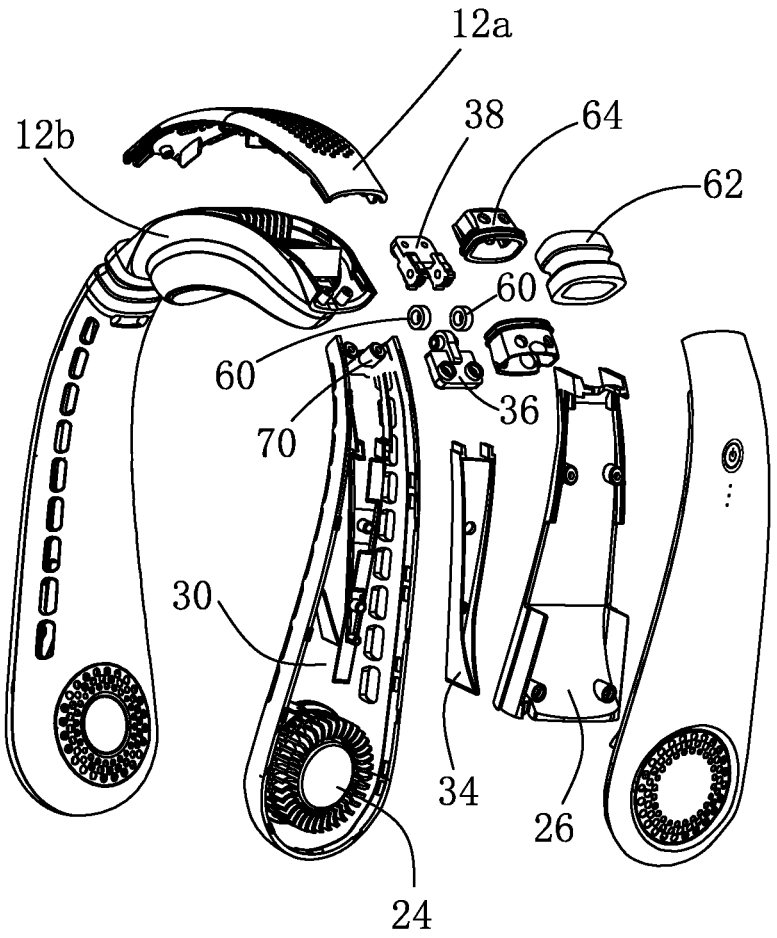
FIG. 40 is a second exploded view of FIG. 38.
Figure 41:
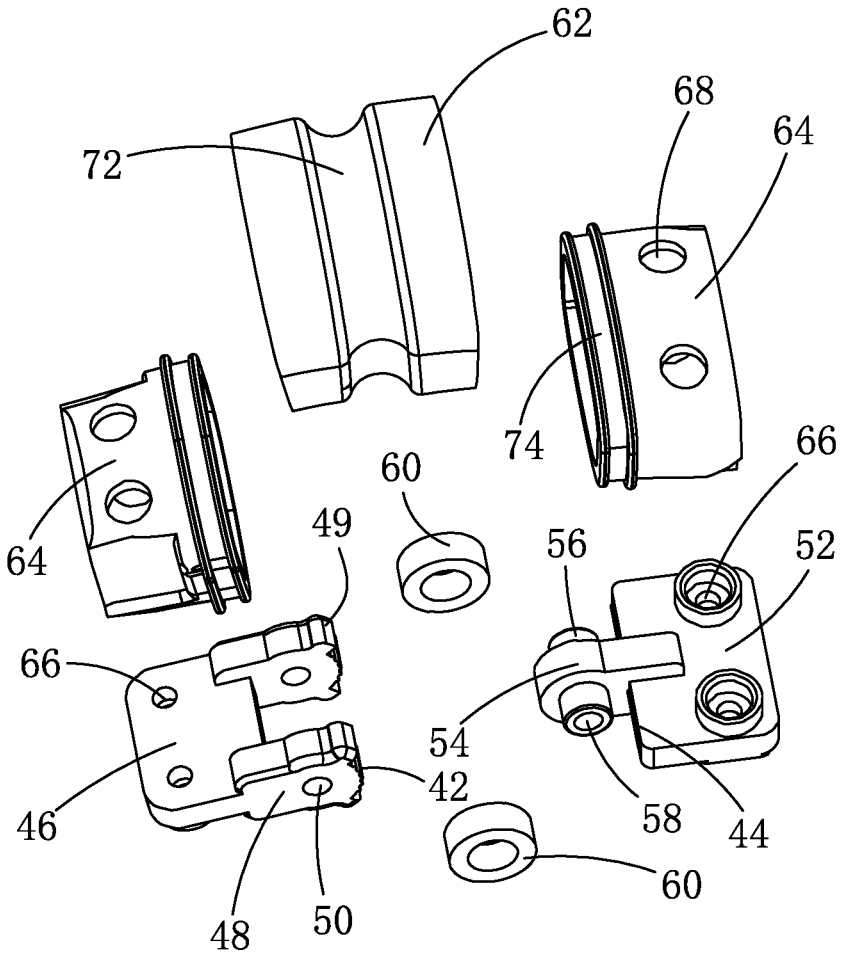
FIG. 41 is an exploded view of a connecting structure of the wearable air conditioner of FIG. 40.

The wearable air conditioner can be a temperature-regulating device that can be worn on different parts of the user's body. The body 10 can be corresponding structure that stably wears the wearable air conditioner on the corresponding part of the user's body. For example, the wearable air conditioner can be a temperature-regulating device worn on the user's wrist, in this case, the body 10 can be a wrist strap that surrounds the user's wrist; the portable wearable air conditioner can be a temperature-regulating device worn on the user's waist, in this case, the body 10 can be a waist strap that surrounds the user's waist; the portable wearable air conditioner can be a temperature-regulating device worn on the user's neck, in this case, the body 10 can be a neck-hung frame worn around the user's neck. In this embodiment, for ease of understanding, the description is given using a neck-hung type wearable air conditioner as an example of the wearable air conditioner. The main difference of the fourth embodiment relative to the first embodiment is as follows:

Referring to FIG. 12 to FIG. 17, optionally, the elastic restore member 12 comprises an elastic member 121 and two connecting members 122. The two connecting members 122 are rotatably connected to each other and are respectively connected to the two shells 11. Opposite two ends of the elastic member 121 respectively abut against the two connecting members 122, applying inward elastic forces to the two shells 11 through the connecting members 122. Specifically, the elastic restore member 12 may further include a pivot shaft 120, and the two connecting members 122 can be rotatably connected to the pivot shaft 120, and ends of the two connecting members 122 away from the pivot shaft 120 are fixedly connected to the two shells 11. Optionally, the two connecting members 122 are bar-shaped and the end, away from the pivot shaft 120, of each connecting member has multiple first positioning holes arranged along the length direction thereof. The elastic member 121 includes a main body portion and elastic arms located at opposite sides of the main body portion. The main body portion is wound around the pivot shaft 120. The two elastic arms (i.e., the two ends of the elastic member 121) abut against the surfaces of the two connecting members 122. The two elastic arms have a tendency to rotate towards the inner side of the shells 11 to thereby apply elastic forces inwardly to the shells 11 via the two connecting members 122 such that the inner surfaces of the shells 11 can firmly contact with the neck of the user to allow the temperature conducting portions 21 to apply good temperature adjusting effects on the neck of the user. Optionally, the elastic member 121 is a torsion spring. The elastic restore member 12 further comprises a sleeve 126 enclosed around the elastic member 121 and the connecting members 122. The sleeve 126 may be a soft sleeve made of rubber. Both ends of the sleeve 126 are provided, by injection molding, with two fixing blocks 106 that have shapes and sizes conformed to the end of the shell 11. Each fixing block 106 is provided with a second positioning hole corresponding to the first positioning hole. One end of each connecting member 122 away from the rotation shaft 120 is fixedly connected to one corresponding fixing block 106. The fixing blocks 106 may be fixed to the end of the shell 11 by screws or other fixing elements. Thus, the two shells 11 are bendably or rotatably connected to each other by the elastic restore member 12. The connecting members 122 and the elastic member 121 are mounted on the rotating shaft 120. After the two connecting members 122 are respectively fixedly connected to the corresponding fixing blocks 106, one end of the two fixing blocks 106 can be injection molded at opposite ends of the sleeve 126. For example, the fixing blocks 106 can be hard plastic block formed at the opposite ends of the sleeve 126 by injection molding, and then the ends of the fixing blocks 106 exposed out of the sleeve 126 are fixedly connected to the corresponding shells 11, such that opposite ends of the elastic restore member 12 can be fixedly connected to the two shells 11. After the fixing connection, opposite two end faces of the sleeve 126 are respectively in contact with the end faces of the two shells 11, and the side surfaces of the sleeve 126 are respectively flush with the corresponding side surfaces of the adjacent ends of the shells 11. In this application, the two ends of the sleeve 126 are respectively fixed with the fixing blocks 106 made of hard plastic material via injection molding. The fixing blocks 106 are respectively fixed with the shells 11 such that the end faces of the sleeve 126 can be in contact with the end faces of the shells 11 when the elastic restore member 12 is bent and deformed, which makes the connection between the elastic restore member 12 and the shells 11 more tight and stable, preventing gaps from appearing between the two ends of the sleeve 126 and the ends of the shells 11 to affect the appearance of the product. In addition, the sleeve 126 can also protect the elastic member 121 and the connecting member 122 without affecting the bending or rotating and folding function between the two shells 11. In other embodiments, the elastic restore member 12 can also be a flexible rubber sleeve that can be bent and deformed, or a metal hose wrapped with a soft rubber sleeve, or other bendable or rotatable connection structures. Alternatively, as shown in FIGS. 36-37, the elastic restore member 12 may include a middle enclosure 30 and two sleeves 126 respectively connected to opposite ends of the middle enclosure 30. Opposite ends of each sleeve 126 are respectively connected to the enclosure and one of the shells 11 through the fixing blocks 106. The middle enclosure 30 is made of hard plastic material. A fan 24 and a temperature regulating member 23 can be arranged inside of the middle enclosure 30. The top sidewall and bottom sidewalls of the middle enclosure 30 are respectively provided with air outlets 14 corresponding to the fan 24, and the inner sidewall of the middle enclosure 30 is provided with a temperature conducting portion 21 corresponding to the temperature regulating member 23, such that the wearable air conditioner can blow air to the back side of the user's neck and provide a temperature adjustment via the temperature regulating member 23 contacting the back side of the user's neck via the temperature conducting portion 21.

Optionally, portions of the surfaces of the inner wall and outer wall of the shell 11 corresponding to the fan 24 are formed with wavy textures 131 around the air inlets 13. The textures 131 can prevent external impurities from entering the interior of the shell 11 through the air inlets 13, and increase the coefficient of friction of the surface of the ends of the shell 11 to prevent the device from slipping off the user's hands when the user grips the ends of the body 10. In addition, the textures 131 can improve the aesthetic appearance.

Optionally, the battery 22 in each shell 11 is located at one end of the corresponding shell 11 close to the elastic restore member 12, the fan 24 is located at the other end of the corresponding shell 11 away from the elastic restore member 12, and the temperature adjusting member 23 is located between the battery 22 and the fan 24. The temperature adjusting member 23 is arranged in the middle of the shell 11, and the battery 22, the temperature adjusting member 23, and the fan 24 inside each shell 11 are arranged sequentially along the length direction of the corresponding shell 11. This arrangement can avoid increasing the thickness or width dimensions of the portable wearable air conditioner, facilitate to distribute the weight of the body 10 evenly, improve the lightweight wearing experience, and make the wearing more stable and less likely to slip off from the human neck. Each shell 11 contains a battery 22, that is, the body 10 is equipped with two batteries 22 to store energy for supplying power to the two temperature adjusting units 20 respectively, thereby effectively increasing the endurance of the portable wearable air conditioner. Users can also choose to turn on the temperature adjusting unit 20 in one of the shells 11 according to specific needs or different remaining power of the batteries 22 in the two shells 11, which further helps to expand the application scenarios that the portable wearable air conditioner can adapt to.

The heat conducting member 21 is arranged on the inner sidewall of the shell 11, and the length of the temperature conducting portion 21 is greater than that of the temperature adjusting member 23 such that the temperature conducting portion 21 can cover a larger surface area of the inner sidewall of the shell 11. When the portable wearable air conditioner is worn on the user's body, the temperature conducting portion 21 can have a larger contact area with the skin surface of the human body. For example, when the portable wearable air conditioner is worn around the user's neck to adjust the temperature of the neck and the face and head area close to the neck, the temperature adjusting member 23 is configured for heating or cooling to regulate the temperature of the temperature conducting portion 21. For instance, functions of cooling and heating of the temperature conducting portion 21 can be switched via changing the direction of the current supplied to the temperature adjusting member 23. When the body 10 is worn around the user's neck, the temperature conducting portion 21 is in contact with the human neck for cooling or heating. In this embodiment, the protrusion part 211 passes through the notch 125 and contacts the cold end of the temperature adjusting member 23. Two temperature conducting portions 21 are provided on the inner sidewalls of the two shells 11 with an interval. The two temperature adjusting components 23 in the two shells 11 respectively cool or heat the two temperature conducting portions 21. In other embodiments, there may be only one temperature conducting portion 21, which is connected to and covers the inner walls of the two shells 11. The two heat temperature conducting portions 21 cooperatively cool or heat the single temperature conducting portion 21 to thereby achieve the function of temperature regulation for the human body.

Figure 13:
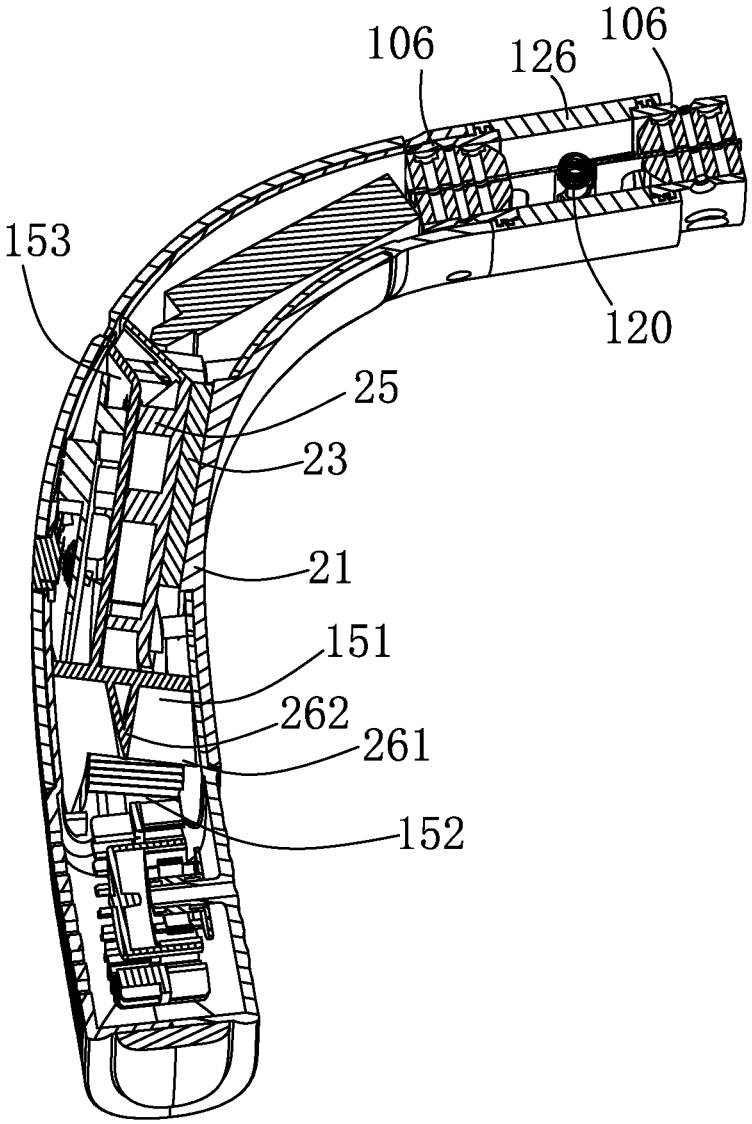
FIG. 13 is a longitudinal cross-sectional view showing one shell of the wearable air conditioner of FIG. 7.
Figure 14:
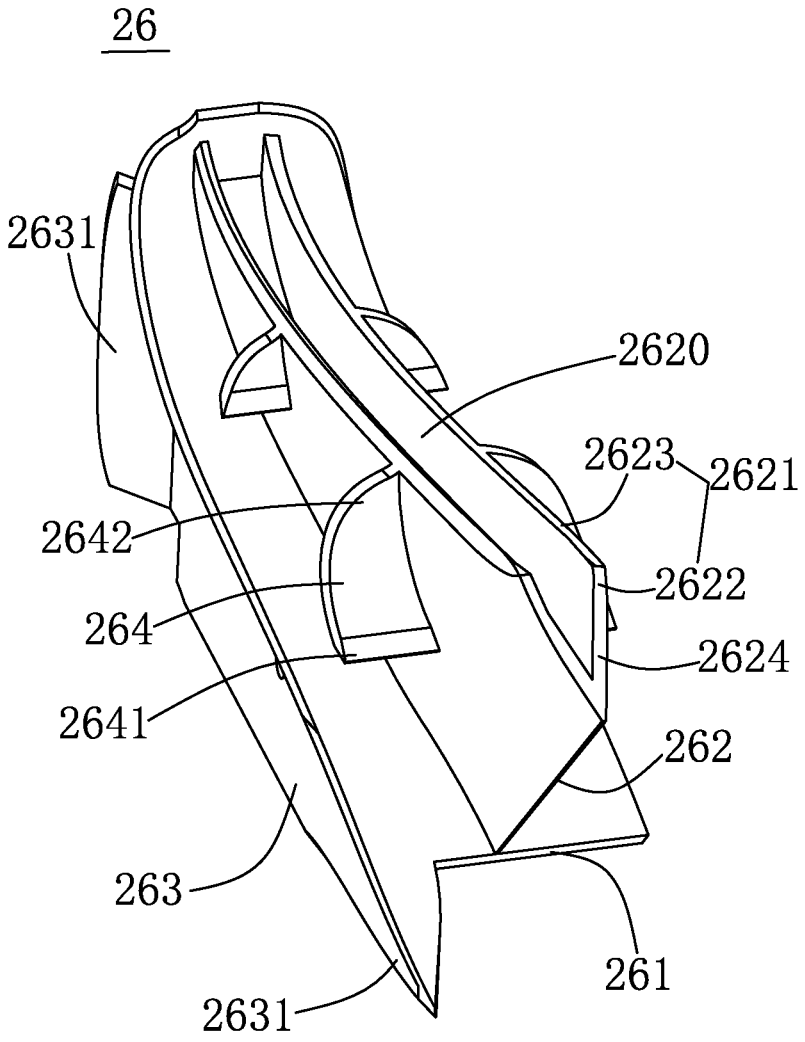
FIG. 14 is an enlarged perspective view of the partition shown in FIG. 11.
Figure 15:
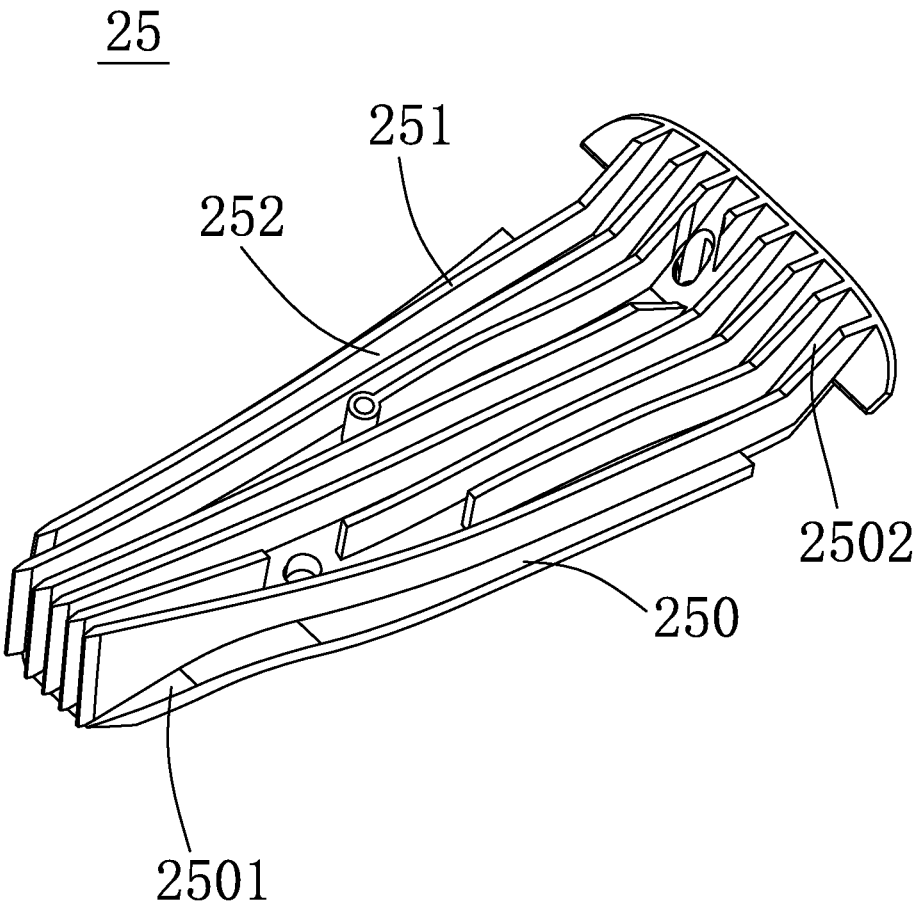
FIG. 15 is an enlarged perspective view of the heat dissipation member shown in FIG. 11.
Figure 16:
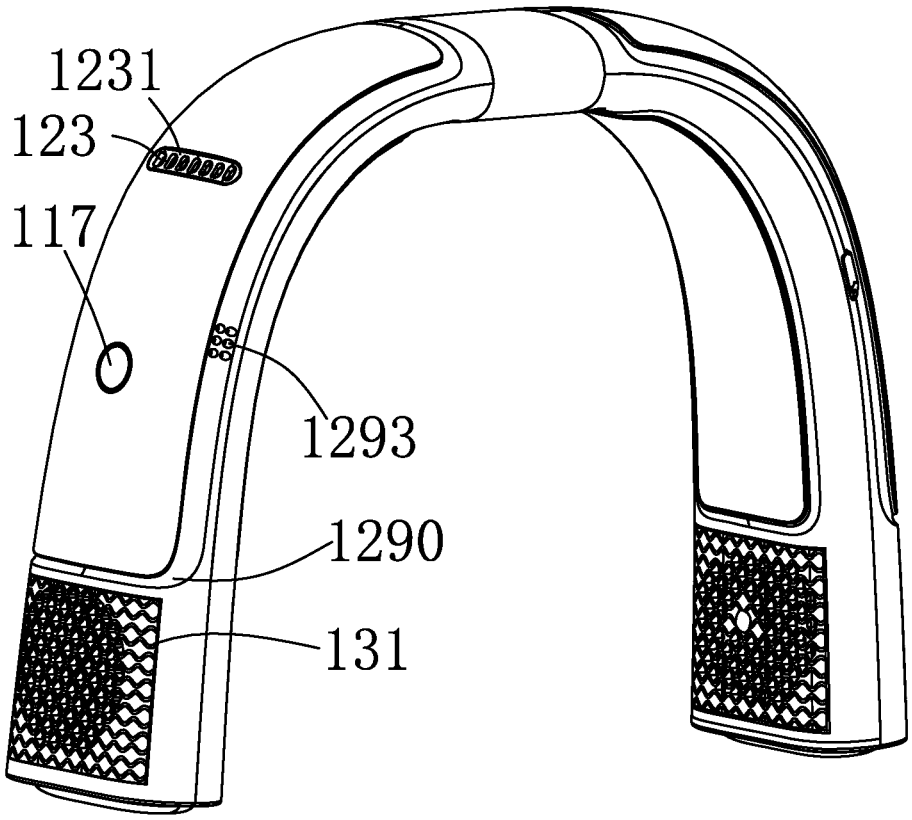
FIG. 16 is another perspective view of the wearable air conditioner shown in FIG. 7, viewed from another aspect.
Figure 17:
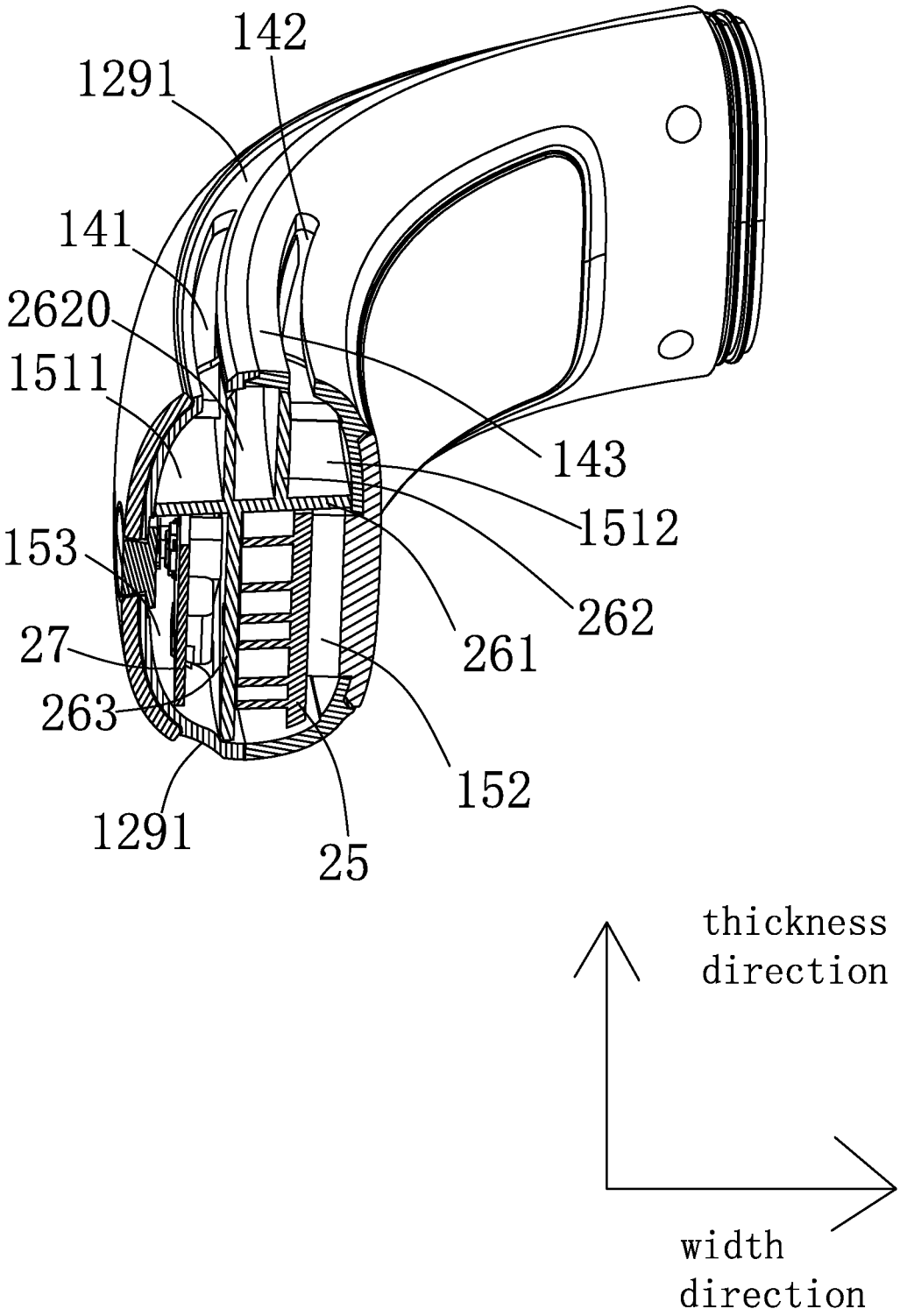
FIG. 17 is a traverse cross-sectional view showing one shell of the wearable air conditioner of FIG. 7.

Further, in this embodiment, the shell 11 is provided with a first partition 261 that divides the internal space of the shell 11 into a first air passage 151 and a first accommodating chamber 152, and a second partition 262 that divides the first air passage 151 into a first sub-air passage 1511 and a second sub-air passage 1512 as shown in FIGS. 13-14 and FIG. 17. The first partition 261 extends obliquely between the inner sidewall and outer sidewall of the shell 11. Preferably, opposite two longitudinal edges of the first partition 261 are in contact with the inner sidewall and outer sidewall of the shell 11 respectively to thereby separate the first air passage 151 and the first accommodating chamber 152. The first sub-air passage 1511, the second sub-air passage 1512, and the first accommodating chamber 152 are respectively in fluid communication with the receiving chamber 128. The shell 11 is provided with a first sub-air outlet 141 in fluid communication with the first sub-air passage 1511, a second sub-air outlet 142 in fluid communication with the second sub-air passage 1512, and vent holes 123 in fluid communication with the first accommodating chamber 152. The temperature adjusting member 23 is located inside the first accommodating chamber 152. For ease of understanding, with reference to the orientation of the portable wearable air conditioner worn around the user's neck, the direction extended between the inner wall and outer wall of the shell 11 is defined as the width direction, the direction extended between the top sidewall and bottom sidewall of the shell 11 is defined as the thickness direction, and the extension direction of the body 10 around the user's neck is defined as the length direction. The first partition 261 can be formed on the inner sidewall of the shell 11, extending from the inner wall to the outer wall, or formed on the outer wall of the shell 11, extending from the outer wall to the inner wall. One end of the first partition 261 close to the fan 24 is closer to the bottom sidewall of the shell 11 than the other end of the first partition 261 away from the fan 24, while the other end of the first partition 261 away from the fan 24 is connected to the top sidewall of the shell 11. The first air passage 151 and the first accommodating chamber 152 are arranged along the thickness direction of the shell 11. For example, the first air passage 151 and the first accommodating chamber 152 are respectively close to the top and bottom sidewalls of the corresponding shell 11. Alternatively, in other embodiments, the first partition 261 may be formed on the top sidewall of the shell 11 and extends from the top sidewall to the bottom sidewall, so that the first air passage 151 and the first accommodating chamber 152 are distributed along the width direction of the shell 11. For example, the first air passage 151 and the first accommodating chamber 152 are close to the inner sidewall and the outer sidewall of the corresponding shell 11. The first part of the airflow generated by the fan 24 enters the first air passage 151 and flows out from the outlet 14, while another part enters the first accommodating chamber 152 and flows out from the vent holes 123. The part of the airflow entering the first accommodating chamber 152 can take away the heat generated by the temperature adjusting unit 20. Thus, there is no need for an additional cooling fan for the temperature adjusting unit 20, thereby simplifying the structure of the product and reducing the manufacturing cost. With this design, the portable wearable air conditioner can not only generate airflow with the fan 24 to achieve a function of temperature regulation for the user, but also adjust the temperature of the temperature conducting portions 21 through the temperature regulating members 23 to thereby achieve another function of temperature regulation for the user via the temperature conducting portions directly contacting the neck of the user. Thus, the portable wearable air conditioner can meet the users' various temperature regulation requirements.

The second partition 262 divides the first air passage 151 into the first sub-air passage 1511 and the second sub-air passage 1512. The outlet 14 is correspondingly divided into the first sub-outlet 141 and the second sub-outlet 142 corresponding to the first sub-air passage 1511 and the second sub-air passage 1512. Optionally, the second partition 262 is located within the first air passage 151 and integrally extends from the surface, facing the first air passage 151, of the first partition 261 or from the inner surface of the shell 11. The first sub-outlet 141 and the second sub-outlet 142 both extend in the length direction of the corresponding shell 11 to form elongated sub-outlets which can be spaced apart from each other along the width direction of the shell 11. For example, two groups of sub-outlets are arranged side by side on the top sidewall of the corresponding shell 11 and spaced apart from each other. In other embodiments, when the first air passage 151 and the first accommodating chamber 152 are close to the inner sidewall and the outer sidewall of the corresponding shell 11 respectively, the first sub-outlet 141 and the second sub-outlet 142 may be arranged with an interval along the thickness direction of the shell 11. For example, the two sets of sub-outlets 141/142 are respectively arranged at the top sidewall and the bottom sidewall of the shell 11, which increases the area of the air outlets of the portable wearable air conditioner. Each set of sub-outlet corresponds to a sub air passage, so that the two sets of sub-outlets do not affect each other and the portable wearable air conditioner can output airflow evenly. Optionally, the shell 11 includes an inner shell 114 and an outer shell 116 which form two detachable parts of the shell 11. In this embodiment, the inner shell 114 includes the inner sidewall, a part of the top sidewall, and a part of the bottom sidewall of the shell 11, and the outer shell 116 includes the outer sidewall, the other part of the top sidewall, and the other part of the bottom sidewall of the shell 11. The first sub air outlet 141 is formed on the top sidewall of the inner shell 114, and the second sub air outlet 142 is formed on the top sidewall of the outer shell 116. The end of the shell 11 may be provided with a decorative member 113 that shields the joint between the inner shell 114 and the outer shell 116. The decorative member 113 can be connect with the end of the shell 11 via glue or interlocking means.

Optionally, referring to FIG. 17, a third partition 263 is also provided inside the shell 11. The third partition 263 is located on one side of the first accommodating chamber 152 to a separate a second accommodating chamber 153 from the space between the first partition 261 and the shell 11. The second accommodating chamber 153 and the first accommodating chamber 152 are distributed along the width direction of the shell 11. Each shell 11 is further provided with a circuit board 27 which is located in the second accommodating chamber 153. The third partition 263 and the second partition 262 are respectively located on opposite sides of the first partition 261 (i.e., the upper and lower sides in FIG. 17). The third partition 263 can be integrally extended from the surface, facing the first accommodating chamber 152, of the first partition 261 or from the inner surface of the corresponding shell 11. In this embodiment, the second partition 262 separates the space above the first partition 261 into the first sub air passage 1511 and the second sub air passage 1512, and the third partition 263 separates the space below the first partition 261 into the first accommodating chamber 152 and the second accommodating chamber 153. The first accommodating chamber 152 and the second accommodating chamber 153 are arranged along the width direction of the shell 11. The circuit board 27 is located in the second accommodating chamber 153, and the circuit board 27 of each shell 11 is provided with a switch. The battery 22, circuit board 27, switch, and temperature regulating member 23 in each shell 11 are electrically connected to each other. A button 117 can be provided on the outer sidewall of the shell 11 corresponding to the switch, so that users can operate the button 117 to control the on/off switch of the portable wearable air conditioner and adjust the operating mode of the fan 24 and the temperature regulating member 23. Optionally, the first partition 261, the second partition 262 and the third partition 263 are of an integrally formed partition 26 which is independent from the shell 11. The integrally formed partition 26 is assembled to the shell 11 after being formed, which facilitates to simplify the structure and manufacturing of the shell 11.

Figure 10:
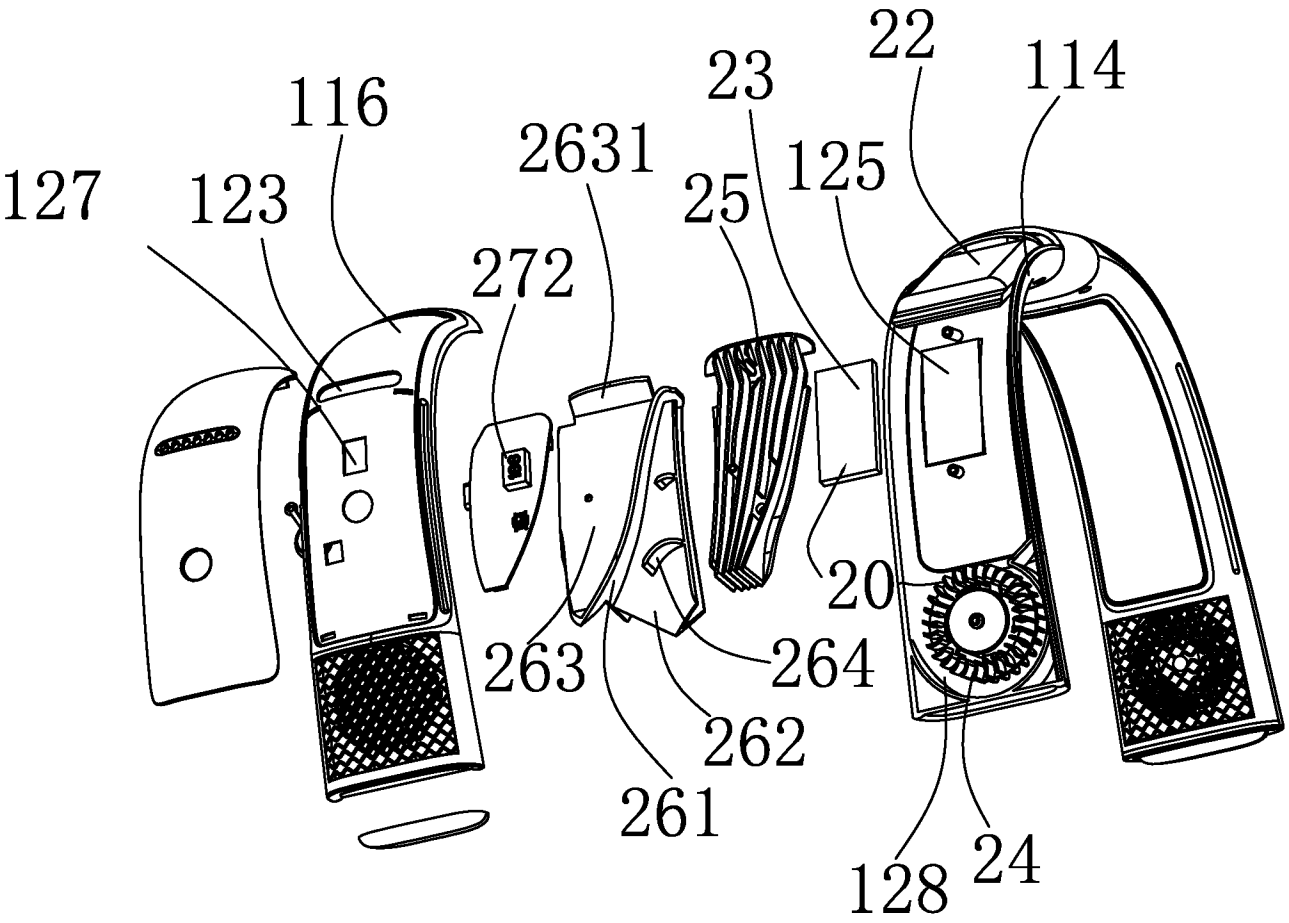
FIG. 10 is a further exploded view of FIG. 9.
Figure 11:
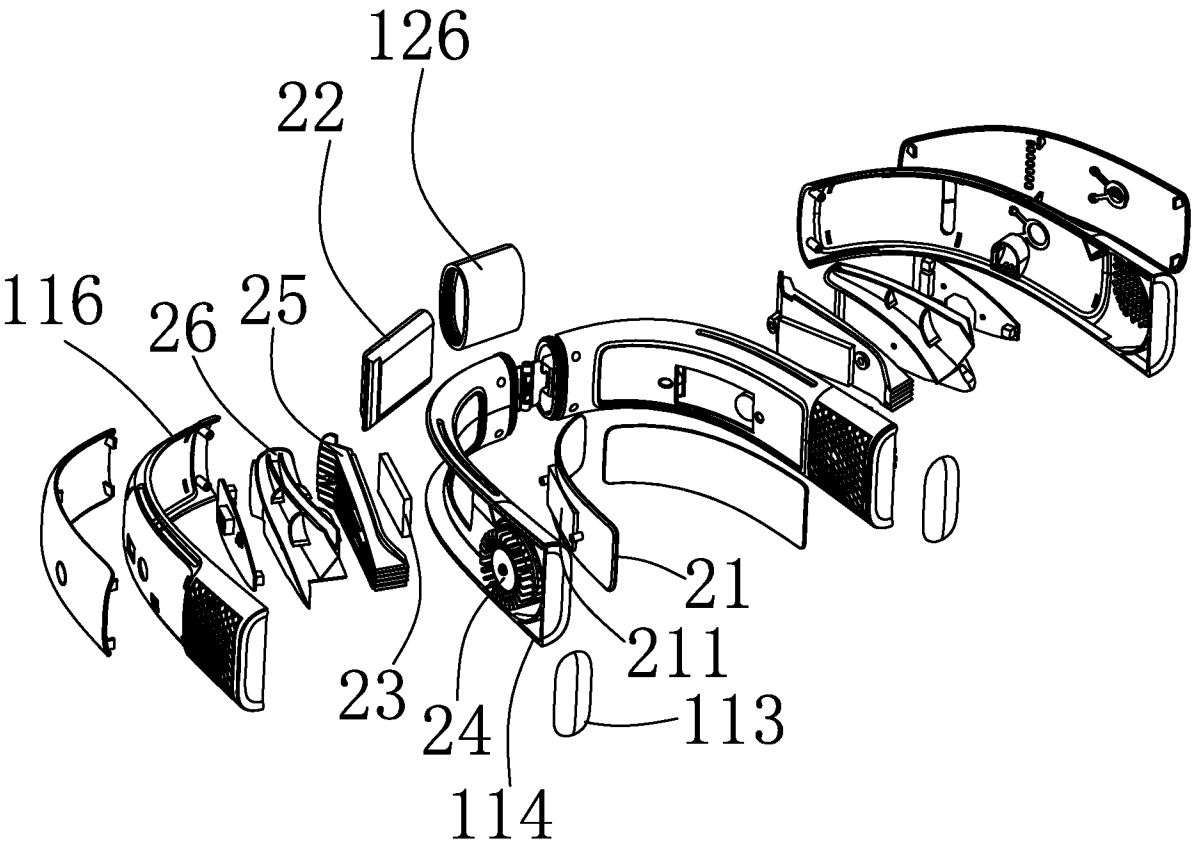
FIG. 11 is a further exploded view of FIG. 10.
Figure 12:
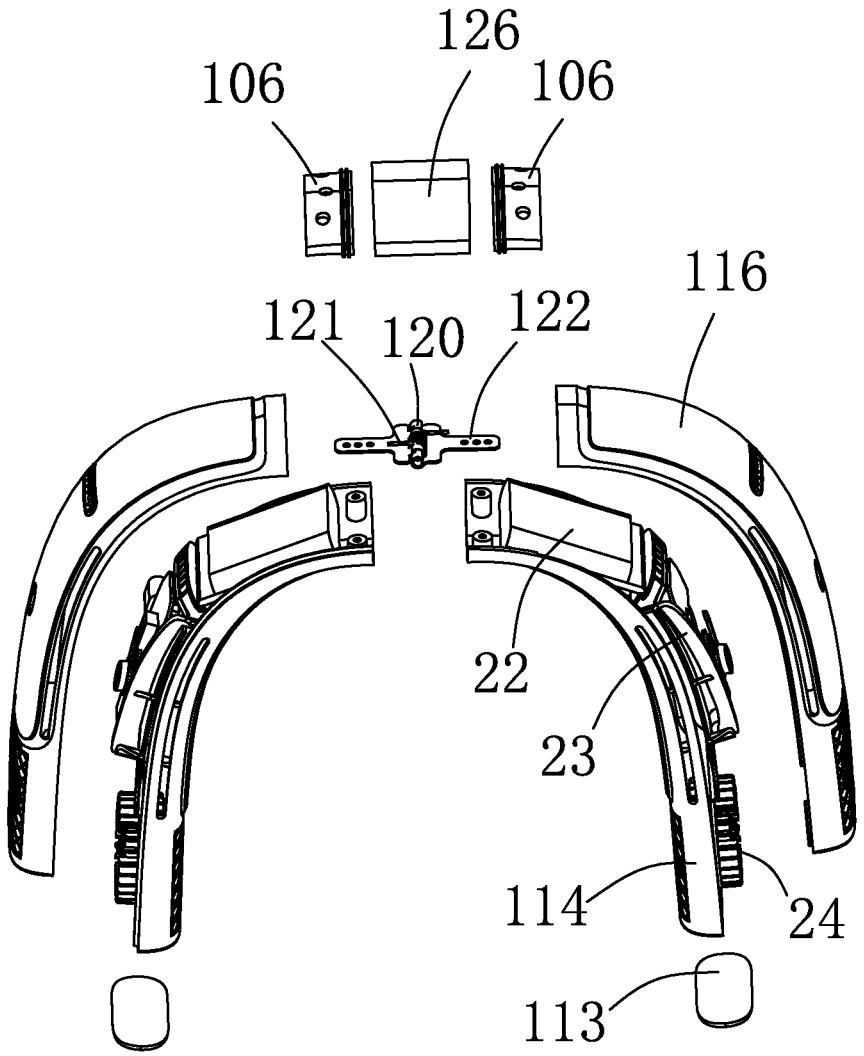
FIG. 12 is another perspective partially exploded view of the wearable air conditioner of the fourth embodiment.

Optionally, the third partition 263 is bent towards the outer sidewall of the shell 11 at one end near the fan 24 and at the other end away from the fan 24, forming a bending portion 2631 (see FIG. 10) that abuts against the outer sidewall of the shell 11, which makes the separation between the second accommodating chamber 153 and the first accommodating chamber 152 more thorough, avoiding mutual interference between the heat generated by the circuit board 27 during operation and the heat generated by the temperature regulating member 23 during operation. In addition, the two ends of the third partition 263 abut against the inner surface of the outer sidewall of the corresponding shell 11 to prevent the airflow generated by the fan 24 from entering the second accommodating chamber 153 to be wasted, thereby ensuring the airflow in the first air passage 151 and the first accommodating chamber 152 being enough. Furthermore, each temperature adjusting unit 20 further includes a heat dissipation member 25 corresponding to the temperature regulating member 23. The heat dissipation member 25 includes a bottom plate 250 in thermal contact with the temperature regulating member 23 and multiple heat dissipating fins 251 extending from the bottom plate 250. Heat dissipating channels 252 are formed between adjacent heat dissipating fins 251. Each heat dissipating channel 252 extends along the length direction of the shell 11. Opposite ends of the bottom plate 250 are respectively bent towards the inner sidewall of the corresponding shell 11 to form a first guiding portion 2501 and towards the outer sidewall of the corresponding shell 11 to form a second guiding portion 2502. In this embodiment, the heat dissipation member 25 is accommodated in the first accommodating chamber 152. The widths of ends of the heat dissipating channels 252 near the fan 24 are smaller than that of ends of the heat dissipating channels 252 away from the fan 24. The heat dissipation member 25 is thermally connected to the hot end of the temperature regulating member 23 through the bottom plate 250. During the operation of the temperature regulating member 23, the cold energy generated by the cold end can be transmitted to the skin of the user's neck through the thermal conducting member 21 for cooling the user's neck. The heat energy generated by the hot end of the temperature regulating member 23 can be transmitted to the heat dissipation member 25 and then dissipated through a larger heat dissipation surface area of the heat dissipation member 25. Each heat dissipating fin 251 extends along the length direction of the corresponding shell 11, and a heat dissipating channel 252 is formed between adjacent heat dissipating fins 251. The width of each heat dissipating channel 252 gradually increases from the end near the fan 24 to the end away from the fan 24. The corresponding shell 11 is provided with vent holes 123 at a position close to the ends of the heat dissipating channels 252 away from the fan 24. The vent holes 123 are in communication with the ends of the heat dissipating channels 252 away from the fan 24, which allows part of the airflow generated by the fan 24 to enter the first accommodating chamber 152, pass through the heat dissipating channels 252, and flow out from the vent holes 123, thereby taking away the heat from the heat dissipation member 25 and achieving rapid cooling of the temperature regulating member 23. By designing the width of the heat dissipating channel 252 to gradually increase from the end near the fan 24 to the end away from the fan 24, i.e., the width of ends of the heat dissipating channel 252 near the fan 24 is smaller than that of ends away from the fan 24, the airflow can slow down after entering the heat dissipating channels 252, which facilitates the airflow to fully take away the heat of the heat dissipation member 25 to be dissipated via the vent holes 123 and facilitates to reduce noise of the airflow. Preferably, as shown in FIG. 10, the shell 11 is provided with multiple positioning posts, and the heat dissipation member 25 is provided with positioning holes corresponding to the positioning posts. The positioning posts can be inserted into the positioning holes or fixedly connected to the positioning holes on the shell 11 through fasteners such as screws.

Optionally, the vent holes 123 are formed in the outer sidewall of the shell 11. The number of the vent holes 123 is equal to that of the heat dissipation channels 252. The vent holes 123 correspond to the heat dissipation channels 252 in one-to-one correspondence. Ends of the heat dissipating fins 251 away from the bottom plate 250 abut against the third partition 263 such that the multiple heat dissipation channels 252 are separated from each other to thereby form multiple independent heat dissipation channels, which facilitates the airflow to flow through the heat dissipation channels 252 smoothly and reduce noise of the airflow. Further, one end of the bottom plate 250 close to the fan 24 is bent towards the inner sidewall of the corresponding shell 11 to form the first guiding portion 2501 which facilitates to guide the airflow generated by the fan 24 to enter the heat dissipation channels 252. The end of the bottom plate 250 away from the fan 24 is bent towards the outer sidewall of the corresponding shell 11 to form the second guiding portion 2502 which facilitates to guide the airflow to rapidly flow to the vent holes 123 from the heat dissipation channels 252. The end portion of each heat dissipation fin 251 adjacent to the fan 24 has a thickness which reduces gradually in a direction toward the fan 24 to form a sharp structure facing the fan 24, which facilitates to guide the airflow generated by fan 24 to flow into the heat dissipation channels 252 with reduced resistance.

The outer sidewall of the shell 11 has an arc-shaped recessed portion 1231 at positions where the vent holes 123 are located. The bending portion 2631 formed at the end of the third partition 263 away from the fan 24 can separate the heat dissipating channels 252 of the heat dissipation member 25 from the circuit board 27 to avoid the airflow at the ends of the heat dissipating channels 252 returning to the second accommodating chamber 153 where the circuit board 27 is located. Optionally, the cross-sectional size/area of the first air passage 151 gradually decreases along the length direction of the corresponding shell 11 from the end near the fan 24 to the other end away from the fan 24, and the cross-sectional size/area of the first accommodating chamber 152 gradually increases along the length direction of the corresponding shell 11 from the end near the fan 24 to the other end away from the fan 24. That is, the first air passage 151 has a tapered shape from the position near the fan 24 towards the middle of the body 10, which is conducive to maintaining the airflow velocity inside the first air passage 151 and increasing the air volume of the air outlet 14 located near the middle of the body 10. The first accommodating chamber 152 gradually expands in a tapering shape from the position near the fan 24 towards the middle of the body 10, which allows the airflow entering the first accommodating chamber 152 to slow down gradually and fully exchange heat with the heat dissipation member 25 before passing through the vent holes 123 located at the end of the first accommodating chamber 152.

In this embodiment, the first air passage 151 and the first accommodating chamber 152 are distributed along the thickness direction of the shell 11. The second accommodating chamber 153 and the first accommodating chamber 152 are distributed along the width direction of the shell 11. That is, the second accommodating chamber 153 and the first air passage 151 located within the shell 11 are distributed along the thickness direction of the corresponding shell 11. With such arrangement, the temperature regulating member 23 and the circuit board 27 can be compactly and neatly arranged under the first partition 261 while ensuring the volume of the air passage. Optionally, the third partition 263 is provided with positioning columns, and the circuit board 27 is provided with positioning holes that are fixedly connected to the positioning columns, which makes assembly of the circuit board 27 in the shell 11 easy and stable. Furthermore, the first sub air outlet 141 and the second sub air outlet 142 are separated by a partition 143. The second partition 262 includes two guide plates 2621 with a cavity 2620 formed between the two guide plates 2621. The two guide plates 2621 respectively abut against opposite sides of the partition 143. Each guide plate 2621 includes a guide portion 2622 near the fan 24 and an extension portion 2623 connected to the guide portion 2622. Two guide portions 2622 are connected to each other at the end near the fan 24 to form a V-shaped guide end. The distance between the two guide portions 2622 along the width direction of the shell 11 gradually increases from the end near the fan 24 in a direction away from the fan 24, i.e., gradually increases along the direction of the airflow. The two extension portions 2623 parallel to each other extend along the length direction of the shell 11 and are spaced apart from each other. A side of each guide portion 2622 near the partition 143 is cut to form an inclined surface 2624, and a clearance is formed between the inclined surface 2624 and the inner surface of the shell 11. The clearance matches the shape of the volute tongue 242 around the receiving cavity 128 within the shell 11 to avoid interference.

Preferably, the side surfaces of the two guide plates 2621 are flush with the opposite side surfaces of the partition 143 to form smooth connections between the side surfaces of the guide plates 2621 and the side surfaces of the partition 143, which facilitates to produce a better guiding effect for the airflow flowing out from the first sub air outlet 141 and the second sub air outlet 142 and effectively suppress the backflow of the airflow and noise generated due to the backflow of the airflow. In this embodiment, the second partition 262 is divided into two sections in a direction from the end near the fan 24 to the other end away from the fan 24. The first section close to the fan 24 forms the guide portion 2622 whose cross-sectional size gradually increases, and the second section away from the fan 24 forms the extension portion 2623 whose cross-sectional size remains the same. That is, the end of the second partition 262 near the fan 24 gradually decreases in size in the width direction of the corresponding shell 11, forming a blade-like structure, which is conducive to divide the airflow generated by the fan 24 into two parts flowing towards the first sub air passage 1511 and the second sub air passage 1512, respectively, reducing wind resistance. The two sides of the second partition 262 abutting against the partition 143 (i.e., the two guide plates 2621) are substantially perpendicular to the top sidewall of the shell 11, allowing the airflow to flow out from the first sub air outlet 141 and the second sub air outlet 142 in a direction that is substantially perpendicular to the top sidewall of the shell 11. The two guide plates 2621 are spaced apart along the width direction of the shell 11 and are connected to each other at the end near the fan 24, and the ends away from the fan 24 are respectively connected to the end of the first air passage 151, so that the partition 143 and the two guide plates 2621 abutting against the partition 143 cooperatively form a cavity 2620, which not only reduces the material cost of the second partition 262 but also effectively absorbs the noise generated by the airflow. In this embodiment, the second partition 262 is a hollow structure including two spaced guide plates 2621. Of course, in other embodiments, the second partition 262 can also be a solid structure consisting of only one plate. That is, the cavity between the two guide plates 2621 can be filled. The end of the solid structure near the fan 24 can be cut to form an inclined surface 2624 as well. Furthermore, the first sub air passage 1511 and the second sub air passage 1512 are provided with guide vanes 264, which are bent and slant relative to the thickness direction of the shell 11. The guide vane 264 include a first end portion 2641 near the fan 24 and a second end portion 2642 away from the fan 24. The second end portion 2642 is closer to the top sidewall of the corresponding shell 11 than the first end portion 2641, and the size of the first end portion 2641 along the thickness direction of the shell 11 gradually decreases in a direction towards the fan 24. That is, the end of the guide vane 264 near the fan 24 is thinner than other portions of the guide vane 264, forming a blade-like structure as shown in FIG. 14, facilitating to reduce wind resistance of the guide vane 264. The guide vane 264 extend in both the width and thickness directions of the corresponding shell 11, and the first end portion 2641 (lower end) of the guide vane 264 is closer to the fan 24 than the second end portion 2642 (upper end) of the guide vane 264, which results in the guide vanes 264 being inclined relative to the top and bottom sidewalls of the shell 11. In this embodiment, two spaced guide vanes 264 are distributed along the length direction of the shell 11 in each of the first air passage 1511 and the second air passage 1512. The guide vanes 264 in the first air passage 1511 and the second air passage 1512 are respectively arranged side by side, and their positions and extension directions are the same. That is, the guide vanes 264 in the first air passage 1511 are respectively symmetrical to the guide vanes 264 in the second air passage 1512 such that the airflow directions of the first sub air outlet 141 and the second sub air outlet 142 are basically the same, avoiding wind power loss. In other embodiments, one or more guide vanes 264 may be provided in either the first sub duct 1511 or the second sub duct 1512. By setting the guide vanes 264, at least a part of the airflow generated by the fan 24 is guided to flow along a plane that is basically parallel to the outlet 14, and then blown out from the first sub air outlet 141 and the second sub air outlet 142, respectively. Thus, the airflow can be guided towards the face of the user, preventing all of the airflow from blowing towards the back side of the neck of the user. The end of the guide vane 264 near the fan 24 is formed as a blade whose thickness gradually decreases, which is more conducive to dividing the airflow and allowing it to flow smoothly along the surface of the guide vanes 264, reducing wind resistance.

Optionally, the guide vanes 264 can be integrally formed with the second partition 262 or extend integrally from the inner surface of the shell 11. In this embodiment, the guide vanes 264 extend integrally from the surface of the second partition 262 to the first sub air passage 1511 and the second sub air passage 1512, respectively. That is, the guide vanes 264 can be integrally formed on the partition 26, which effectively simplifies the structure of the shell 11 and makes manufacturing of the product more convenient. Separating plates or heat-insulating cotton (not shown in the drawings) may be provided in the shell 11 to separate the temperature-adjusting member 23 from the battery 22, thereby preventing the heat generated by the temperature-adjusting member 23 from being transferred to the battery 22. The separating plates or heat-insulating cotton can be connected between the inner sidewall and the outer sidewall of the corresponding shell 11. The heat-insulating cotton can be made of bubble cotton material with heat insulation effect, and the separating plates can extend integrally from the inner surface of the inner sidewall of the shell 11 towards the outer sidewall. A display device 272 is provided inside the shell 11, and the outer sidewall of the shell 11 defines a through-hole 127 corresponding to the display device 272. In this embodiment, two recesses 129 are provided on the outer sidewalls of the two shells 11, and cover plates 124 are received in the recesses 129 respectively. The cover plates 124 cover the through-holes 127. The display devices 272 are located in the through-holes 127 and configured to display information through the cover plates 124. The cover plates 124 are made of transparent material, and the display device 272 is used to display at least one of the following information: remaining power, settings for working conditions of the fan 24 and the temperature regulating member 23, such as setting for the rotating speed of the fan 24 or other parameters of the temperature regulating member 23, temperature (for example: the temperature of the heat conducting member temperature conducting portion 21). The outer sidewalls of the shell 11 can be provided with locking slots at the positions where the recesses 129 are formed, and the cover plates 124 can be provided with corresponding locking structures, which facilitates to assemble the cover plate 124 to the recesses 129. Optionally, the shell 11 may form inclined guide surfaces 1291 surrounding the periphery of the cover plate 124. The cover plate 124 and the guide surface 1291 cooperate to form an annular air guide passage 1290 that is in communication with the air outlet, which can increase the air outlet area of the portable wearable air conditioner. The display device 272 can be mounted on the circuit board 27, and the cover plate 124 can be made of transparent material. The portion of the cover plate 124 facing the display device 272 forms a display screen area so that the information displayed by the display device 272 can be observed through the cover plate 124. Optionally, the display device 272 can be a digital tube. A notch can also be defined in the inner sidewall of the corresponding shell 11 at a position corresponding to the temperature conducting portion 21. The temperature conducting portion 21 is mounted in the notch of the inner sidewall to keep the outer surface of the inner sidewall of the corresponding shell 11 flat as a whole. The length of the temperature conducting portion 21 is basically equal to that of the cover plate 124, making the appearance of the portable wearable air conditioner more beautiful and neat. Optionally, one of the circuit boards 27 may also have a speaker 271, and the corresponding position on the body 10 is provided with a sound outlet 1293. The sound outlet 1293 can be located on the bottom sidewall of the corresponding shell 11, and the speaker 271 can be used to announce the on/off or setting information of the wearable air conditioner. In the present application, inner surfaces of the sidewalls (such as inner sidewall/outer sidewall/top sidewall/bottom sidewall) of the shell 11 face the internal space of the corresponding shell 11 while outer surfaces of the sidewalls of the shell 11 is away from the internal space of the corresponding shell 11.

In one embodiment, each temperature adjusting unit 20 includes a controller connected to the temperature adjusting member 23 and a thermistor connected to the controller. When the portable wearable air conditioner works in a cooling mode, the thermistor collects the temperature information of the cold-end of the temperature adjusting member 23 and sends it to the controller which controls the cooling temperature of the temperature adjusting member 23 based on the temperature information of the cold-end. When the portable wearable air conditioner works in a heating mode, the thermistor collects the temperature information of the hot-end of the temperature adjusting member 23 and sends it to the controller which controls the heating temperature of the temperature adjusting member 23 based on the temperature information of the hot-end. The operation of the cooling mode can be as follows: the voltage output by the battery 22 is lowered to 3.0V through a step-down chip or circuit to be supplied to the temperature adjusting member 23, and the thermistor detects the cold-end temperature of the temperature adjusting member 23. The controller then intelligently controls the temperature adjusting member 23 to work to thereby achieve a cooling effect. The operation of the heating mode can be as follows: the voltage output by the battery 22 is lowered to 3.0V through a step-down chip or circuit to be supplied to the temperature adjusting member 23, and the thermistor detects the hot-end temperature of the temperature adjusting member 23. The controller then intelligently controls the temperature adjusting member 23 to work to achieve a constant heating temperature effect. The controller can achieve the working mode transition of the temperature adjusting member 23 by adjusting the voltage level of the first and second terminals of a H-bridge chip to thereby adjust the polarity of the output voltage of terminals 5, 6 and 7, 8 of the H-bridge chip.

Figure 18:
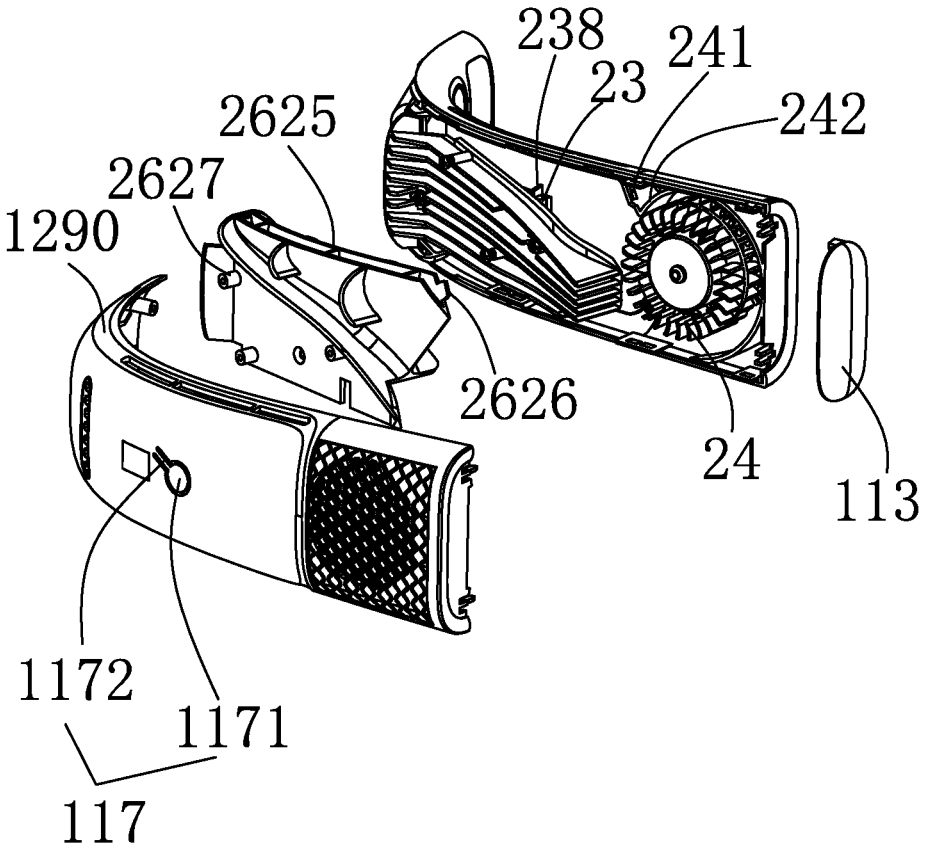
FIG. 18 is an exploded view of one shell of a wearable air conditioner according to a fifth embodiment of the present invention.

FIG. 18 illustrates a portable wearable air conditioner in accordance with a fifth embodiment of the present invention. The portable wearable air conditioner of the fifth embodiment differs from that of the fourth embodiment in that: the second partition 262 further comprises multiple reinforce ribs 2625 connected between the two air guide plates 2621 and arranged with intervals, which are conducive to increase the strength of the air guide plates 2621 and prevent the air guide plates 2621 from deforming during the process of manufacturing. The slope 2624 of the second partition 262 is provided with a locking holder 2626. The fan 24 is a centrifugal fan. The portion of the shell 11 surrounding the fan 24 acts as a volute of the centrifugal fan. A tongue-like protrusion in the volute is called a volute tongue which mainly functions to isolate the flowing air and prevent the air from circulating in the volute. The volute tongue 242 of the corresponding fan 24 is provided with a corresponding locking slot 241 that matches the locking holder 2626. When the partition 26 is installed inside the shell 11, it can be fixed by the locking holder 2626 of the second partition 262 inserted into the locking slot 241 on the volute tongue 242. This can improve the stability of the partition 26 installed inside the corresponding shell 11. Furthermore, multiple positioning columns 2627 are provided on the third partition 263 for installing and fixing the circuit board 27. The inner surface of the shell 11 corresponding to the periphery of the temperature regulating member 23 is provided with multiple positioning protrusions 238 for assisting in positioning the temperature regulating member 23. Multiple positioning protrusions 238 are arranged with interval around the periphery of the temperature regulating member 23. In this embodiment, the independent cover plate 124 that is detachably attached to the shell 11 may be omitted. The annular air guide groove 1290 and the display area corresponding to the display device 272 can be directly formed on the outer sidewall of the shell 11. The air guide groove 1290 can be directly used as the air outlet 14 for the portable wearable air conditioner. Alternatively, the first sub-air outlet 141 of the air outlet 14 can be directly arranged in the air guide groove 1290, while the second sub-air outlet 142 is reserved. Referring to FIG. 18 again, a through-hole is defined in the shell at a position corresponding to the button 117. The button 117 includes a pressing part 1171 located in the through-hole and a cantilever arm 1172 connected between the pressing part 1171 and the peripheral edge of the through-hole. By setting the through-hole and cantilever arm 1172, when the user presses the button 117, the pressing part 1171 can deform inwardly towards the internal space of the shell 11, thereby correspondingly triggering the first switch or second switch located in the internal space of the shell 11 to generate control commands, meanwhile improving the user's pressing feel. Preferably, a film sheet that covers the button 117 and the through-hole is provided to prevent dust and other debris from entering the through-hole. A decorative component 113 is mounted to the end of the shell 11. Other structures in this embodiment as shown in FIG. 18 are similar to those in the fourth embodiment mentioned above, and the same structures are not described again here.

Figure 19:
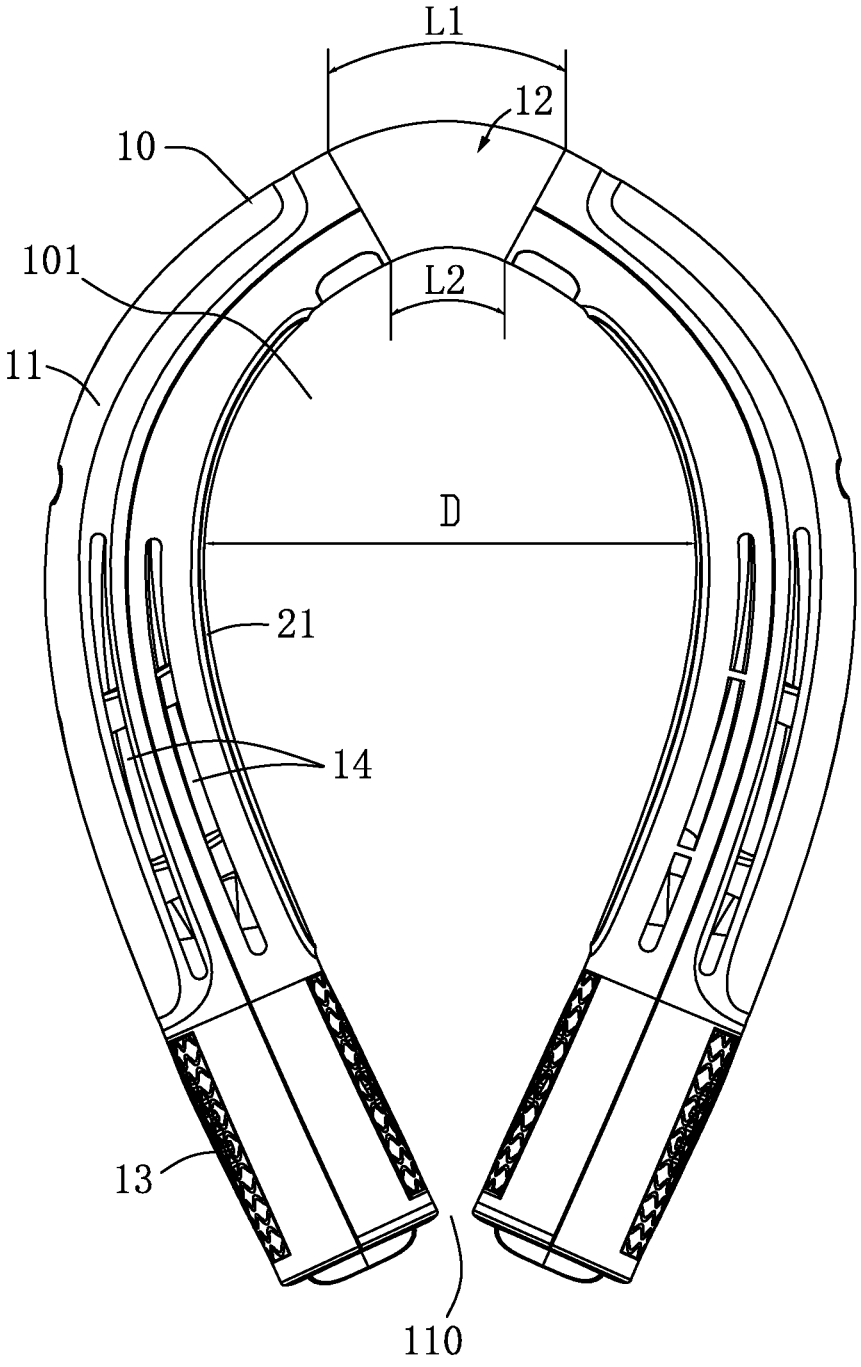
FIG. 19 is a perspective assembled view of a wearable air conditioner according to a sixth embodiment of the present invention.

FIGS. 19-26 illustrates a portable wearable air conditioner in accordance with a sixth embodiment of the present invention. The portable wearable air conditioner of the sixth embodiment differs from that of the fourth embodiment in that: the body 10 is of an arc-shaped structure which surrounds a wearing space 101. The shape of the wearing space 101 matches the shape of a human neck. Each shell 11 includes a connecting end 102 connected to the elastic restore member 12 and a free end 103 away from the elastic restore member 12. From the connecting ends 102 towards the free ends 103, the distance between the two shells 11 gradually increases and then gradually decreases. The maximum distance between the two shells 11, i.e., the maximum size of the wearing space 101 along the horizontal direction in FIG. 19, is located approximately at the middle position of the shells 11. As shown in FIG. 19, the position where the wearing space 101 has the maximum size is consistent with the position where the distance between the two temperature conducting portions 21 is the maximum. The temperature conducting portions 21 located on the inner sidewalls of the shells 11 are of arc-shaped structures. Each temperature conducting portion 21 include a first end close to the elastic restore member 12 and a second end away from the elastic restore member 12. In the initial state, the distance between the two temperature conducting portions 21 gradually increases and then gradually decreases from the first end towards the second end. The maximum distance between the two temperature conducting portions 21 on the two shells 11 is denoted as D, 90 mm≤D≤110 mm. Through a lot of wear tests on people with different neck sizes, the inventors of the present application have found that by designing the maximum distance between the two temperature conducting portions 21 on the two shells 11 to be D, 90 mm≤D≤110 mm (preferably 100 mm), it can effectively ensure that after wearing the device, the elastic restore member 12 can restore its original shape and automatically force the temperature conducting portions 21 to fit against the skin of the user's neck, ensuring good temperature control effects and stable and comfortable wearing experience. Understandably, in order to prevent the necks of some users with larger neck size from being excessively compressed by the two temperature conducting portions 21 during wearing, the maximum distance D between the two temperature conducting portions 21 of the two shells 11 can be appropriately increased, for example, the maximum distance D can be increased to 125 mm. An opening 110 is formed between the free ends 103 of the two shells 11 of the body 10, providing convenience for wearing the device around the user's neck through the opening 110. In a natural state of the elastic restore member 12, i.e., when the elastic restore member 12 is not deformed, the maximum distance between the two temperature conducting portions 21 is generally smaller than the diameter of the human neck. When wearing the portable wearable air conditioner around the neck, the user can move the two shells 11 in opposite directions to increase the size of the opening 110, making it easier to wear the device around the neck. When worn around the neck, under the elastic reset force of the elastic restore member 12, the two temperature conducting portions 21 are in contact with the user's neck. Specifically, the elastic restore member 12 has a tendency of restoring to its original shape to thereby urge the temperature conducting portions 21 to contact with the user's neck firmly, thus ensuring better temperature control.

Figure 23:
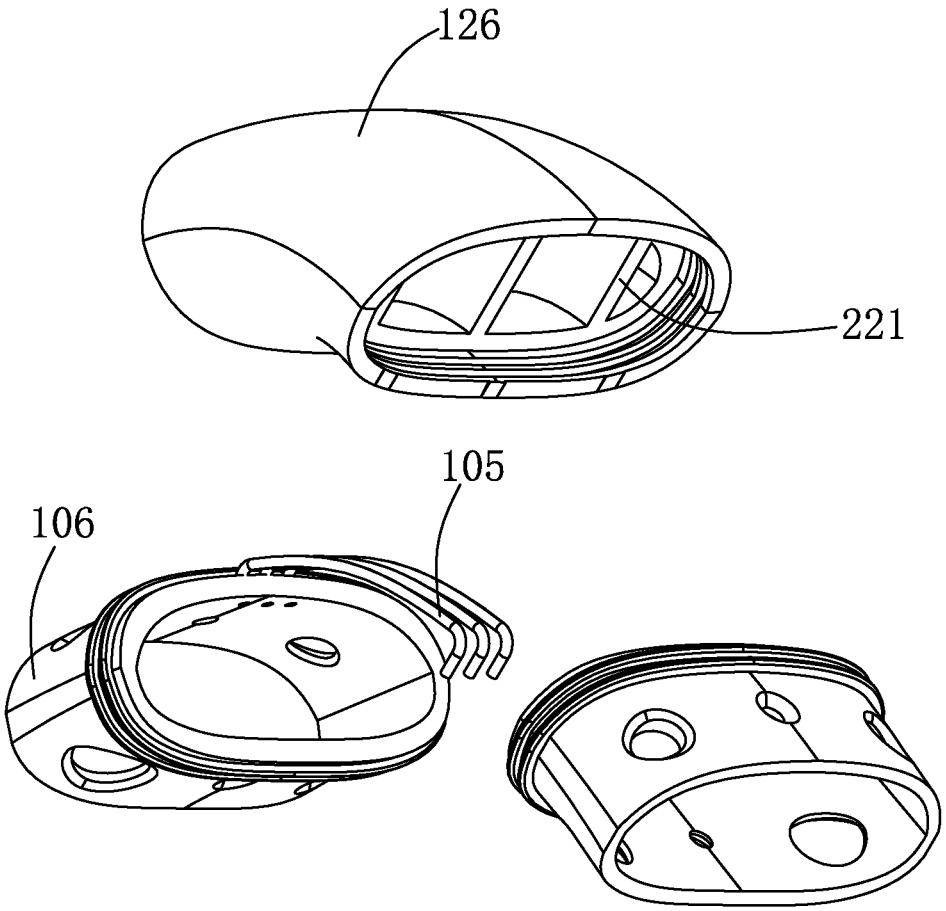
FIG. 23 is an exploded view of a connecting member of the wearable air conditioner of FIG. 19.
Figure 24:
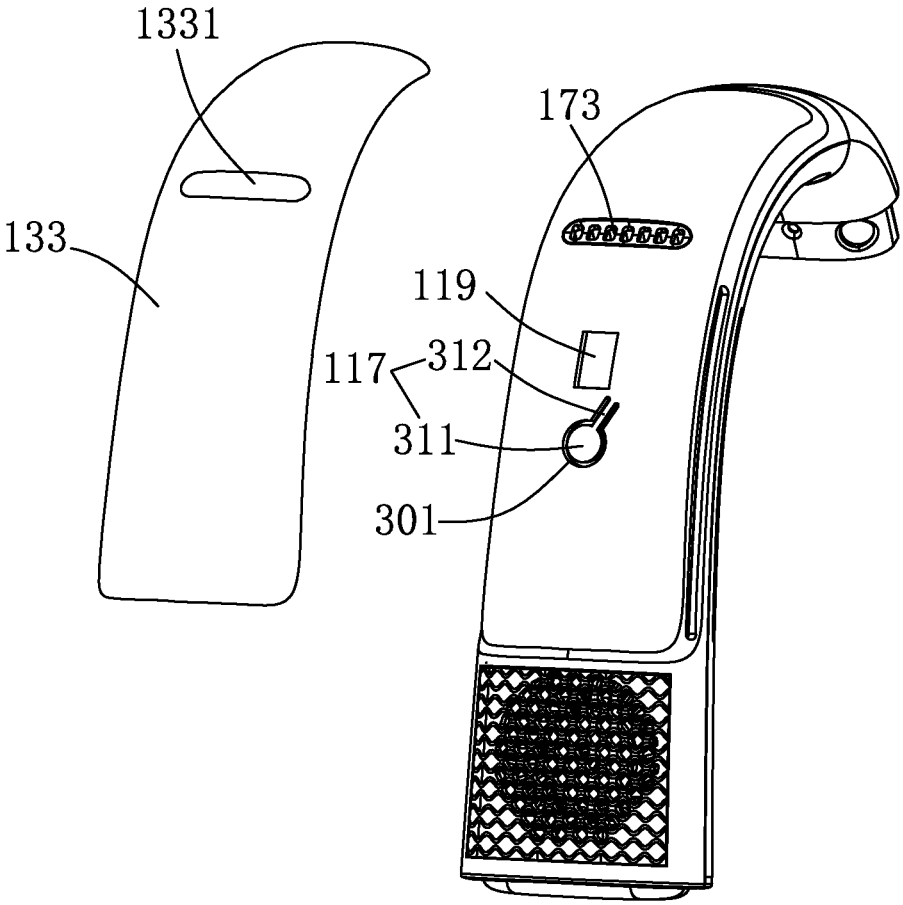
FIG. 24 illustrates a shell of the wearable air conditioner of FIG. 19, a cover plate being departed from other parts of the shell.
Figure 25:
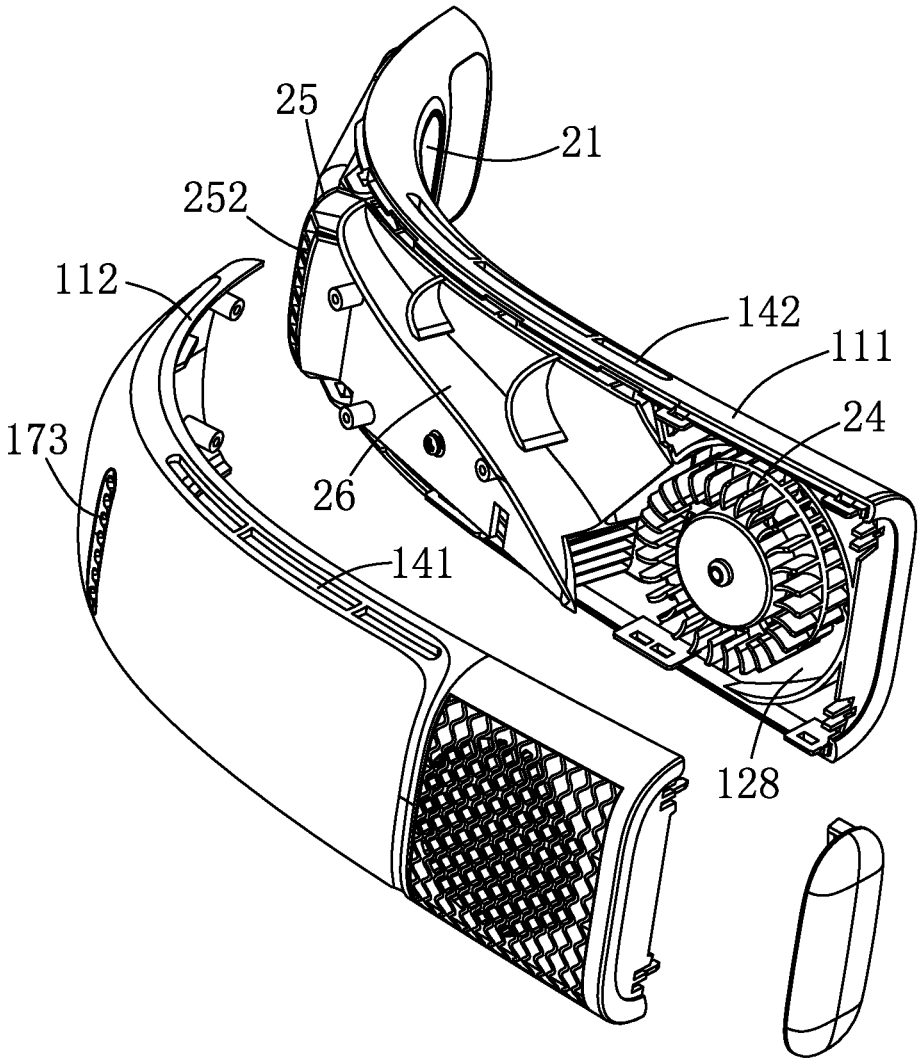
FIG. 25 is an exploded view of the shell of the wearable air conditioner of FIG. 19.
Figure 26:
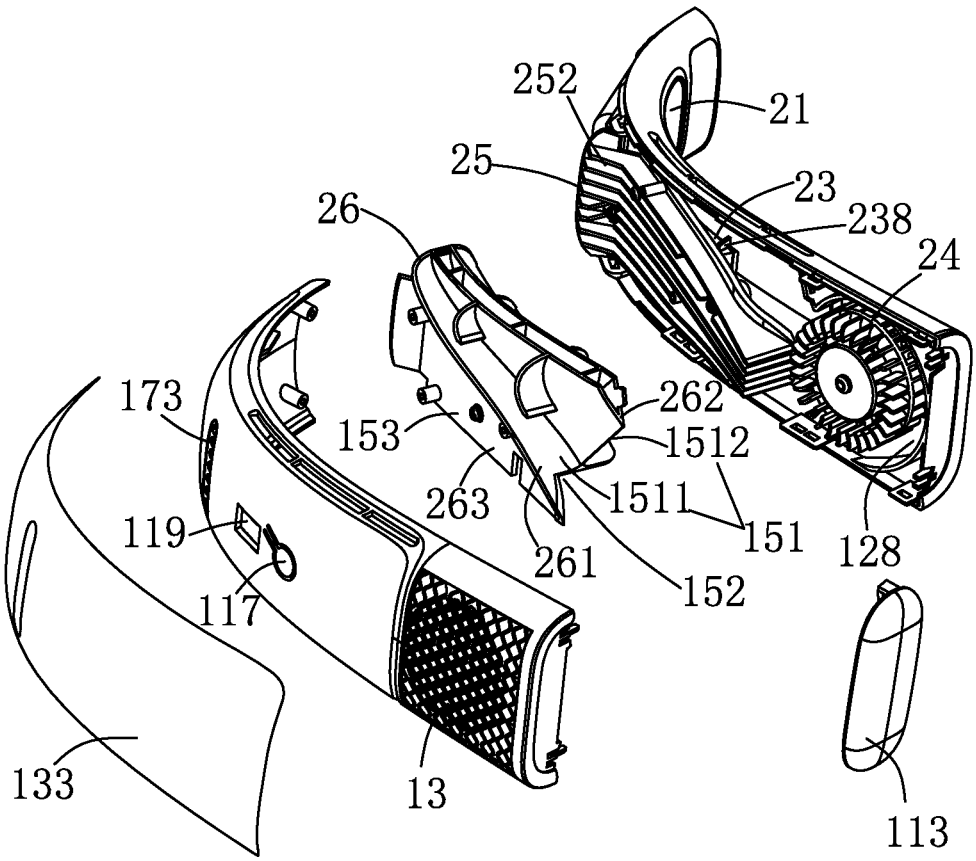
FIG. 26 is a further exploded view of FIG. 25.

Optionally, when the body 10 is worn on the corresponding part of the human body, the two shells 11 are spread apart to cause elastic deformation of the elastic restore member 12. As a consequence, the elastic restore member generates an elastic restoring force that urges the temperature conducting portions 21 to firmly contact with the corresponding part of the human body. Here, the corresponding part of the human body refers to the part of the body where the portable wearable air conditioner is originally designed to be worn, such as the wrist when the portable wearable air conditioner is designed to be worn on the wrist, the waist when the portable wearable air conditioner is designed to be worn on the waist, or the neck when the portable wearable air conditioner is designed to be worn around the neck. The initial size of the wearing space 101 is smaller than the size of the corresponding part of the human body. Referring to FIGS. 19 and 23, in an optional specific example, in the natural state of the body 10, i.e., without applying external forces to the shells 11 to deform the elastic restore member 12, the size/width of the opening 110 is smaller than the distance between the connecting ends 102 of the two shells 11, i.e., the size/width of the opening 110 is smaller than the middle arc length of the outer sidewall of the elastic restore member 12. This design ensures that the initial size of the wearing space 101 is smaller than the size of the human neck, so that the elastic restore member 12 can provide a sufficient elastic pre-clamping force. When the body 10 is worn around the user's neck, the elastic restore member 12 can automatically restore its elastic deformation to provide a sufficient clamping force to the two shells 11, ensuring that the temperature conducting portions 21 on the two shells 11 firmly contacting the user's neck, resulting in stable wearing and sufficient contact between the temperature conducting portions 21 and the user's neck.

The inner sidewalls of the shells 11 are concavely provided with cutouts 115, in which the temperature conducting portions 21 are located. A glue layer is provided between the temperature conducting portions 21 and the bottom of the cutouts 115. The design of the cutouts 115 ensures that the temperature conducting portions 21 do not protrude significantly from the inner sidewalls of the shells 11 after being connected to the inner sidewalls, which also makes the connection between the temperature conducting portions 21 and the inner sidewalls of the shells 11 more secure. The bottom of the cutouts 115 further defines adhesive slots 1151 and connecting holes 1152. The adhesive slots 1151 can conveniently accommodate the adhesive layer (i.e., glue layer) used to fix the temperature conducting portions 21 in the cutouts 115, preventing the glue from overflowing onto the surface of the temperature conducting portions 21. The glue placed inside the cutouts 115 solidifies to form the adhesive layer. The temperature conducting portions 21 are provided with connection columns 213, which are inserted into the connecting holes 1152 and fixed to the shells 11, ensuring that the temperature conducting portions 21 are firmly connected to the shells 11 both by the adhesive layer in the cutouts 115 and by the connection columns 213 inserted into the connecting holes 1152. This dual fixation method ensures a stable connection between the temperature conducting portions 21 and the shells 11, and the glue layer can seal the gap between the temperature conducting portions 21 and the bottom of the cutouts 115, making the connection more secure. A through-hole may be further defined in the bottom of the cutouts 115 to allow the temperature conducting portions 21 to thermal connect with the temperature regulating members 23 inside the shells 11.

The temperature conducting portions 21 being arranged on the inner sidewalls of the two shells 11 comprises the temperature conducting portion completely arranged on the inner sidewalls, and the temperature conducting portion being L-shaped and at least one part being located at the inner sidewall and the other part being located at the bottom sidewall which is connected between the inner sidewall and the outer sidewall, which allows the temperature conducting portion 21 to cool or heat the shoulder of the user.

Optionally, the elastic restore member 12 comprises an inner core 105 connected between the connecting ends 102 of the two shells 11. The inner core 105 is capable of restoring its original shape after being elastically deformed. Thus, the inner core 105 forms a component which is capable of restoring its original shape after being elastically deformed. Preferably, the inner core 105 is of arc-shaped. Thus, after being elastically deformed, the inner core 105 is capable of restoring to its original arc shape to thereby apply a squeeze force to drive the two shells 11 to move toward each other, ensuring the inner sidewalls of the shells 11 firmly contacting with the human neck. Further, the inner core 105 is elongated and arc-shaped, connected between side edges of the connecting ends 102 of the shells 11. That is, the inner core 105 is connected to the side edges of the connecting ends 102 of the shells 11. Thus, a required force to deform the inner core 105 can be reduced, allowing users to use a smaller force to conveniently open the two shells 11 apart to allow the wearing parts of the human body to enter into the wearing space 101. After the inner core 105 is restored to its natural state, it can ensure that the shells 11 do not apply a too big clamping force to the wearing part of the human body. In this embodiment, the inner core 105 includes multiple arc-shaped metal elements arranged in intervals. For example, multiple parallel and spaced steel wires can be provided. The number of the steel wires can be 2, 3, or more. The inner core 105 is composed of multiple elongated metal elements, which facilitates adjusting the required external force for the deformation of the inner core 105 by changing the diameter and quantity of the metal elements and adjusting the force of the inner core 105 to drive the shells 11 against the user's body. In this embodiment, the inner core 105 includes three metal steel wires arranged in intervals, and the inner core 105 is connected between the outer edges of the two connecting ends 102. In other embodiments, the inner core 105 can be composed of two steel wires arranged in intervals, and connected to opposite two edges of the connecting ends 102, for example, one steel wire being connected between the inner edges of the two connecting ends 102, and the other steel wire being connected between the outer edges of the two connecting ends 10. Alternatively, in other embodiments, the inner core 105 can also be made of a relatively hard plastic material that can be elastically deformed and restored, or the inner core 105 can also consist of only one metal sheet.

The inner core 105 being connected between the connecting ends of the two shells 11 comprises the inner core 105 being connected to the connecting ends of the shells 11 directly and indirectly. In some embodiments, the elastic restore member 12 further comprises two fixing blocks 106 connected to opposite ends of the inner core 105 respectively. The inner core 105 is connected to the shells 11 respectively via the two fixing blocks 106. The fixing blocks 106 made of hard plastic material have a shape matching with that of the connecting ends of the shells 11 respectively. The two opposite ends of the inner core [15] 105 and the fixing blocks 106 are fixed together via injection molding. The two opposite ends of the inner core 105 is connected to the connecting ends of the shells 11 respectively via the two fixing blocks 106. Each fixing block 106 is provided with fixing holes 1060. The connecting ends of the shell 11 are provided with through holes corresponding to the fixing holes 1060. The connecting ends of the shell 11 are further provided with positioning posts 107 in which the through holes are defined. The fixing blocks 106 may be inserted into the connecting ends of the shell 11. The positioning posts 107 are inserted into the positioning holes 1060 and fasteners such as screws are extended through the through holes to be fixed to the fixing holes 1060 to thereby fix the fixing blocks 106 to the ends of the corresponding shells 11. Sidewalls of the connecting ends 102 of the shells 11 are provided with concaved portions 108 at positions where the connecting ends 102 are fixed to the fixing blocks 106. The through holes are defined in the concaved portions 108. The shell 11 further comprises a cap 150 which is detachably mounted to the recessed portion 108 to shield the through hole and a portion of the fastener exposed to the concaved portion 108. Such design not only simplifies the installation and connection between the inner core 105 and the shell 11, but also maintains the concise and beautiful appearance of the body 10. The cap 150 can be detachably mounted to the concaved portion 108 through the combination of buckles 1501 and locking holes. In this embodiment, the edge of the concaved portion 108 is provided with multiple locking holes 1160, and the edge of the cap 150 facing the edge of the concaved portion 108 are provided with multiple buckles 1501 corresponding to the locking holes 1160. The cap 150 is detachably mounted to the concaved portion 108 by the buckles 150 being locked into the corresponding locking holes 1160.

Figure 20:
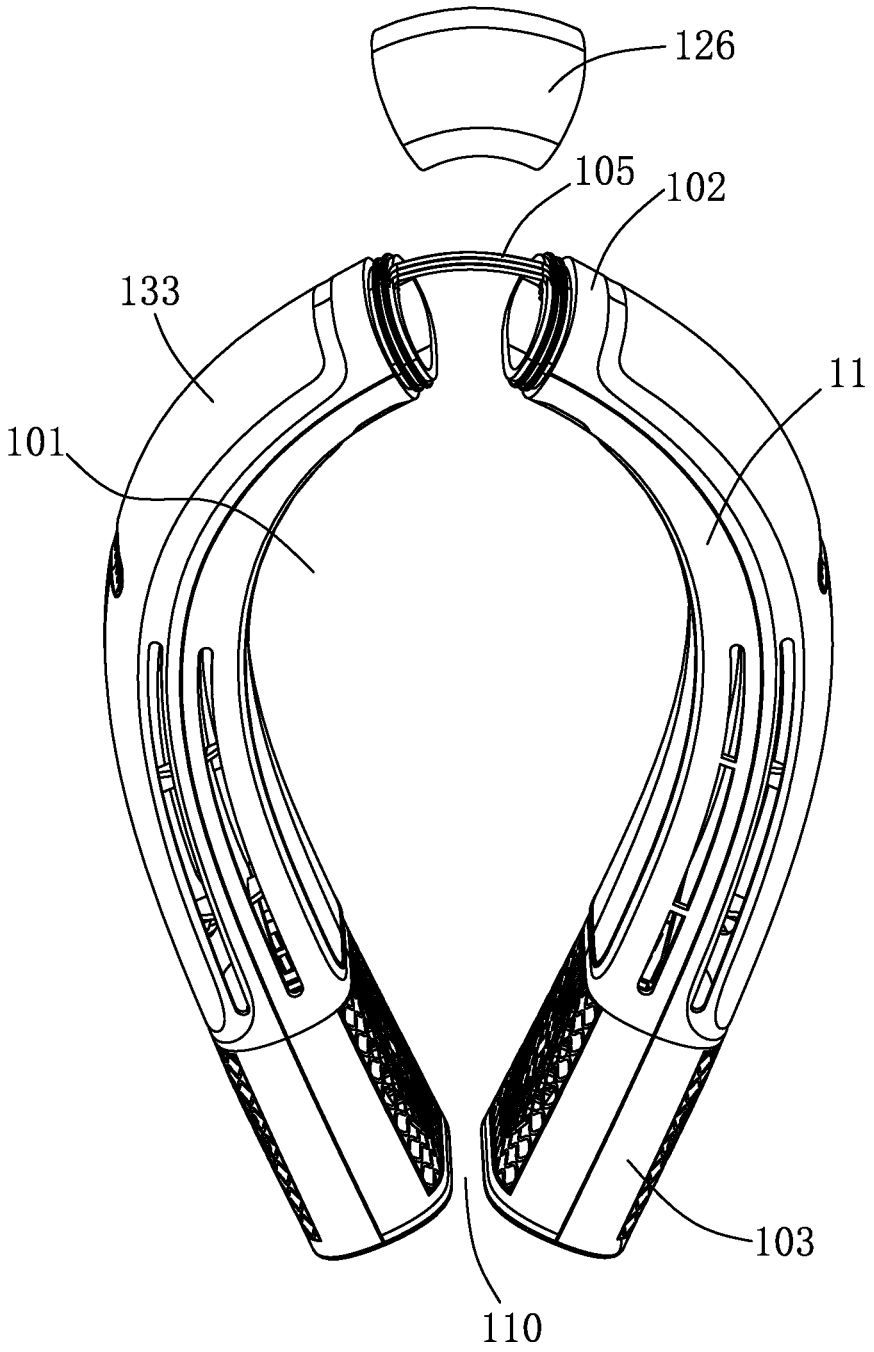
FIG. 20 is an exploded view of FIG. 19.
Figure 21:
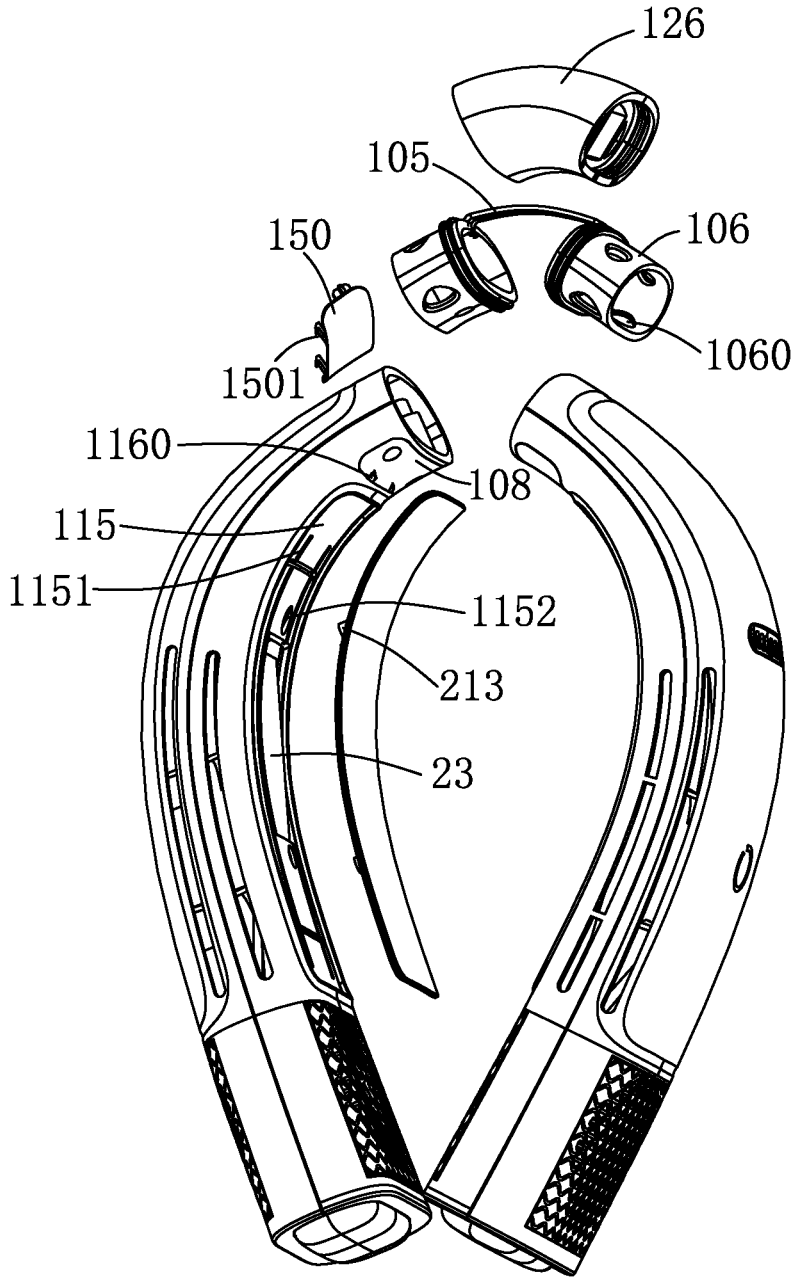
FIG. 21 is a further exploded view of FIG. 20.
Figure 22:
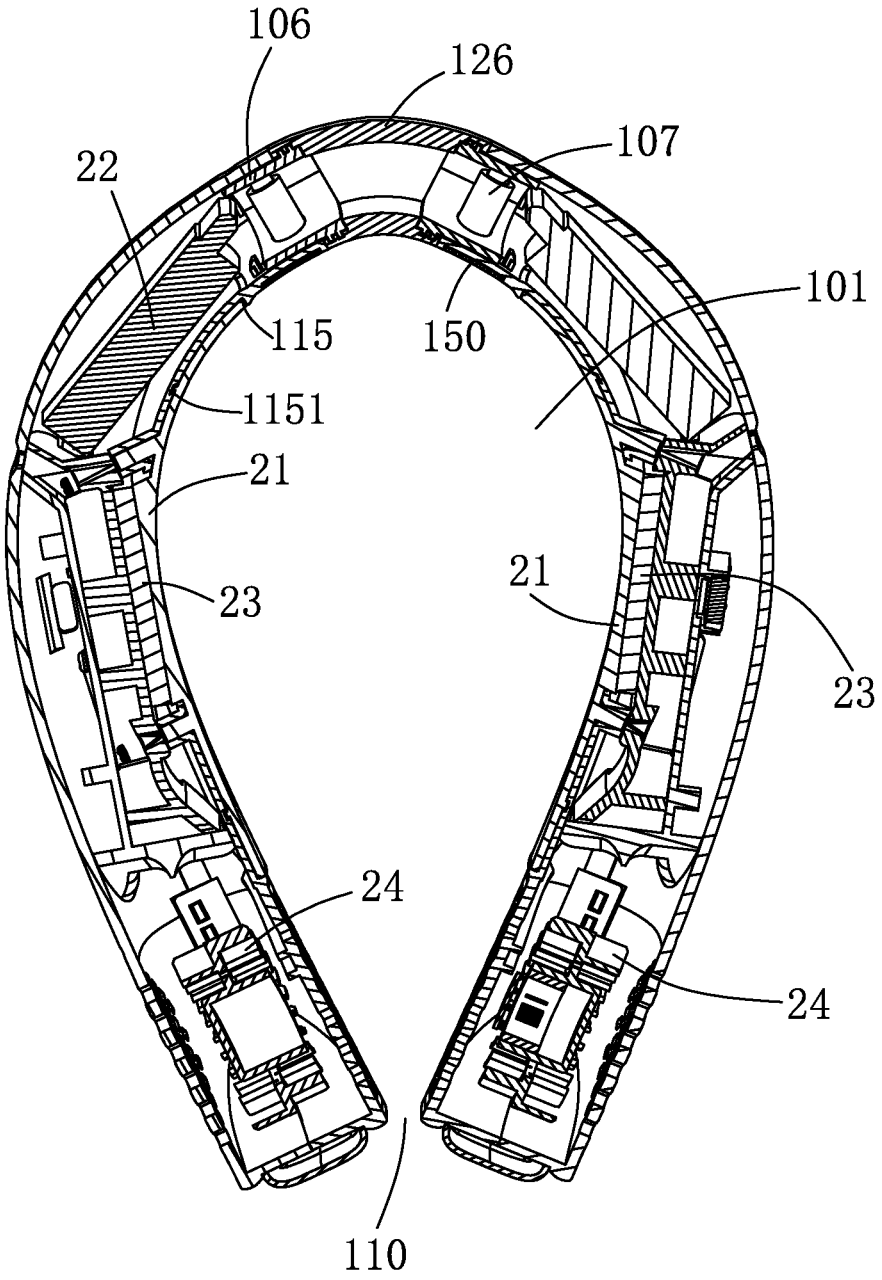
FIG. 22 is a longitudinal cross-sectional view of FIG. 19.

Further, the elastic restore member 12 further comprises a sleeve 126 with an elastic restoring function. The sleeve 126 can restore to its original shape after being elastically deformed by an external force. In this embodiment, the sleeve 126 is made of an elastic material, for example, a silicone material, so that the sleeve 126 can be elastically deformed under action of an external force. The inner core 105 is located inside the sleeve 126. When the inner core 105 and the sleeve 126 are connected to the two shells 11 via the two fixing blocks 106, the outer surface of the sleeve 126 is smoothly connected with the outer surfaces of the connecting ends 102 of the shells 11. The elastic restore member 20 is of an arc-shaped structure, an arc length L1 between middle points of two ends of an outer sidewall of the elastic restore member 20 is greater than an arc length L2 between middle points of two ends of an inner sidewall of the elastic reset piece, as shown in FIG. 20 and FIG. 23. That is, a longitudinal section of the sleeve 126 is fan-shaped, and the length of the inner sidewall is shorter than that of the outer sidewall, so that when the shells 11 connected to two ends of the elastic restore member 20 are moved away from each other under action of an external force, the elastic restore member 20 is elastically deformed; after the shells 11 are released, the sleeve 126 can provide an elastic restoring force to squeeze the shells 11 inwardly. In some other embodiments, the inner core 105 can be omitted, the inner sidewall of the shell 11 is kept in contact with a human body by the sleeve 126 alone. That is, the sleeve 126 can be arranged together with the inner core 105, or can be arranged alone. The elastic restore member 20 including an inner sidewall facing the wearing space 101 and an outer sidewall opposite to the inner sidewall. The ratio that the arc length L1 between midpoints of the two ends of the outer sidewall of the elastic restore member 20 and the arc length L2 between midpoints of the two ends of the inner sidewall is a1, 1.5≤a1≤2.5. In a preferred embodiment, the outer contour of the elastic restore member 20 is defined by the sleeve 126, the ratio of the arc length L1 between the middle points of the two ends of the outer sidewall of the sleeve 126 to the arc length L2 between the middle points of the two ends of the inner sidewall thereof is between 1.5 and 2.5. The arc length L1 between the middle points of the two ends of the outer sidewall of the elastic restore member 20 is the arc length connecting the middle points of the two ends of the outer sidewall of the sleeve 126, i.e. the connecting arc length of the outer sidewall of the sleeve 126 along the center line of the length direction thereof, and the arc length L2 between the middle points of the two ends of the inner sidewall of the elastic restore member 20 is the arc length connecting the middle points of the two ends of the inner sidewall of the sleeve 126, i.e. the connecting arc length of the inner sidewall of the sleeve 126 along the center line of the length direction thereof. After doing multiple tests, the inventors of the present application have found that by designing a1 within the above ratio range, an optimized elastic force can be provided by the elastic restore element 12 to maintain a fit contact between the temperature conducting portion 21 and the wearing part of the corresponding human body after the body 10 is placed on the corresponding wearing part. The elastic force provided by the elastic reset element 12 can maintain a stable and comfortable wearing experience. Discomfort when worn too tightly is avoided. Further, the shell 11 and the temperature conducting portion 21 are of arc structures, the temperature conducting portion 21 has two parts which are located on the inner sidewalls of the two shells respectively. The ratio of the arc length between the middle points of the two ends of each temperature conducting portion 21 to the arc length between the middle points of the two ends of the inner sidewall of the corresponding shell 11 is a2, the arc length between the middle points of the two ends of the temperature conducting portion 21 refers to the length of the connecting arc line of the temperature conducting portion 21 along the center line of the length direction thereof, the arc length between the middle points of the two ends of the inner sidewall of the shell 11 refers to the length of the connecting arc line of the inner sidewall of the housing along the center line of the length direction thereof, 0.6≤a2≤0.8, so that the occupation ratio of the temperature conducting portion 21 in the length direction of the shell 11 is relatively large under the condition that the air inlet 113 is not blocked. It can be ensured that after the body 10 is worn on the wearing part of the human body, the temperature conducting portion 21 can be kept in contact with the wearing part of the human body to the maximum extent, and the contact area is larger, thereby achieving a better temperature adjustment effect on the wearing part of the human body.

A slight gap is formed between the two ends of the inner sidewall of the sleeve 126 and the connecting ends 102 of the shells 11, respectively; that is, the inner sidewall of the sleeve 126 is not completely in contact with the connecting ends 112 of the shells 11, which facilitates to stretch/open the two shells 11 away from each other and deform the elastic restore member 20. The sleeve 126 is connected between the connecting ends of the two shells 11. When the elastic restore member 20 is in the natural state, the surface of the sleeve 126 and the surface of the connecting ends of the shells 11 are connected smoothly, ensuring the body 10 having a smooth aesthetic appearance as a whole. After being deformed, the sleeve 126 can elastically restore to make the inner sidewalls of the shells 11 worn on a wearing portion of a human body firmly contact with the skin of the wearing portion, promoting wearing stability. Optionally, at least one separation sheet 221 is disposed in an interior space of the sleeve 126, and the separation sheet 221 extends along the length direction of the sleeve 126. The at least one separation sheet 221 may comprise multiple separation sheets 221 which are located inside the sleeve 126 at intervals. Opposite two sides of each separation sheet 221 are respectively connected with the inner sidewall and the outer sidewall of the sleeve 126. The partition sheets 221 are connected between the inner and outer sidewalls of the sleeve 126 and extend along the length direction of the sleeve 126, which facilitates to enhance the structural strength of the sleeve 126 such that the sleeve 126 has an increased elastic restoring force. Furthermore, the partition sheets 221 can divide the internal space of the sleeve 126 into a plurality of (i.e., at least two) channels for the wires connecting the electronic components in the two shells 11 to pass through, and prevent the wires from being twisted and knotted. The partition sheets 221 and the sleeve 126 can be integrally formed by injection molding the same material (e.g., silicone). The number of the partition sheet 221 can also be one. In other embodiments, the sleeve 126 may be made of other flexible deformable materials, and the elastic deformation and the elastic restoration of the elastic restore member 22 can be realized by the inner core 105.

In some embodiments, the outer sidewalls of at least one of shell 11 is provided with a button 117 and a through hole 301 corresponding to the button 117. The button 117 includes a pressing part 311 located in the through hole 301 and an elastic arm 312 connected between the pressing part 311 and the peripheral edge of the through hole 301. The shell 11 is formed with the through hole 301 at the position corresponding to the button 117, and the pressing part 311 is disposed in the through hole 301 through the elastic arm 312. Thus, the button 117 has elasticity and it is convenient for users to operate and press the button 117. In some embodiments, the number of the buttons 117 is two, including a first button and a second button. The first button is used to control the wearable air conditioner to switch among a cooling mode, a fan mode, and a heating mode, and the second button is used to control the on/off of the wearable air conditioner and switch of the settings of working conditions of the wearable air conditioner in different modes. The body 10 is further provided with a loudspeaker (not shown) with a voice broadcasting function. For example, the loudspeaker is arranged in one of the shells 11, and the corresponding sound outlet holes are defined in one of the sidewalls of the corresponding shell 11 such that the sound generated by the loudspeaker can spread out via the sound holes. The first button and the second button can cooperate to control the loudspeaker to switch language modes of the voice broadcasting.

In some embodiments, the first button is arranged at the outer sidewall of one of the shells 11 and configured to control the wearable air conditioner to switch among the cooling mode, the fan mode, and the heating mode. The second button is arranged at the outer sidewall of the other shell 11 and configured to control the on/off of the wearable air conditioner and switch of the settings of working conditions of the wearable air conditioner in different modes. Preferably, the working modes of the wearable air conditioner comprises the cooling mode, the fan mode, and the heating mode, the first button is configured to control the wearable air conditioner to switch among the cooling mode, the fan mode, and the heating mode, and the second button is configured to control the on/off of the wearable air conditioner and switch of the settings of working conditions of the wearable air conditioner in the cooling/fan/heating modes. The wearable air conditioner comprises multiple language modes for voice broadcasting, such as Chinese mode, English mode, Japanese mode, Korean mode. By the user touching or pressing the first and second buttons, the language modes of the speaker can be switched. In some other embodiments, the two buttons 117 can be arranged on the same shell 11. In this embodiment, the two buttons 117 are respectively arranged on the two shells 11 and electrically connected to the circuit boards in the corresponding shells 11 for different operations corresponding to different functions, which facilitates the user to operate, avoiding mis-operation.

In this embodiment, the cooling mode, the fan mode and the heating mode each include three settings. The wearable air conditioner has a mode memory function. That is, when the wearable air conditioner is turned off, the current working mode can be recorded. When the wearable air conditioner is turned on next time, the wearable air conditioner directly enters the recorded setting of the last working mode. The functional operation logics of the two buttons are as follows: when the wearable air conditioner is turned off in the refrigeration mode last time, the wearable air conditioner starts to work in the refrigeration mode by light touch of the second button once, in the mode, the temperature regulating member 23 and the fan 24 start to work simultaneously; meanwhile, the loudspeaker makes a sound to prompt that the operation is effective, and the wearable air conditioner enters the refrigeration first-setting mode. When the second button is lightly touched once again, the temperature regulating member 23 and the fan 24 start to work in the second setting, and meanwhile, the loudspeaker makes a sound to prompt that the operation is effective, and the wearable air conditioner enters a refrigerating second setting mode. When the second button is lightly touched once again, the temperature regulating member 23 and the fan 24 start to work in the third setting, meanwhile, the loudspeaker makes a sound to prompt that the operation is effective, and the wearable air conditioner enters a refrigeration third setting mode. When the second button is touched once again, the wearable air conditioner is turned off, and meanwhile, the loudspeaker makes a sound to prompt the shutdown. The fan mode comprises three settings, in the refrigeration mode, the wearable air conditioner is switched to the fan mode by lightly touching the first button once, the fan 24 starts to work in the first setting, the temperature regulating member 23 stops working; when the second button is lightly touched once again, the fan 24 starts to work in the second setting, meanwhile, the loudspeaker makes a sound to prompt that the operation is effective, and the wearable air conditioner enters the second setting mode of the fan; when the second button is touched once again, the fan 24 starts to work in the third setting, and meanwhile the loudspeaker makes a sound to prompt that the operation is effective, so that the wearable air conditioner enters a fan third setting mode; when the second switch key is touched once again, the wearable air conditioner is turned off, and the loudspeaker makes a sound to prompt the shutdown. When the wearable air conditioner works in any of the fan mode settings, the wearable air conditioner can be switched to the refrigeration mode by touching lightly the first button.

The heating mode comprises three settings. When the wearable air conditioner works in the fan mode or the refrigerating mode, the first button is pressed for 1.5 seconds for a single time, the temperature regulating member 23 starts to work, meanwhile, the loudspeaker makes a sound to indicate that the operation is effective, the voltage polarities at the two ends of the temperature regulating member 23 are exchanged, and the temperature regulating member 23 starts the first heating setting mode; the second button is lightly touched once again, the temperature regulating member 23 increases the working power, meanwhile, the loudspeaker makes a sound to indicate that the operation is effective, and the wearable air conditioner starts the second heating setting mode; the second button is lightly touched once again, the temperature regulating member 23 increases the working power, meanwhile, the loudspeaker makes a sound to indicate that the operation is effective, and the wearable air conditioner starts the third heating setting mode; and the second button is touched once again, the wearable air conditioner is turned off, the loudspeaker makes a sound to indicate t the shutdown. The fan 24 does not work in the heating mode. Optionally, the second button may also be used to quickly turn off the cooling mode, the fan mode, and the heating mode, for example, when the wearable air conditioner is working in any one of the cooling mode, the fan mode, and the heating mode, if the second button is pressed for 1.5 seconds, the wearable air conditioner will be turned off and the speaker will make a sound to indicate the wearable air conditioner to be turned off.

When the wearable air conditioner is in a standby state at which the wearable air conditioner does not work, the working mode of the wearable air conditioner can be checked by touching the first button, and the user can switch the working mode of the wearable air conditioner to a required mode by touching the first button and then turns on the wearable air conditioner by touching the second button. In some embodiments, a display window 119 is further disposed on the outer sidewall of the shells 11 where the button 117 is disposed. A display module is disposed in a position of the shell 11 corresponding to the display window 119, and the display window 119 is made of a transparent material (i.e., the display window 119 being a transparent area) or the display window 119 is an opening. The display device is configured to display at least one of: the power, setting, temperature and working mode. The user can see the display information of the display device through the display window 119. A thin cover plate 133 is disposed on the corresponding outer sidewall of the shell 11 and configured for shielding the button 117, the through hole 301 and the display window 119. The cover plate 13 can protect the button 117 from being damaged and prevent impurities such as dust from entering the shell 11 from the through hole 301. The cover plate 13 may be a PET film, and is fixed on the outer sidewall of the shell 11 by injection molding. In this embodiment, the outer sidewalls of the two shells 11 are both provided with the cover plates 13 which cover most of the area of the outer sidewalls of the shells 11. The position of the cover plate 13 corresponding to the vent holes 173 is provided with a through opening 1331 for exposing the vent holes 173.

In some embodiments, the inner surface of the shell 11 corresponding to the periphery of the temperature regulating member 23 is provided with multiple positioning protrusions 238 for assisting in positioning the temperature regulating member 23. Multiple positioning protrusions 238 are spaced around the periphery of the temperature regulating member 23. The structure, position and connecting relationship of the fan 24, partition 26, temperature regulating member 23, heat dissipation member 26, battery 22 and circuit board 27 are similar to that of the fourth embodiment and not repeated here.

Figure 27:
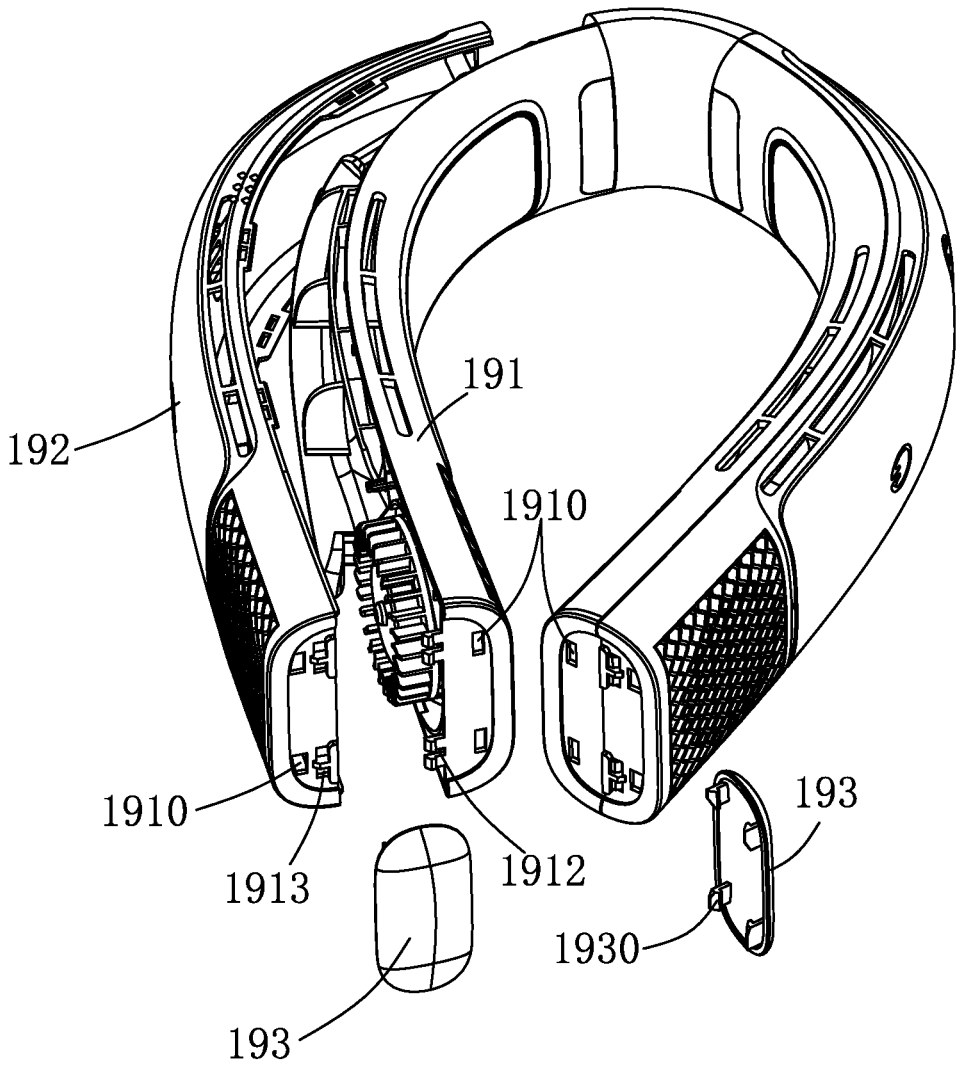
FIG. 27 is an exploded view of a wearable air conditioner according to a seventh embodiment of the present invention.

FIG. 27 illustrates a portable wearable air conditioner in accordance with a seventh embodiment of the present invention. The portable wearable air conditioner of the seventh embodiment differs from that of the sixth embodiment in that: each shell 11 comprises an inner shell 191, an outer shell 192 and an end cover 193. The end cover 193 has a function of decoration like the decoration member of the fourth embodiment. End surfaces of free ends of the inner shell and outer shell 191/192 are provided with first locking structures, the end covers 193 are provided with second locking structures corresponding to the first locking structures respectively. The end covers 193 can be fixed to the free ends of the inner shell and outer shell 191/192 via the second locking structures engaged with the first locking structures respectively. Optionally, the end surfaces of the inner shell and outer shell 191/192 are formed with recessed portion, the first locking structures 1910 are locking holes defined in the end surfaces of the inner and outer shells 191/192 (i.e., parts of the first locking structures 1910 being defined in the end surfaces of the inner shell 191 and the other parts being defined in the end surfaces of the outer shell 192), and the second locking structures 1930 are locking hooks corresponding to the locking holes. The end covers 193 are secured to the end surfaces of the inner and outer shells 191/192 to prevent the inner and outer shells 191/192 from departing from each other. Optionally, the free ends of the inner and outer shells 191/192 are further provided with locking openings 1912 and latches 1913 respectively. For example, one of the inner and outer shells 191/192 is provided with latches 1913 (or locking openings 1912) while the other of the inner and outer shells 191/192 is provided with locking openings 1912 (or latches 1913). The latches are engaged in the corresponding locking openings 1912 to further increase the stability of the connected inner and outer shells 191/192. Alternatively, in some other embodiments, the end covers 193 can be adhered to the end surfaces of the inner and outer shells 191/192 by adhesive.

Figure 28:
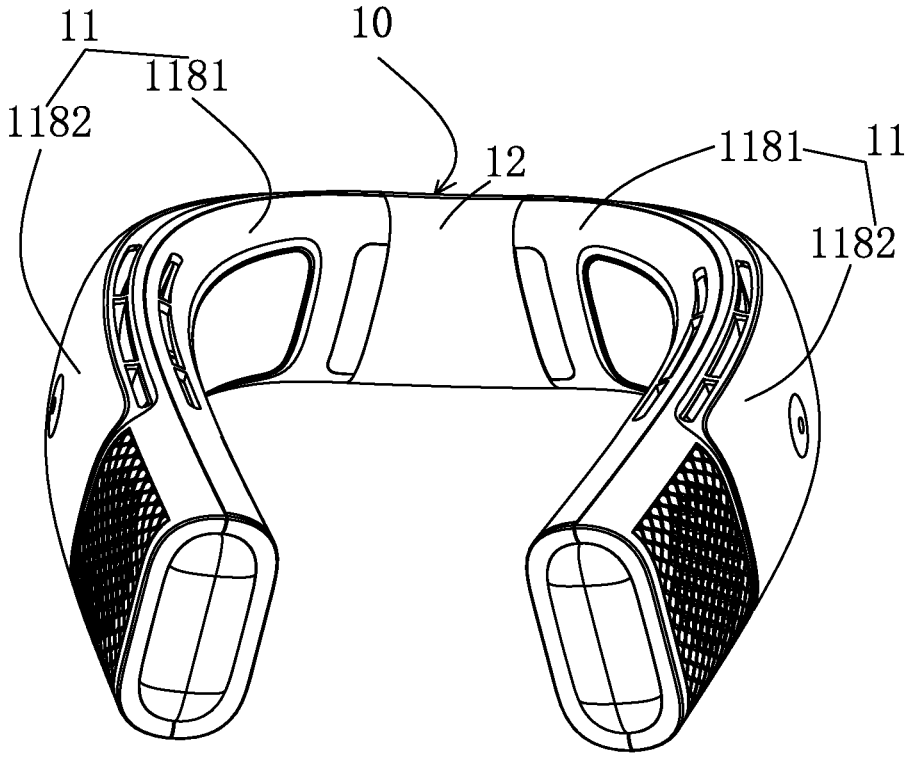
FIG. 28 is an exploded view of a wearable air conditioner according to an eighth embodiment of the present invention.
Figure 29:
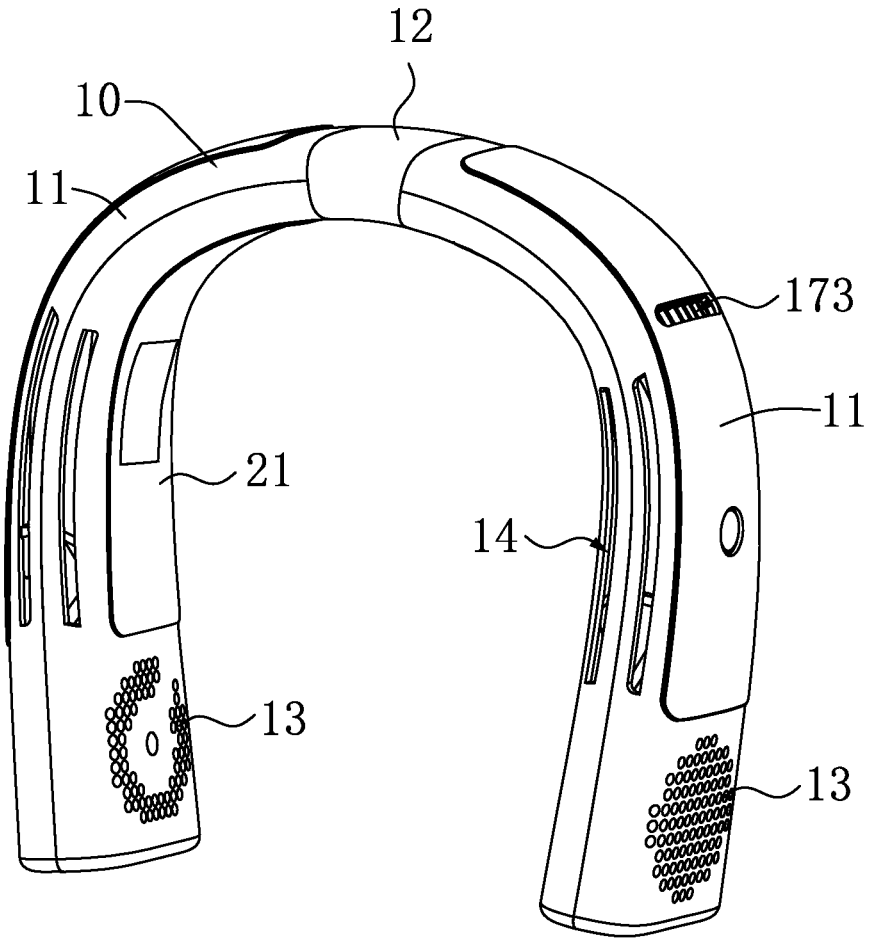
FIG. 29 is an exploded view of a wearable air conditioner according to a ninth embodiment of the present invention.
Figure 30:
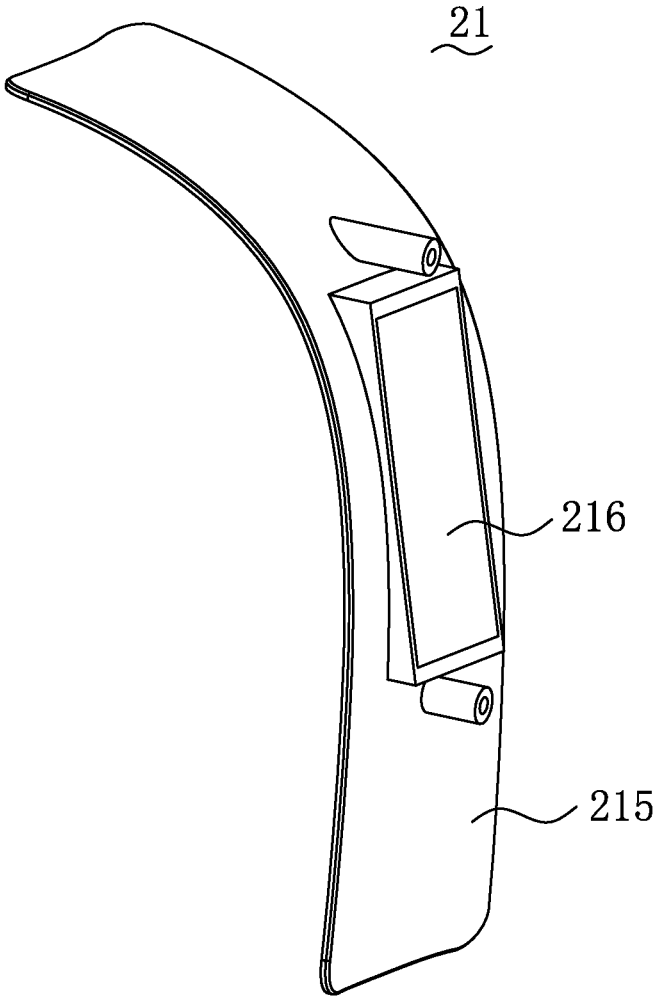
FIG. 30 illustrates a temperature conducting portion of the wearable air conditioner of FIG. 29.

FIG. 28 illustrates a portable wearable air conditioner in accordance with an eighth embodiment of the present invention. The portable wearable air conditioner of the eighth embodiment differs from that of the above-mentioned embodiments in that: each shell 11 comprises a first curved section 1181 and a second curved section 1182 sequentially arranged in a direction from one end thereof close to the elastic restore member 12 toward the other end away from the elastic restore member 12. The second curved section 1182 is twisted toward a bearing surface of the body 10 relative to the first curved section 1181. An angle formed between the first curved section 1181 and the bearing surface is greater than the angle formed between the second curved section 1182 and the bearing surface. In this embodiment, if the wearable air conditioner is for being worn on the neck of a user, when the wearable air conditioner is placed on and supported by any one surface, the bearing surface of the body 10 refers to the surface contacting and supporting the body 10. The angle formed between the first curved section 1181 and the bearing surface is greater than the angle formed between the second curved section 1182 and the bearing surface, which causes the two shells 11 to be in twisted state. As shown in FIG. 28, in the twisted state, the width of the opening formed between the free ends of the two shells 11 increases gradually in a top-to-bottom direction of the body 10. Thus, when the wearable air conditioner is worn on the neck of the user, the first curved sections 1181 of the shells 11 are close to the back side of the neck of the user while the second curved sections 1182 of the shells 11 are close to the breast of the user, and the second curved sections 1182 of the shells 11 are twisted toward the shoulder of the user relative to the first curved sections 1181 of the shells 11, such that the two shells 11 can be supported on the shoulder and the breast of the user, increasing wearing stability and comfortablity.

Figure 31:
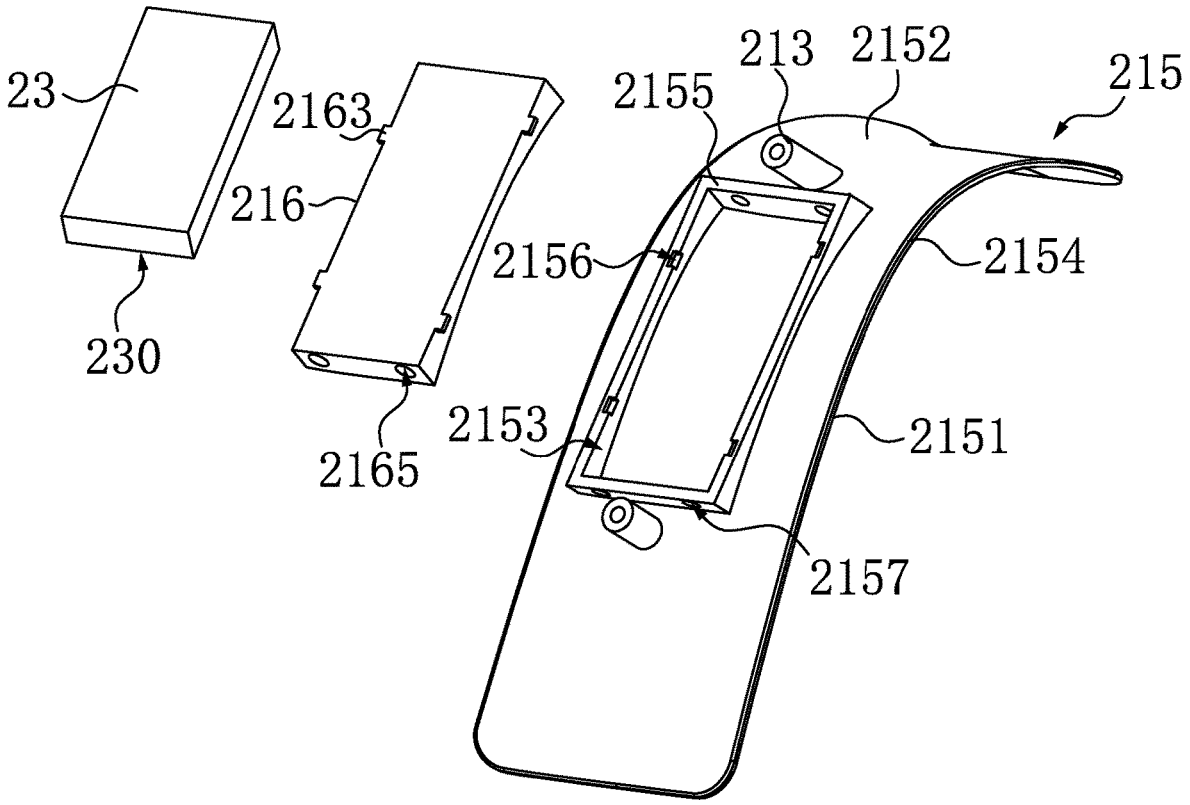
FIG. 31 illustrates a heat regulating member and the temperature conducting portion of the wearable air conditioner of the ninth embodiment.
Figure 32:
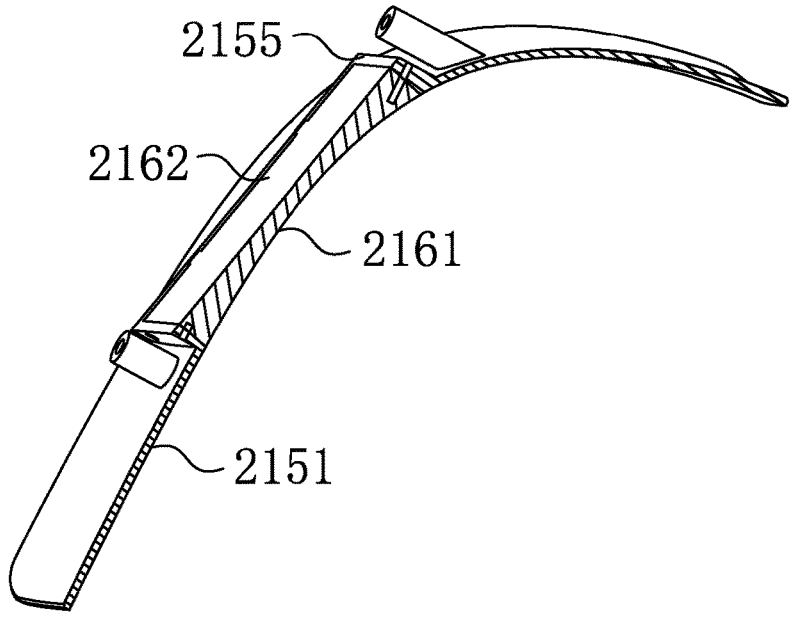
FIG. 32 is a cross sectional view of the temperature conducting portion of the wearable air conditioner of the ninth embodiment.

FIG. 29 to FIG. 32 illustrate a portable wearable air conditioner in accordance with a ninth embodiment of the present invention. The portable wearable air conditioner of the ninth embodiment differs from that of the sixth embodiments in that: the temperature conducting portion 21 of this embodiment comprises a first temperature conducting part 215 and a second temperature conducting part 216. The first temperature conducting part 215 is exposed to a surface of the shell 11 for contacting the skin of the user. The second temperature conducting part 216 is connected between the first temperature conducting part 215 and the temperature regulating member 23. The second temperature conducting part 216 has a thermal conductivity greater than that of the first temperature conducting part 215. The second temperature conducting part 216 which is in contact with the temperature regulating member 23, can absorb heat from the temperature regulating member 23 rapidly and transfer the heat to the first temperature conducting part 215 rapidly and evenly, thereby increasing the thermal conductive efficiency of the first temperature conducting part 215 and achieving an even temperature adjusting effect on the user. In this embodiment, the temperature conducting portion 21 is arranged on a surface of the shell 11. The first and second temperature conducting parts 215/216 can be detached from each other. The first and second temperature conducting parts 215/216 are made of different metal materials with different thermal conductivities. For example, the first temperature conducting part 215 is made of Al and the second temperature conducting part 216 is made of Cu which has a thermal conductivity greater than that of Al. When the temperature regulating member 23 works to generate heat or cold energy, the second temperature conducting part 216 can absorb the heat or cold energy from the temperature regulating member 23 rapidly and transfer it to the first temperature conducting part 215 rapidly and evenly such that the heat or cold energy can be transferred to the wearing portion of the user rapidly and evenly. Referring to FIG. 31 and FIG. 32, in this embodiment, the first temperature conducting part 215 comprises a first contacting surface 2151 exposed to outside of the shell 11 and a connecting surface 2152 opposite to the first contacting surface 2151. The first contacting surface 2151 is configured to contact the wearing portion of the user. In this embodiment, the connecting surface 2152 of the first temperature conducting part 215 is provided with an accommodating cavity 2153 which has a shape matching with that of the second temperature conducting part 216. The second temperature conducting part 216 is accommodated in the accommodating cavity 2153. The peripheral edges of the second temperature conducting part 216 may firmly contact the inner surface of the accommodating cavity 2153 to ensure a good thermal connection between the first and second conducting parts 215/216. The accommodating cavity 2153 can be a through cavity or a blind cavity, exemplarily, the accommodating cavity 2153 is a through cavity which extends through the first contacting surface 2151 and the connecting surface 2152. The second temperature conducting part 216 includes a second contacting surface 2161 for contacting with a human body, the second contacting surface 2161 is flush with the first contacting surface 2151, the second contacting surface 2161 and the first contacting surface 2151 together form the contacting surface of the temperature conducting portion 21 for contacting with the human body, such that the contact surface of the temperature conducting portion 21 for contacting with the human body can be flatter.

In some embodiments, the second contacting surface 2161 and the first contacting surface 2151 are provided with thermal conductive coatings (not shown). The thermal conductive coatings can cover/fill the gaps between the first contacting surfaces 2151 and the second contacting surface 2161 and shield the color difference between the first and second temperature conducting parts 215/216, making the surface of temperature conducting portion 21 smoother and more beautiful. The first temperature conducting part 215 includes a sheet 2154 and a frame 2155. The connecting surface 2152 and the first contacting surface 2151 are respectively located on opposite surfaces of the sheet 2154. The frame 2155 is disposed around the periphery of the accommodating cavity 2153 and protrudes from the connecting surface 2152. The outer circumferential wall of the second temperature conducting part 216 is in thermal connection with the inner circumferential wall of the frame 2155. The outer circumferential wall of the second temperature conducting part 216 can be closely attached to the inner circumferential wall of the frame 2155. The second temperature conducting part 216 further includes a heat-conducting surface 2162 opposite to the second contacting surface 2161, and the heat-conducting surface 2162 can be flush with the end surface of the frame 2155, ensuring a large contact area being formed between the second temperature conducting part 216 and the first temperature conducting part 215. By providing the frame 2155, the thickness of a local portion of the first temperature conducting part 215 adjoining the second temperature conducting part 216 can be made thicker, so as to increase the contact area and thermal conduction efficiency between the second temperature conducting part 216 and the first temperature conducting part 215. In other embodiments, the frame 2155 may protrude from the sheet 2154 and cooperate with the connecting surface 2152 of the sheet 2154 to form the accommodating cavity 2153. The outer circumferential wall of the second temperature conducting part 216 is in thermal connection with the inner circumferential wall of the frame 2155, whereby the second temperature conducting part 216 is connected to the first temperature conducting part 215 as well. In some embodiments, the inner wall of the frame 2155 is provided with first catching portions 2156, and the second temperature conducting part 216 is provided with second catching portions 2163 engaged with the first catching portions 2156. For example, the first catching portions 2156 may include a plurality of catching holes which may be disposed at intervals in the inner circumferential wall of the frame 2155, and the second catching portions 2163 may include a plurality of catching bulges/projections protruding from the outer circumferential wall of the second temperature conducting part 216. The catching bulges/projections can be engaged in the corresponding catching holes to thereby firmly secure the second temperature conducting part 216 to the first temperature conducting part 215. Alternatively, the first catching portions 2156 may include a plurality of catching bulges/projections while the second catching portions 2163 may include a plurality of catching slots. Understandably, the above-mentioned first and second catching portions 2156/2163 may be omitted, the second temperature conducting part 216 may be fixed to the first temperature conducting part 215 by adhesive. For example, the second temperature conducting part 216 may be adhered to the first temperature conducting part 215 by heat conductive resin.

In some embodiments, the temperature regulating member 23 includes a temperature control surface 230 facing the heat-conducting surface 2162. The area of the heat-conducting surface 2162 is larger than that of the temperature control surface 230, and the whole temperature control surface 230 is in contact with the heat-conducting surface 2162. Compared with the first temperature conducting part 215, the second temperature conducting part 216 has a higher heat conductive efficiency, and therefore, by increasing the area of the heat-conducting surface 2162 of the second temperature conducting part 216, the second temperature conducting part 216 has an effect of amplifying the area of the temperature control surface 230 of the temperature regulating member 23. The heat or cold energy generated by the temperature regulating member 23 can be efficiently conducted to the second temperature conducting part 216, and then be efficiently conducted to the first temperature conducting part 215 by the second temperature conducting part 216 with a larger surface area, so that the thermal conductivity of the temperature regulating member 23 is increased.

Figure 33:
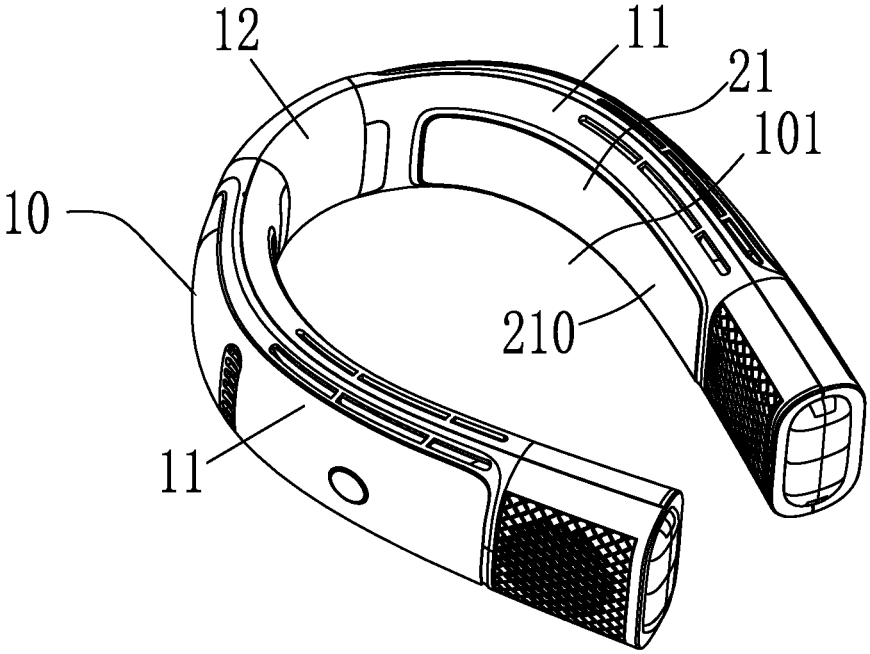
FIG. 33 is a perspective view of a wearable air conditioner according to a tenth embodiment of the present invention.

In some embodiments, as shown in FIGS. 32 and 33, the frame 2155 may be provided with connecting through holes 2157, the outer circumferential wall of the second temperature conducting part 216 is provided with mounting holes 2165 corresponding to the connecting through holes 2157. The temperature regulating member 23 further includes connecting members (not shown) passing through the connecting through holes 2157 and to be connected to the mounting holes 2156. As an example, the mounting hole 2165 may be a threaded hole, and the connecting member may be a bolt. The connecting member can extend through the through hole to directly engage with the corresponding threaded hole, thereby fixing the second temperature conducting part 216 on the first temperature conducting part 215. As another example, the connecting member may be a pin, and the outer diameter of the mounting hole 2165 is smaller than or equal to the outer diameter of the pin, and the pin may be fixed in the mounting hole 2165 by an interference fit, so as to fix the second temperature conducting part 216 to the first temperature conducting part 215.

Figure 34:
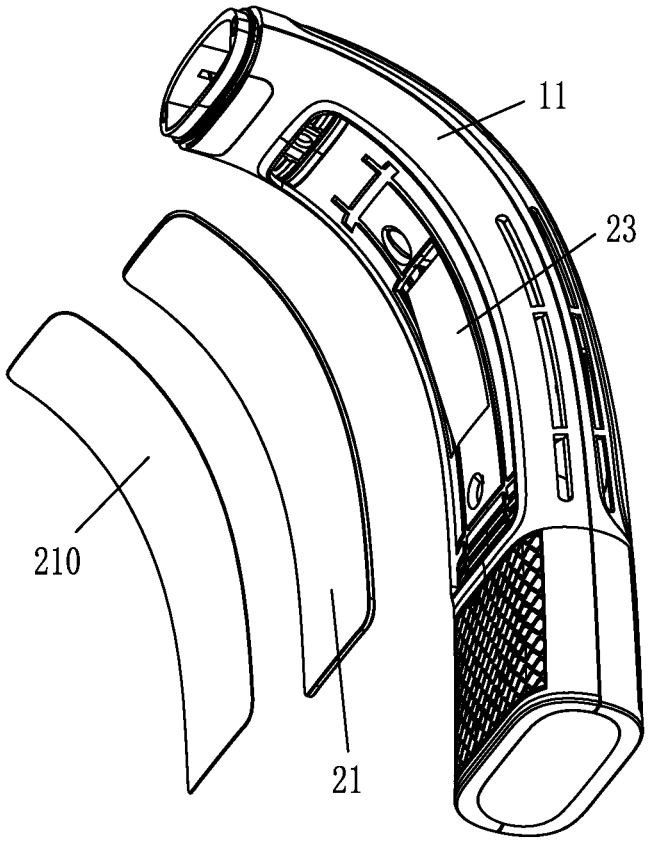
FIG. 34 is a partial exploded view of a shell of the wearable air conditioner of the tenth embodiment.
Figure 35:
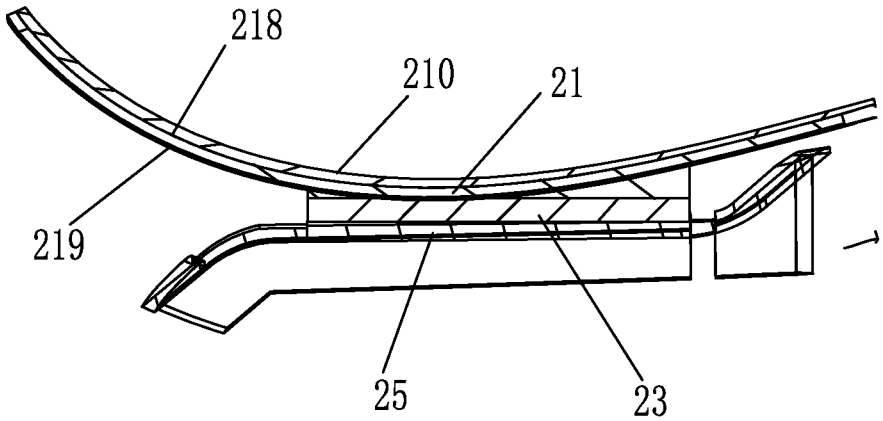
FIG. 35 is a cross sectional view of a portion of the wearable air conditioner of the tenth embodiment.

FIG. 33 to FIG. 35 illustrate a portable wearable air conditioner in accordance with a tenth embodiment of the present invention. The portable wearable air conditioner of the tenth embodiment differs from that of the sixth embodiments in that: the wearable air conditioner has a temperature indicating function. Specifically, a temperature sensing layer 210 is attached to a surface of the temperature conducting portion 21 and configured for indicating temperature information of the temperature conducting portion 21. The temperature conducting portion 21 includes a contact surface 218 exposed out of the shell 11 and a connecting surface 219 opposite to the contact surface 218. The contact surface 218 is configured to contact with the human body and the temperature-sensing layer 210 is located on the contacting surface 218. Preferably, the temperature sensing layer 210 is distributed on the whole contacting surface 218 and exposed to the wearing space 101. Of course, besides the contact surface 218, the temperature sensing layer 210 may also be located on other surfaces of the temperature conducting portion 21, such as all surfaces of the temperature conducting portion 21, which is not limited herein. In this embodiment, the temperature regulating member 23 is a semiconductor refrigeration chip or semiconductor heating chip. The temperature conducting portion 21 is disposed at the outer surface of the shell 11 and in thermal connection with the temperature regulating member 23. When the wearable air conditioner is worn around the wearing portion of the user, the cold energy or heat energy generated by the temperature regulating member 23 can be conducted to the wearing portion of the user for cooling or heating via the temperature conducting portion 21. The temperature sensing layer 210 is attached to the surface of the temperature conducting portion 21 for indicating temperature information of the temperature conducting portion 21. The temperature sensing layer 210 may be a temperature sensing ink which is formed on the contact surface 218 by spraying. The temperature sensing layer 210 made of thermal conductive material does not block thermal conduction between the temperature conducting portion 21 and the skin of the wearing part of the user. Of course, the temperature sensing layer 210 can also be attached to the contact surface 218 of the temperature conducting portion 21 by other means, such as adhesive, and is not limited herein.

Further, the temperature sensing layer 210 is capable of displaying different colors in response to different temperatures of the temperature conducting portion 21. In this embodiment, the temperature sensing layer 210 prompts/indicates the current temperature information of the temperature conducting portion 21 through change of color, which is convenient for the user to observe. The color change of the temperature sensing layer 210 belongs to physical change. Further, the temperature regulating member 23 has a first state and a second state. When the temperature regulating member 23 is in the first state and the temperature of the temperature conducting portion 21 is not greater than a preset threshold value, the temperature sensing layer 210 presents a first color; when the temperature regulating member 23 is in the second state and the temperature of the temperature conducting portion 21 is greater than the preset threshold value, the temperature sensing layer 210 presents a second color, and the first color and the second color are two different colors. In this embodiment, the first state of the temperature regulating member 23 refers to a cooling state in which cold energy is output to the temperature conducting portion 21, and the second state of the temperature regulating member 23 refers to a heating state in which heat energy is output to the temperature conducting portion 21 or an inoperative state. The preset threshold value is, for example, 28 degrees Celsius, and when the temperature of the temperature conducting portion 21 is not higher than 28 degrees Celsius, the temperature sensing layer 210 presents black; when the temperature of the temperature conducting portion 21 is higher than 28 degrees Celsius, the temperature sensing layer 210 presents orange. Of course, in other embodiments, the first color and the second color may be other colors besides black and orange, and are not limited herein as long as the first color and the second color are two different colors. The preset threshold value may also be set to another temperature value according to the actual demand. Further, when the temperature regulating member 23 is switched between the first state and the second state, the color of the temperature sensing layer 210 is switched between the first color and the second color in a gradual manner. In this embodiment, when the state of the temperature regulating member 23 changes, the color of the temperature sensing layer 210 changes in a gradual manner until the color of the temperature sensing layer 210 corresponds to the current state of the temperature regulating member 23. The gradual change manner means that change of the color of the temperature sensing layer 210 is a gradual change process. Optionally, the temperature regulating member 23 is attached to the middle portion of the temperature conducting portion 21 to realize heat conduction connection. When the temperature regulating member 23 is switched between the first state and the second state, the color of the temperature sensing layer 210 gradually changes in a direction from the middle portion of the temperature conducting portion 21 toward the periphery of the temperature conducting portion 21.

In this embodiment, the middle portion of the temperature regulating member 23 and the temperature conducting portion 21 are bonded by a heat conductive adhesive. Preferably, the area of the temperature regulating member 23 is smaller than that of the temperature conducting portion 21, and the temperature sensing layer 210 is fully covered on the contact surface 218 of the temperature conducting portion 21. Thus, when the state of the temperature regulating member 23 is switched, the color of a middle portion of the temperature sensing layer 210 corresponding to the middle portion of the temperature conducting portion 21 is changed first, and the color of the temperature sensing layer 210 gradually changes from the middle portion thereof, corresponding to the middle portion of the 21, to the periphery thereof, corresponding to the periphery of the heat conducting member temperature conducting portion 21, until the color of the temperature sensing layer 210 completely corresponds to the current state of the temperature regulating member 23.

In this embodiment, the temperature sensing layer 210 provided on the surface of the temperature conducting portion 21 is capable of prompting the temperature information of the temperature conducting portion 21. The color of the temperature sensing layer 210 can change in response to the change of the temperature of the temperature conducting portion 21. Thus, the user can easily distinguish the current temperature information of the temperature conducting portion 21 according to the color of the temperature sensing layer 210, which brings a great convenience to the user during the using process. The technical problem that the temperature conducting portion 21 of the wearable temperature adjusting device in the prior art does not have a temperature prompting function is solved.

Of course, in other embodiments, the temperature sensing layer 210 may also be made of other materials that can be changed physically, for example, materials that can expand with heat and contract with cold, so as to indicate the temperature information of the temperature conducting portion 21. For example, when the temperature regulating member 23 is in the first state and the temperature of the temperature conducting portion 21 is not greater than the preset threshold value, the temperature sensing layer 210 shrinks in volume. When the temperature regulating member 23 is in the second state and the temperature of the temperature conducting portion 21 is greater than the preset threshold value, the temperature sensing layer 210 expands in volume. Thus, the user can quickly know the current thermal state (heating state/refrigeration state) of the temperature conducting portion 21 through the change of the temperature sensing layer 210.

FIG. 38 to FIG. 45 illustrate a portable wearable air conditioner in accordance with a twelfth embodiment of the present invention. The portable wearable air conditioner comprises a body 10 and a temperature adjusting unit 20, a fan 24, a battery 22 and a circuit board 27 which are installed in the body 10. The temperature adjusting unit 20 comprises a temperature regulating member 23. The temperature regulating member 23, the fan 24 and the battery 22 are respectively electrically connected to the circuit board 27 such that the battery 22 is capable of supplying power to the temperature regulating member 23 and the fan 24.

The body 10 comprises a middle enclosure 30 and at least one shell 11. The middle enclosure 30 and the shell 11 are pivotably connected to each other via a pivotal connecting structure such that the shell 11 is pivotable relative to the middle enclosure 30 in a left-right direction to facilitate the user to wear the portable wearable air conditioner. In this embodiment, the body 10 comprises a pair of shells 11 respectively pivotably connected to opposite ends of the middle enclosure 30 via a pair of pivotal connecting structures. Thus, the portable wearable air conditioner is symmetrical about a center line in the left-right direction, which facilitates to increase the aesthetic appearance of the portable wearable air conditioner. An opening is formed between free ends of the shells 11. The pair of shells 11 are pivotable relative to the middle enclosure 30 to enlarge or reduce the size of the opening. Understandably, in other embodiments, the body 10 has only one shell 11 which is connected to one end of the middle enclosure 30 via one pivotal connecting structure.

In the embodiment, two fans 24 are provided. Specifically, the two fans 24 are respectively disposed in the two shells 11. The temperature adjusting unit 20 is disposed in the middle enclosure 30. Thus, the portable wearable air conditioner of the present embodiment can not only cool down through the temperature adjusting unit 20 in the middle enclosure 30, but also cool down through the fans 24 in the shells 11, which is convenient for the user to use.

The temperature adjusting unit 20 comprises a heat dissipation member 25 disposed in the middle enclosure 30, a temperature conducting portion 21 disposed on the inner sidewall of the middle enclosure 30, a temperature regulating member 23 disposed between the heat dissipation member 25 and the temperature conducting portion 21, and a cooling fan 40 close to one end of the heat dissipation member 25 for cooling the hot end of the temperature regulating member 23. That is, the temperature conducting portion 21 is in thermal contact with the temperature regulating member 23, and the heat dissipation member 25 is disposed at a side of the temperature regulating member 23 opposite to the temperature conducting portion 21 and in thermal contact with the temperature regulating member 23. Specifically, the temperature regulating member 23 is a semiconductor refrigeration chip in thermal contact with the temperature conducting portion 21. The inner sidewall of the middle enclosure 30 protrudes outwardly to form a convex portion 320. The temperature conducting portion 21 is connected to the convex portion 320 and extends out of the inner sidewall of the middle enclosure 30. The temperature conducting portion 21 has an arcuate shape adapted to a human neck. The temperature conducting portion 21 can be secured to the convex portion 320 via a snap-fit joint or any other connecting means. The heat dissipation member 25 comprises a bottom plate 250 and a plurality of fins 251 extending from the bottom plate 250. The fins 251 are spaced from each other with a channel 252 formed between any two adjacent fins 251. In the length direction of the body 10, one end of the bottom plate 250 extends beyond the fins 251. The cooling fan 40 is at least partially located on the bottom plate 250 and the air outlet of the cooling fan 40 faces the channels 252 such that the airflow generated by the cooling fan 40 can flow into the channels 252 to thereby cool the fins 251. The outer sidewall of the middle enclosure 30 is provided with vent holes 123 corresponding to the heat dissipation member 25 and air intake holes 130 corresponding to the cooling fan 40. Heat generated by heat dissipation element 25 is dissipated through the vent holes 123 and the cooling fan 40 intakes air through the air intake hole 130.

In the illustrated embodiment, the fan 24 is disposed at the free end of the shell 11 away from the middle enclosure 30. The inner sidewall and the outer sidewall of the shell 11 are respectively provided with air inlets 13 corresponding to the fan 24 such that the fan 24 can intake air through the air inlets 13. An air passage 30 corresponding to the fan 24 is formed inside the shell 11. The sidewall of the shell 11 defines air outlets 14 arranged in the length direction of the shell 11. The air outlets 14 may be defined at inner sides of the top sidewall and bottom sidewall of the shell 11. In the present embodiment, the air outlet 14 comprises a plurality of air outlet openings arranged in the length direction of the shell 11 at intervals. The airflow generated by the fan 24 exits the outlets 14 after passing through the air passage 30. In other embodiments, the air outlet 14 may comprises one or more elongated slots extending along the length direction of the shell 11.

Further, in this embodiment, a partition 26 is provided inside the shell 11. The partition 26 has a major surface which extends in the length direction and the height direction of the shell 11. The partition 26 divides the internal space of the shell 11 into the air passage 140 and an accommodating chamber 170 which are distributed along the width direction of the shell 11. The air passage 30 is located within the shell 11 closer to the inner sidewall. Thus, the air passage 30 has a reduced volume to thereby make the airflow more concentrated and powerful. The battery 22 and the circuit board 27 may be disposed within the accommodating chamber 170 to avoid affecting the airflow exiting from the air outlets 14.

Further, an air guide member 34 is disposed within the air passage 30. The air guide member 34 extends along the length direction of the shell 11. Specifically, the air guide member 34 has a V shape. The air guide member 34 comprises a pair of major surfaces extending in the length direction and width direction of the shell 11. The air guide member 34 may integrally extend from the inner sidewall of the shell 11 or be mounted to the inner sidewall of the shell 11. The air guide member 34 may be an integrally formed component or assembled by multiple components, which can be adjusted according to actual requirements. In this embodiment, the air guide member 34 is secured to the inner sidewall of the shell 11 via screws. Specifically, the sharp end of the air guide member 34 faces and is close to the fan 24. The sharp end of the air guide member 34 may be closer to the top sidewall or the bottom sidewall, to thereby divide the entrance of the air passage 30 into two parts with different sizes. Two diverged ends of the air guide member 34 extend to the top sidewall and the bottom sidewall of the shell 11 respectively. The airflow generated by fan 24 is divided into two streams after passing through the air guide member 34. One stream flows towards the air outlet 14 of the top sidewall and then blows out from the air outlet 14 of the top sidewall; and the other stream flows towards the air outlet 14 of the bottom sidewall, and then blows out from the air outlet 14 of the bottom sidewall.

Figure 42:
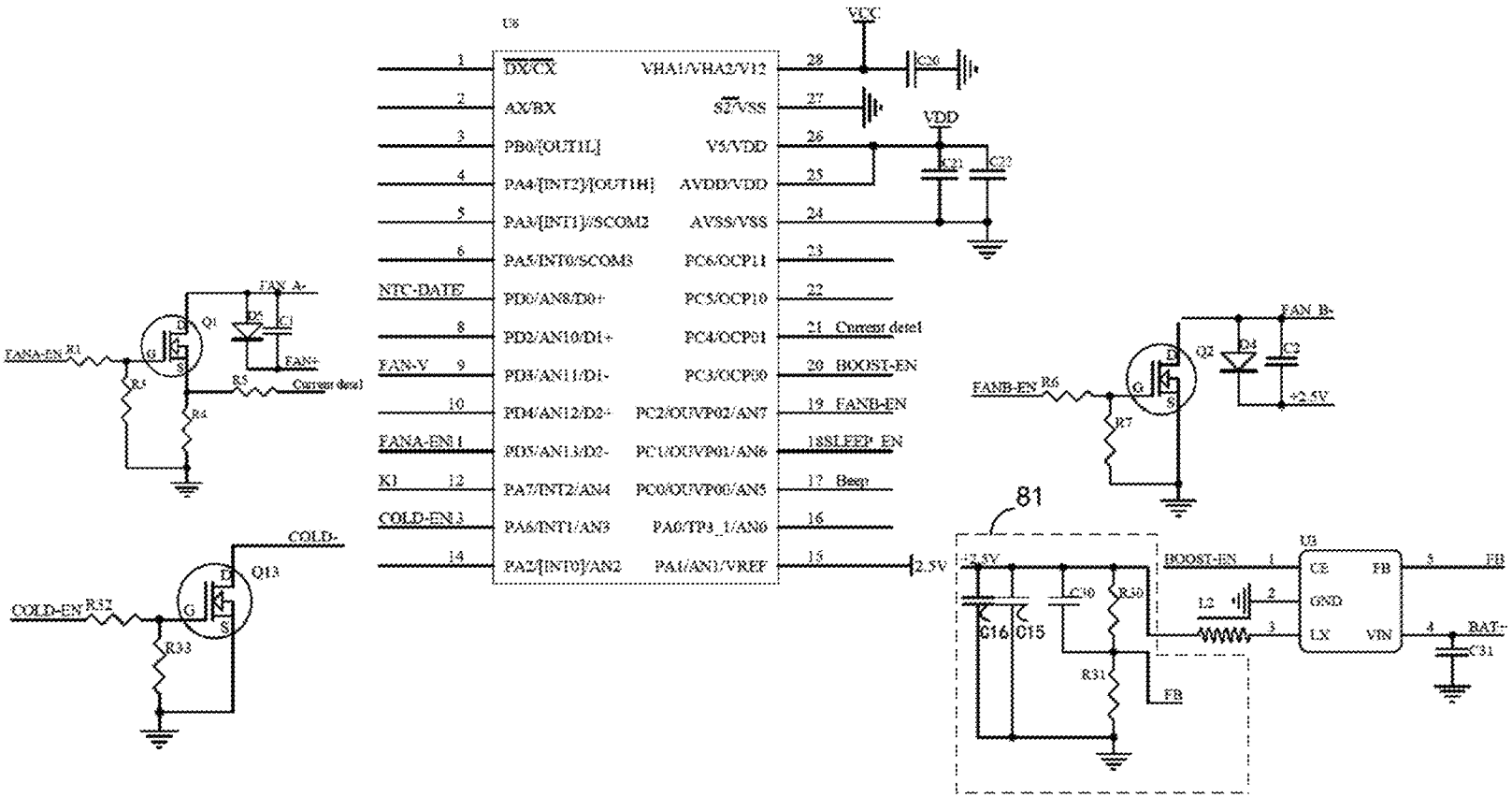
FIG. 42 is an explanatory view schematically showing a circuit diagram of the wearable air conditioner of FIG. 38.

In some embodiments, the temperature adjusting unit 20 further comprises a button 117 configured to control the fan 24 and the temperature regulating member 23. The button 117 mechanically cooperates with a control switch mounted on the circuit board 27. The button 117 can be arranged on the outer sidewall of the middle enclosure 30 or the shell 11 to facilitate operation of the user. The button 117 can control the fan 24 and the temperature regulating member 23 through various control methods. For example, short press of the button 117 can control the fan 24 to switch among working modes of ON, different settings and OFF, and long press of the button 117 can control the temperature regulating member 23 to switch between ON and OFF working modes. Referring to FIG. 42 which is a schematic diagram of the circuit principle of the temperature regulating module 20, in an optional embodiment, the circuit board 27 is provided with a main control chip U6, and the corresponding circuit of the button 117 includes the touch control chip U3. The reference voltage end VREF of the main control chip U6 is connected to the control end LX of the touch chip U3 through the booster circuit 81. The booster circuit 81 comprises a first capacitor C16 and a second capacitor C15 connected in parallel. The first resistor R30 and the second resistor R31 connected in series are connected with the second capacitor C15 in parallel. The node between the first resistor R30 and the second resistor R31 is connected with the feedback end FB of the touch chip U3. The main control chip U6 comprises a first fan control terminal FANA-EN and a second fan control terminal FANB-EN respectively connected to the fan 24, and a temperature control terminal COLD-EN connected to the temperature regulating member 23. The first fan control terminal FANA-EN is connected to the motor of one of the fans 24 through the first switching transistor Q1, the second fan control terminal FANB-EN is connected to the motor of another fan 24 through the second switching transistor Q2, and the temperature control terminal COLD-EN is connected to the temperature regulating member 23 through the third switching transistor Q13. The touch chip U3 is configured to detect the user's keystroke duration and send it to the main control chip U6. After recognizing the current keystroke operation, the main control chip U6 issues a corresponding control command through the first fan control terminal FANA-EN, the second fan control terminal FANB-EN, or the temperature control terminal COLD-EN, to thereby realize switching of the working modes of the control fan 24 and the temperature regulating member 23. Optionally, the first switching transistor Q1, the second switching transistor Q2 and the third switching transistor Q13 can adopt field effect transistors respectively.

Further, the temperature adjusting unit 20 further comprises a buzzer, which is electrically connected with the circuit board 27, so that sound can be generated when the button 117 is pressed, so as to facilitate the user to perceive the effective operation of the button 117. For example, the buzzer generates a long buzzing sound when long-pressing the button 117, and generates a short buzzing sound when short-pressing the button 117.

Figure 43:
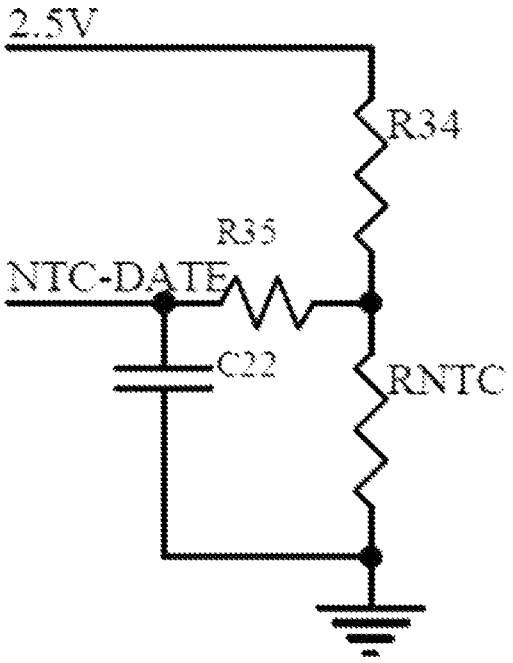
FIG. 43 is an explanatory view schematically showing a circuit diagram of a temperature detecting device the wearable air conditioner of FIG. 38.
Figure 44:
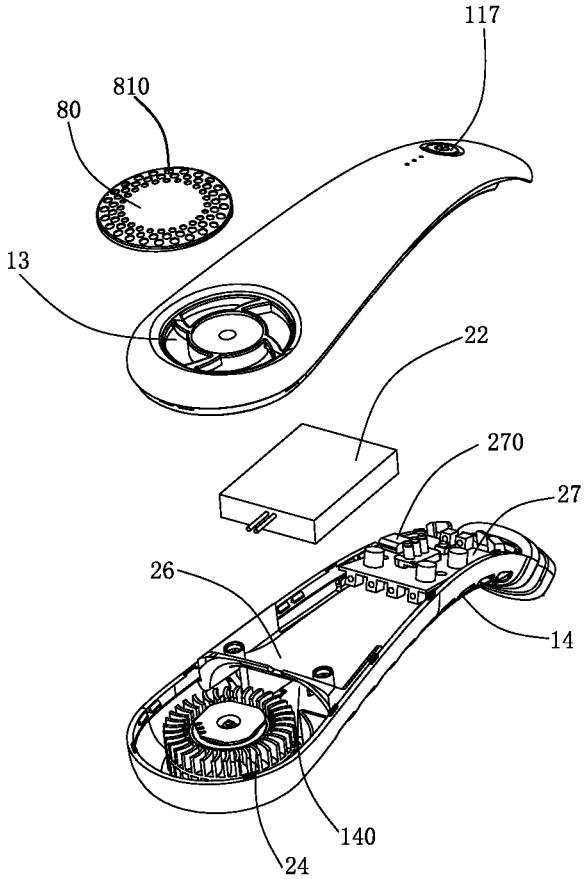
FIG. 44 is an exploded view of a shell of the wearable air conditioner of FIG. 39.

Further, the temperature adjusting unit 20 further comprises a temperature sensor which may be disposed within the middle enclosure 30 and electrically connected with the circuit board 27. The temperature sensor is configured to detect the temperature of the temperature regulating member 23. When the temperature sensor detects that the temperature of the temperature regulating member 23 is too high, it can control the temperature regulating member 23 to stop working, so as to avoid danger of melting the enclosure when the temperature is too high. Referring to FIG. 43, in an optional embodiment, the temperature sensor comprises a thermistor RNTC connected to the temperature-sensitive control terminal NTC-DATE of the main control chip U6. The resistance value of the thermistor RNTC varies according to the temperature variation of the temperature regulating member 23. The main control chip U6 can determine whether the current temperature is too high or not according to the change of the resistance value of thermistor RNTC, so as to avoid the fault or danger caused by the over-high temperature of the temperature regulating member 23.

Further, the temperature regulating member 23 being turn off by operating the button 117 can be set as: the temperature regulating member 23 stops working first, and the cooling fan 40 continues to work for a period of time, such as 5-10 S, so as to thoroughly cool the heat dissipating member 25 and improve the product quality. The temperature regulating member 23 stopping working first, and the cooling fan 40 stopping working after a preset time can comprise: after obtaining the information/command/indication to turn off the temperature regulating member 23, the main control chip U6 controls the temperature regulating member 23 to stop working via the temperature control terminal COLD-EN and starts timing at the same time. When the time interval reaches the preset value, the main control chip U6 controls the fan 24 stop working via the first fan control terminal FANA-EN and the second fan control terminal FANB-EN.

It should be understood that in other embodiments, the wearable air conditioner may also include only fans 24 or only a temperature regulating member 23. When the wearable air conditioner includes both fan 24 and temperature regulating member 23, multiple buttons 117 may be provided to separately control the fan 24 and the temperature regulating member 23. Alternatively, when multiple button 117 are provided, one button 117 is configured to control ON/OFF, the other button 117 is configured to control the settings, and so on. The button 117 can also have a variety of trigger control modes.

In the illustrate embodiment, the rotating connection structure comprises a first connecting member 38 and a second connecting member 36. Adjacent ends of the first connecting member 38 and the second connecting member 36 are rotationally connected to each other, and ends of the first connecting member 38 and the second connecting member 36 far away from each other are fixedly connected with the middle enclosure 30 and the shell 11 respectively. End faces of ends of the first connecting member 38 and the second connecting member 36 close to each other are provided with a tooth part 42 and a meshing part 44. The tooth part 42 comprises a plurality of teeth and tooth grooves formed between adjacent teeth. When the shell 11 rotates relative to the middle enclosure 30, the meshing part 44 can be held in any one of the tooth grooves of the tooth part 42 for positioning. Thus, the shell 11 can be maintained in different positions, so as to adjust the width of the wearing space formed between the two shells 11, to prevent abnormal rotation. Preferably, the first connecting member 38 and the second connecting member 36 are made of metal materials with high strength and good wear resistance.

More specifically, the first connecting member 38 comprises the first connecting part 46 and two pivoting parts 48 connected to one end of the first connecting part 46 near the second connecting member 36. The two pivoting parts 48 are arranged at intervals, and the tooth part 42 is formed on the end face of the connecting parts 48 near the second connecting member 36. Preferably, the end face of the connecting part 48 near the second connecting member 36 is a convex curved surface, and the tooth part 42 comprises a plurality of elongated teeth arranged at intervals along the direction of rotation, and a tooth groove is formed between two adjacent elongated teeth. A slot is formed between two pivoting parts 48, and first pivoting holes 50 are defined in the pivoting parts 48. The second connecting part 36 comprises a second connecting part 52 and a pivoting part 54 connected to one end of the second connecting part 52 close to the first connecting part 38. The pivoting part 54 is provided with a second pivoting hole 58. Preferably, shaft 56 is arranged on opposite sides of the pivoting part 54. For example, the shaft 56 is extended through the pivoting part 54, and the second pivoting hole 58 passes through the shaft 56. The meshing part 44 is arranged on the end face of the second connecting part 52 near the first connecting part 38. Preferably, the meshing part 44 comprises a plurality of convex bars extending along the axial direction of the rotating connecting structure.

In assembly, the rotating part 54 and the shaft 56 are received in the slot between the pivoting parts 48 with the meshing part 44 being meshed with the tooth part 42 and the meshing part 44 being hold in one of the tooth grooves of the tooth part 42. The first pivoting holes 50 and the second pivoting holes 58 are aligned with each other. A pin can extend through the first pivoting hole 50 and the second pivoting hole 58 to thereby pivotably connect the first connecting part 38 and the second connecting part 36.

Preferably, the connecting part 48 is provided with a projection 49 at each of opposite ends of the curved surface, and the tooth part 42 is formed on the curved surface and located between the two projections 49. The projections 49 are used to block/abut against/stop the second connecting part 52 when the shell 11 rotates relative to the middle enclosure 30 a predetermined angle, to prevent an excessive rotation of the shell 11 relative to the middle enclosure 30.

Preferably, the rotating connection structure further includes a damping part, such as a damping rubber ring 60. Twp damping rubber rings 60 may be provided and respectively located at opposite sides of the rotating part 54. The damping rubber rings 60 can be sleeved on the rotating shaft 56 and located between the rotating part 54 and the pivoting parts 48. For example, the damping rubber ring 60 is compressed between the rotating part 54 and the connecting part 48 for increasing the friction resistance of the rotating connection structure and thereby enhancing rotating stability of the shells 11.

In the illustrated embodiment, the rotating connection structure is enclosed with a protective sleeve to prevent the user's hair from being wound around the rotating shaft. Specifically, the protective sleeve comprises a soft sleeve 62 and two hard/solid parts 64 fixed at opposite ends of the soft sleeve 62 respectively. The two hard parts 64 are respectively sleeved on the first connecting member 38 and the second connecting member 36. The two hard parts 64 are provided at the two ends of the soft sleeve 62 such as through injection molding, which can effectively avoid gaps being generated between the ends of the soft sleeve 62 and the middle enclosure 30/the shells 11 during deformation of the soft sleeve 62, and improve the aesthetic appearance of the device.

The first connecting part 46 and the second connecting part 52 are respectively provided with a first fixing hole 66, the two hard rubber parts 64 respectively correspond to the first fixing holes 66 are provided with second fixing holes 68, the inner surface of the middle enclosure 30 and the shell 11 are respectively provided with studs 70. The stud 70 defines a threaded hole therein. In assembly, the end of the first connecting part 46 away from the second connecting part 36 extends into the middle enclosure 30, the end of the second connecting part 52 away from the first connecting part 38 extends into the end of the shell 11. Fasteners such as screws pass through the corresponding fixing holes 66/68 to be engaged in the threaded holes of the corresponding studs 70 to thereby fix the first connecting part 38 and the corresponding hard part 64 to the middle enclosure 30, and fix the second connecting part 36 and the corresponding hard part 64 to the shell 11.

Preferably, the middle portion of the soft rubber sleeve 62 defines an annular groove 72. In assembly, the annular groove 72 corresponds to/faces the rotating connection position of the rotating connection structure (that is, the position of the shaft 56), which facilitate the soft rubber sleeve 62 to deform when the shell 11 rotates relative to the middle enclosure 30, making bending of the shell 11 easier.

In order to strengthen the jointing stability between the soft rubber sleeve 62 and the hard rubber part 64, in the illustrate embodiment, a positioning slot 74 is defined in the outer surface of one end of the hard rubber part 64 jointing with the soft rubber sleeve 62. During injection molding, part of the material of the soft rubber sleeve 62 enters into the positioning slot 74, thus enhancing the jointing stability between the soft rubber sleeve 62 and the hard rubber part 64.

Preferably, the air inlet 13 of the shell 11 is covered with a metal protective cover 80. A plurality of mesh holes 810 is defined in the protective cover 80 to ensure that the external air can enter the shell 11 through the mesh holes 810 while debris such as hair is blocked from falling into the shell 11 to affect the use of the fan 24, making the appearance of the whole product more beautiful. It should be understood that the air inlet 13 can be defined only in the inner sidewall or the outer sidewall of the shell 11, and the air outlet 14 can be defined only in the top sidewall or the bottom sidewall of the shell 11.

Figure 45:
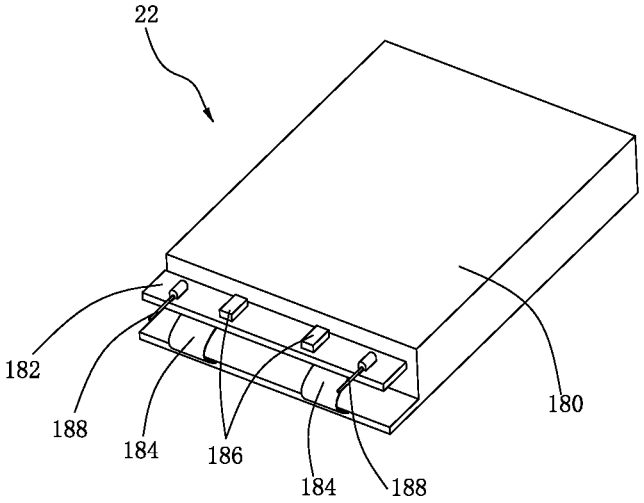
FIG. 45 illustrates a battery of the wearable air conditioner of FIG. 39.

Referring also to FIG. 45, the battery 22 comprises a battery body 180 and a protective plate 182 electrically connected to the battery body 18. The battery body 18 has a square block structure. Preferably, the battery 22 is a polymer rechargeable battery. Accordingly, a charging interface 270 is provided on the circuit board 27, which is used to connect an external power supply to charge the battery 22. The protective plate 182 is an elongated strip and arranged at a sidewall of the battery body 180. In this embodiment, the protective plate 182 is located at an outer surface of the sidewall of the battery body 180, i.e., closer to the fan 24. Of course, in other embodiments, the protective plate 182 may also be located at an inner side end or upper end or lower end of the battery body 180. The protective plate 182 is connected with positive and negative electrodes of the battery body 180 through two metal conductive plates 184. A protection chip 186 is provided on the protection plate 182 to form an over-discharge protection, over-charge protection, short-circuit protection and over-current protection for the battery body 180 to ensure the safety and the service life of the battery body 180. In addition, the protection plate 182 is provided with positive and negative leads 188 for connecting with the circuit board 27.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. A wearable air conditioner, comprising:

a body for being worn around a wearing portion of a user, the body comprising a first air passage, a first accommodating chamber, at least one air outlet in communication with the first air passage, and vent holes in communication with the first accommodating chamber;

a fan disposed in the body; and a temperature regulating member disposed in the first accommodating chamber of the body and configured to generate heat energy or cold energy, the temperature regulating member being in thermal connection with a sidewall of the body;

wherein an airflow generated by the fan is capable of entering the first air passage and the first accommodating chamber and then exiting the body via the at least air outlet and the vent holes; and wherein the body comprises an inner sidewall configured to contact with the wearing portion of the user and an outer sidewall opposite to the inner sidewall, the temperature regulating member being in thermal contact with the inner sidewall, the vent holes being defined in the outer sidewall.

2. The wearable air conditioner according to claim 1, wherein the body comprises a shell having an internal space, a partition is provided in the internal space of the shell to separate the first air passage from the first accommodating chamber such that a part of the airflow generated by the fan is capable of entering the first air passage and then exiting the shell via the at least air outlet and another part of the airflow is capable of entering the first accommodating chamber and then exiting the shell via the vent holes.

3. The wearable air conditioner according to claim 2, wherein a separating member is provided in the internal space of the shell to form a second accommodating chamber separated from the first air passage and the first accommodating chamber.

4. The wearable air conditioner according to claim 1, wherein the shell further comprises a receiving cavity configured to receive the fan, the first air passage being located between and in communication with the receiving cavity and the first accommodating chamber.

5. The wearable air conditioner according to claim 1, wherein the body comprises a shell having an internal space, the internal space of the shell is provided with a first partition to separate the first air passage from the first accommodating chamber, and a second partition to divide the first air passage into a first sub air passage and a second sub air passage; and the at least one air outlet comprises a first sub air outlet in communication with the first sub air passage and a second sub air outlet in communication with the second sub air passage.

6. The wearable air conditioner according to claim 1, wherein the inner sidewall is made of thermal conductive material; or the inner sidewall is provided with a temperature conducting portion at a position corresponding to the temperature regulating member, the temperature regulating member being in thermal contact with the temperature conducting portion.

7. The wearable air conditioner according to claim 1, wherein the inner sidewall comprises a notch and a temperature conducting portion; and the temperature regulating member is located in the notch and in thermal contact with the temperature conducting portion; or the temperature conducting portion comprises a protrusion being located in the notch and in thermal contact with the temperature regulating member.

8. A wearable air conditioner, comprising:

a body for being hung around a wearing portion of a user; and a temperature regulating member disposed in the body and configured for generating heat energy or cold energy, wherein the body comprises two shells and an elastic restore member connected between the two shells to cooperatively form a wearing space corresponding to the wearing portion; and wherein the two shells each comprises an inner sidewall facing the wearing space and the temperature regulating member is in thermal connection with the inner sidewall of at least one of the two shells;

the inner sidewall is provided with a temperature conducting portion at a position corresponding to the temperature regulating member, the temperature regulating member being in thermal contact with the temperature conducting portion;

the wearable air conditioner comprises two said temperature conducting portions respectively disposed on the inner sidewalls of the two shells, each temperature conducting portion has an arc structure comprising a first end close to the elastic restore member and a second end away from the elastic restore member;

the body comprises an initial state where the elastic restore member is in a nature state;

in the initial state, a distance between two said temperature conducting portions gradually increases and then reduces in a direction from the first end to the second end; and the distance between two said temperature conducting portions has a maximum value D, 90 mm≤D≤125 mm.

9. The wearable air conditioner according to claim 8, wherein each of the two shells is provided with a fan and an air passage corresponding to the fan inside thereof;

the air passage comprises a first sub air passage and a second sub air passage; and each of the two shells defines a first sub outlet in communication with the first sub air passage and a second sub outlet in communication with the second sub air passage, the first sub outlet and the second sub outlet defined in the same shell being arranged along a width direction of the same shell.

10. The wearable air conditioner according to claim 8, wherein the elastic restore member comprises an elastically deformable sleeve, opposite ends of the sleeve are respectively connected to the two shells, and the sleeve is arc-shaped and comprises an inner sidewall and an outer sidewall longer than the inner sidewall.

11. The wearable air conditioner according to claim 10, wherein a ratio that an arc length between midpoints of opposite two ends of the outer sidewalls of the elastic restore member and an arc length between midpoints of opposite two ends of the inner sidewalls of the elastic restore member is a1, 1.5≤a1≤2.5.

12. The wearable air conditioner according to claim 8, wherein the elastic restore member comprises a sleeve and at least one separation sheet disposed in an interior space of the sleeve, the at least one separation sheet extends along a length direction of the sleeve, the sleeve comprises an inner sidewall and an outer sidewall, and opposite sides of the at least one separation sheet are respectively connected to the inner sidewall and the outer sidewall of the sleeve, the sleeve and the at least one separation sheet being elastically deformable and restorable.

13. A portable air conditioner, comprising a shell, a temperature regulating member disposed in the shell and configured for generating heat energy or cold energy, and a temperature conducting portion attached to the shell and at least partially exposed from an outer surface of the shell, the temperature conducting portion being in thermal contact with the temperature regulating member, a temperature sensing layer being provided on a surface of the temperature conducting portion and configured for indicating temperature information of the temperature conducting portion.

14. The portable air conditioner according to claim 13, wherein the temperature sensing layer indicates temperature information of the temperature conducting portion by presenting different colors.

15. The portable air conditioner according to claim 14, wherein the temperature regulating member has a first state and a second state;

when the temperature regulating member is in the first state and the temperature of the temperature conducting portion is not greater than a preset threshold value, the temperature sensing layer presents a first color; and when the temperature regulating member is in the second state and the temperature of the temperature conducting portion is greater than the preset threshold value, the temperature sensing layer presents a second color different from the first color.

16. The portable air conditioner according to claim 13, wherein the portable air conditioner has an arc-shaped structure surrounding a wearing space, the temperature sensing layer being exposed to the wearing space.

* * * * *